US009069329B2

(12) United States Patent
Murakami et al.

(10) Patent No.: US 9,069,329 B2
(45) Date of Patent: Jun. 30, 2015

(54) IMAGE FORMING APPARATUS

(71) Applicant: CANON KABUSHIKI KAISHA, Tokyo (JP)

(72) Inventors: Atsushi Murakami, Kawasaki (JP); Shogo Miyakawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/462,761

(22) Filed: Aug. 19, 2014

(65) Prior Publication Data

US 2015/0055976 A1 Feb. 26, 2015

(51) Int. Cl.
*G03G 21/16* (2006.01)

(52) U.S. Cl.
CPC ..... *G03G 21/1661* (2013.01)

(58) Field of Classification Search
CPC combination set(s) only.
See application file for complete search history.

(56) References Cited

U.S. PATENT DOCUMENTS

| | | | |
|---|---|---|---|
| 5,802,433 | A | 9/1998 | Sato et al. |
| 7,509,071 | B2 | 3/2009 | Yoshimura et al. |
| 7,526,227 | B2 | 4/2009 | Sato et al. |
| 7,567,769 | B2 | 7/2009 | Noguchi et al. |
| 8,311,437 | B2 | 11/2012 | Sato |
| 8,862,022 | B2 | 10/2014 | Sato et al. |
| 2012/0294646 | A1 | 11/2012 | Suzuki et al. |
| 2012/0328331 | A1 | 12/2012 | Sato |
| 2014/0064782 | A1 | 3/2014 | Furukawa et al. |
| 2014/0161483 | A1 | 6/2014 | Fukui et al. |

FOREIGN PATENT DOCUMENTS

JP 4835671 B2 12/2011

OTHER PUBLICATIONS

Masaki Sato et al., U.S. Appl. No. 14/454,870, filed Aug. 8, 2014.

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

An image forming apparatus includes a movable member movable between first and second inside positions and between the second inside position and an outside position, supporting cartridges arranged in an arranging direction. At the outside position, the cartridges are detachably mountable outside a main assembly of the image forming apparatus in a direction crossing with the arranging direction and with a longitudinal direction of each cartridge. At the first inside position, the cartridges are positioned inside the main assembly. The second inside position is inside the main assembly partway of a movement path between the outside position and the first inside position. The movable member supports the cartridges so that a distance between adjacent two cartridges of the cartridges is increased with respect to the arranging direction in interrelation with movement of the movable member from the first inside position to the second inside position.

17 Claims, 36 Drawing Sheets

(a)

(b)

(a)

(b)

IMAGE FORMING APPARATUS

FIELD OF THE INVENTION AND RELATED ART

The present invention relates to an image forming apparatus, in which a plurality of cartridges are detachably mounted in a main assembly thereof, for forming a color image on a recording material (medium).

Here, the image forming apparatus is an apparatus for forming the image on the recording material by using known various image forming principles and types (processes) such as an electrophotographic process, an electrostatic recording process and a magnetic recording process. The image forming apparatus includes, e.g., a copying machine, a printer (a laser beam printer, an LED printer, or the like), a facsimile machine, an image display apparatus (electronic blackboard or electronic white board) and the like. On the recording material, the image is formed by the image forming apparatus, and the recording material may include, e.g., a sheet, an OHT sheet, an intermediary transfer member, an image displaying material, and the like.

The cartridge is prepared by integrally assembling, into a cartridge (unit), a part or all of an image forming portion including an image bearing member for forming an image and an image forming process means actable on the image bearing member. Further, the cartridge is detachably mounted in an apparatus main assembly of the image forming apparatus, and contributes to an image forming process for forming the image on the recording material. The apparatus main assembly is an image forming apparatus constituent portion excluding the cartridge in the image forming apparatus of the cartridge type.

As the image bearing member, it is possible to use an electrophotographic photosensitive member in the electrophotographic process, an electrostatic recording dielectric member in the electrostatic recording process, a magnetic recording magnetic material in the magnetic recording process, and members capable of forming the image by other various image forming principles and types. The image forming process means is a device for forming the image by acting on the image bearing member.

In the following, for convenience, an electrophotographic image forming apparatus of the cartridge type will be described as an example. As the cartridge, e.g., a process cartridge or a developing cartridge may be cited.

The process cartridge is prepared by integrally assembling, into a cartridge, an electrophotographic photosensitive member and, as an electrophotographic process means actable on the member, at least one of a charging means, a developing means and a cleaning means, and is detachably mountable to the apparatus main assembly of the electrophotographic image forming apparatus.

Accordingly, the process cartridge includes a cartridge which is prepared by integrally assembling the electrophotographic photosensitive member and the developing means as the process means into a cartridge, which is detachably mountable to the apparatus main assembly. Further, the process cartridge includes a cartridge which is prepared by integrally assembling, into a cartridge, the electrophotographic photosensitive member and, as the process means, the charging means, the developing means or the cleaning means, and is detachably mountable to the apparatus main assembly.

The process cartridge integrally including the electrophotographic photosensitive member and the developing means is referred to as a so-called integral type process cartridge. Further, the process cartridge integrally including the electrophotographic photosensitive member and the process means other than the developing means is referred to as a so-called (function) separation type process cartridge. That is, the developing means is provided in a developing unit other than the process cartridge, and the process cartridge for forming the image by being paired with the developing unit is referred to as the so-called separation type process cartridge.

According to this process cartridge type, maintenance of the image forming apparatus was able to be performed by a user himself (herself) without relying on a service person, and therefore operativity was able to be remarkably improved.

Further, the developing cartridge includes a developer carrying member (hereinafter referred to as a developing roller) for supplying the developer to the electrophotographic photosensitive member. Further, the developing cartridge accommodates a powdery developer (toner) used for developing an electrostatic latent image, formed on the electrophotographic member, by the developing roller, and is detachably mountable to the apparatus main assembly.

In the case of the developing cartridge, the electrophotographic member is mounted in the apparatus main assembly or a cartridge supporting member. Alternatively, the electrophotographic photosensitive member is provided in the so-called separation type process cartridge described above. In this case, the process cartridge does not include the developing means. Also the developing cartridge can be mounted in and dismounted from the apparatus main assembly by the user himself (herself). For that reason, the maintenance of the apparatus main assembly can be easily performed.

Therefore, the cartridge includes the above-described so-called integral type process cartridge or the above-described so-called separation type process cartridge. Further, the cartridge includes the case where the so-called separation type process cartridge and the developing cartridge are used in a pair. Further, the cartridge includes the case where the electrophotographic photosensitive member is fixedly mounted in the apparatus main assembly or on the cartridge supporting member and the developing cartridge is used so as to be actable on and detachably mountable to the electrophotographic photosensitive member. Further, the cartridge includes a unit, detachably mounted in the apparatus main assembly, which contributes to the image forming process for forming the image on the recording material.

Mounting and dismounting of the process cartridge relative to the image forming apparatus will be described. In an electrophotographic image forming apparatus in which a plurality of process cartridges are arranged in a substantially horizontal direction and are detachably mountable to the apparatus main assembly, in order to facilitate mounting and dismounting of the process cartridges, a constitution in which the plurality of the process cartridges are pulled out as a unit and then are detachably mountable in a vertical direction has been proposed (U.S. Pat. Nos. 7,567,769, 7,526,227 and 8,311,437).

In the image forming apparatus having the pulling-out constitution such that the plurality of process cartridges are pulled out as the unit and are then detachably mountable, when a pitch between adjacent drums of the cartridges is narrowed in order to shorten FPOT (first print-out time), parts (components) of adjacent process cartridges are disposed in an overlapping manner in some cases. In such cases, it can be difficult to ensure a mounting locus along which the process cartridges are individually detachably mountable.

Here, the FPOT is a time until a first recording material on which the image is formed is discharged. The drum is a rotatable member as the image bearing member.

SUMMARY OF THE INVENTION

A principal object of the present invention is to realize a state in which even under a condition such that adjacent two cartridges partly overlap with each other at an image formable position inside an apparatus main assembly of an image forming apparatus, a movable member for supporting the cartridges is moved to make the cartridges detachably mountable to the movable member at a position outside the apparatus main assembly. As a result, there is provided an image forming apparatus capable of improving usability and also capable of not only shortening FPOT but also downsizing the apparatus main assembly.

According to an aspect of the present invention, there is provided an image forming apparatus capable of forming a color image on a recording material, comprising: a movable member movable between a first inside position and a second inside position and between the second inside position and an outside position, supporting a plurality cartridges which contribute to image formation and which are arranged in an arranging direction, wherein the outside position is a position where the cartridges are detachably mountable outside a main assembly of the image forming apparatus in a direction crossing with the arranging direction and with a longitudinal direction of each of the cartridges, the first inside position is a position where the cartridges are positioned inside the main assembly at a mounting position where the cartridges are capable of performing an image forming operation, and the second inside position is inside the main assembly partway of a movement path between the outside position and the first inside position, wherein the movable member supports the cartridges so that a distance between adjacent two cartridges of the cartridges is increased with respect to the arranging direction in interrelation with movement of the movable member from the first inside position to the second inside position.

These and other objects, features and advantages of the present invention will become more apparent upon a consideration of the following description of the preferred embodiments of the present invention taken in conjunction with the accompanying drawings.

Figure 9:
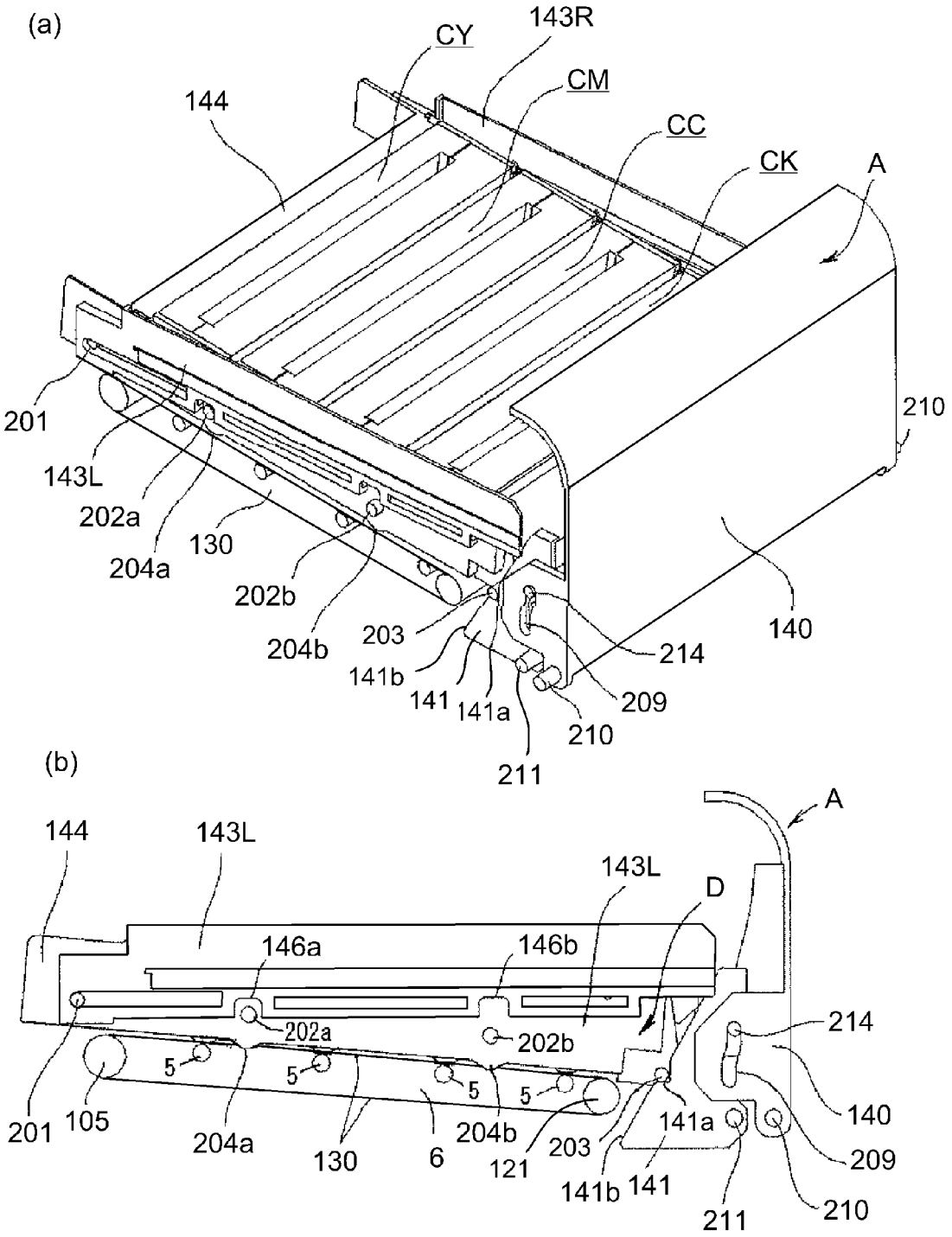
Figure 10:
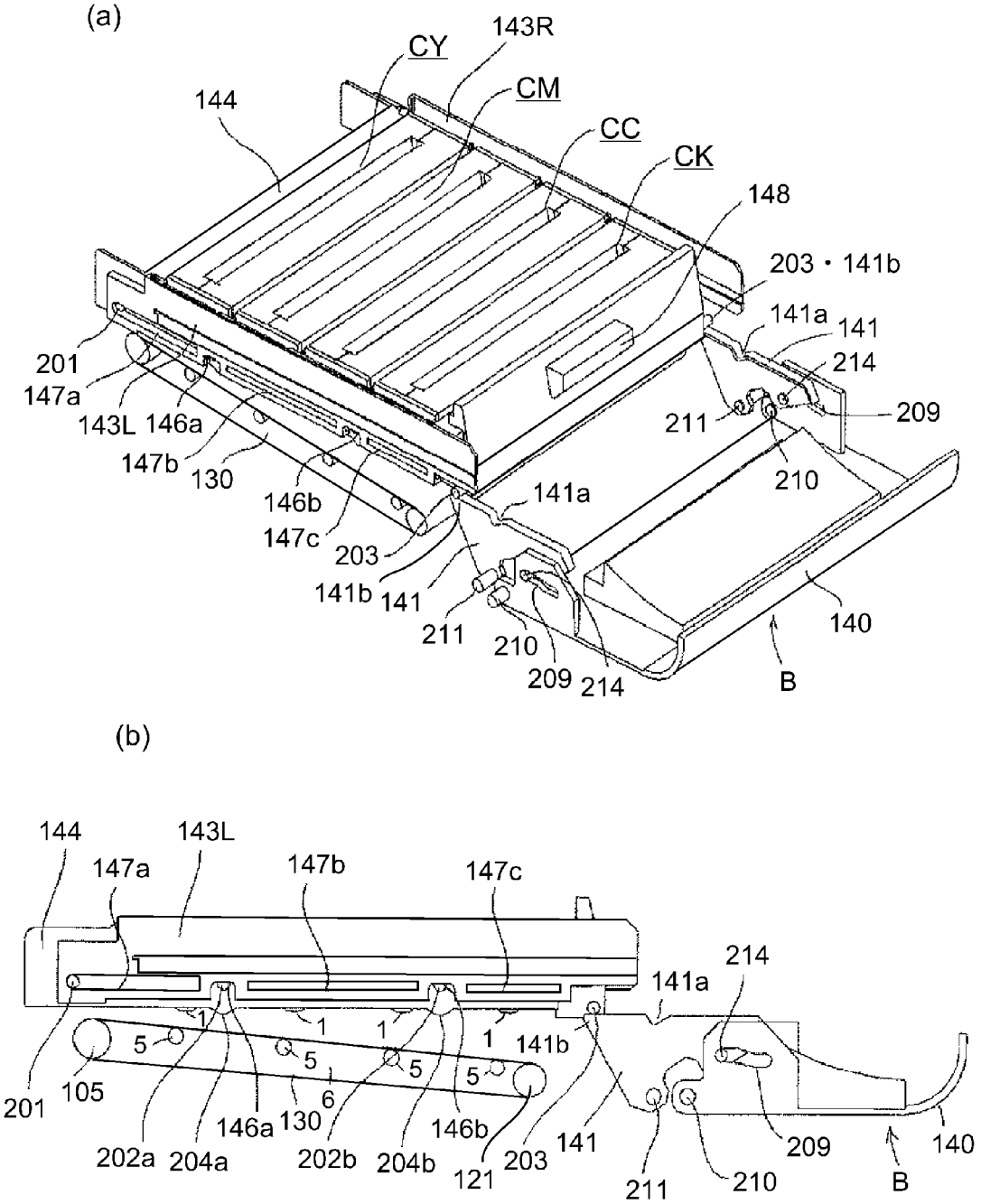
Figure 11:
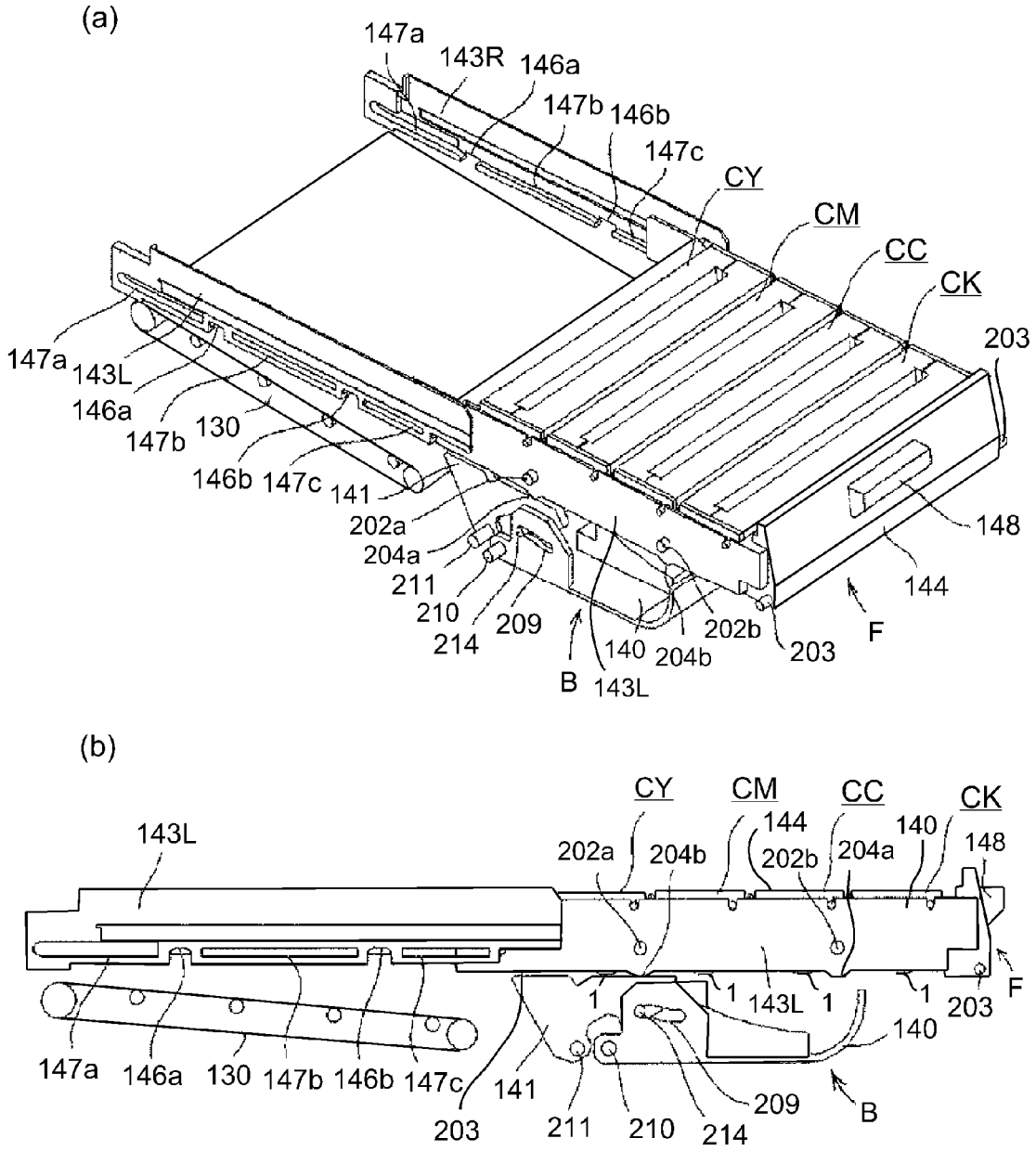

In each of FIGS. 9, 10 and 11, (a) and (b) are illustrations for explaining an interrelating mechanism and an interrelating operation between the door and the tray.

Figure 12:
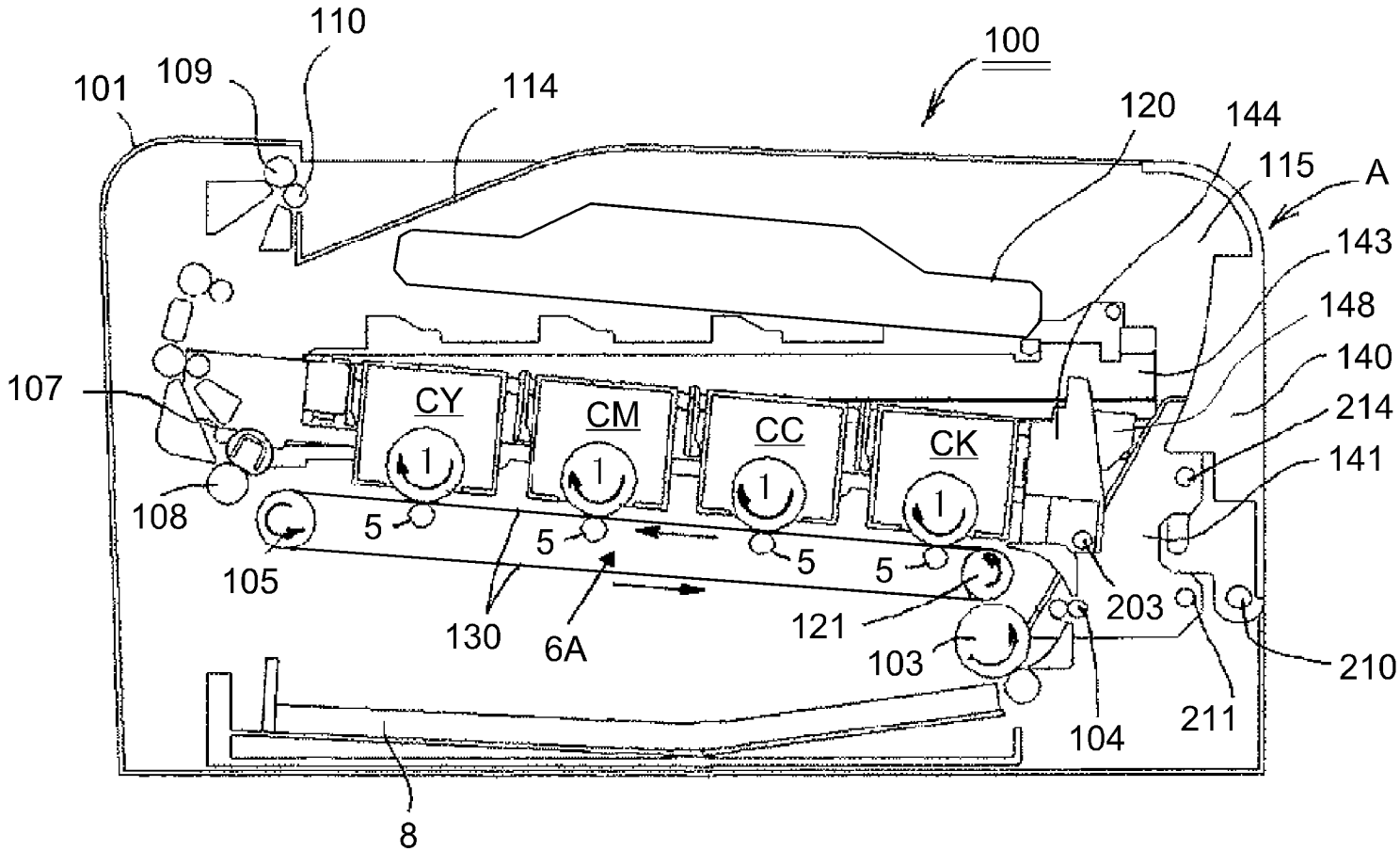

FIG. 12 is a schematic longitudinal left side view of an image forming apparatus of an ETB type using an electrostatic conveyer belt.

Figure 13:
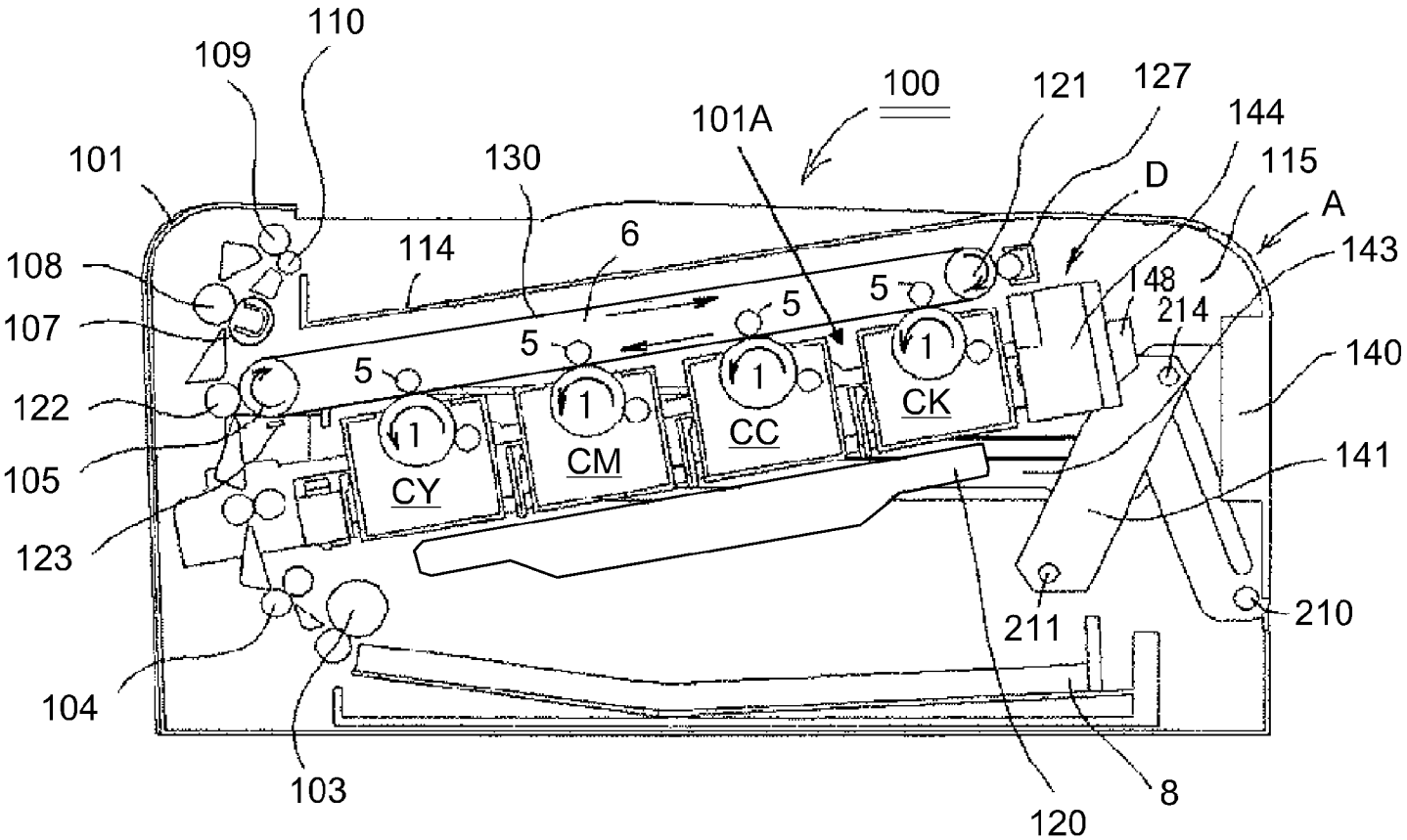

FIG. 13 is a schematic longitudinal left side view of an image forming apparatus in Reference Example 2.

Figure 14:
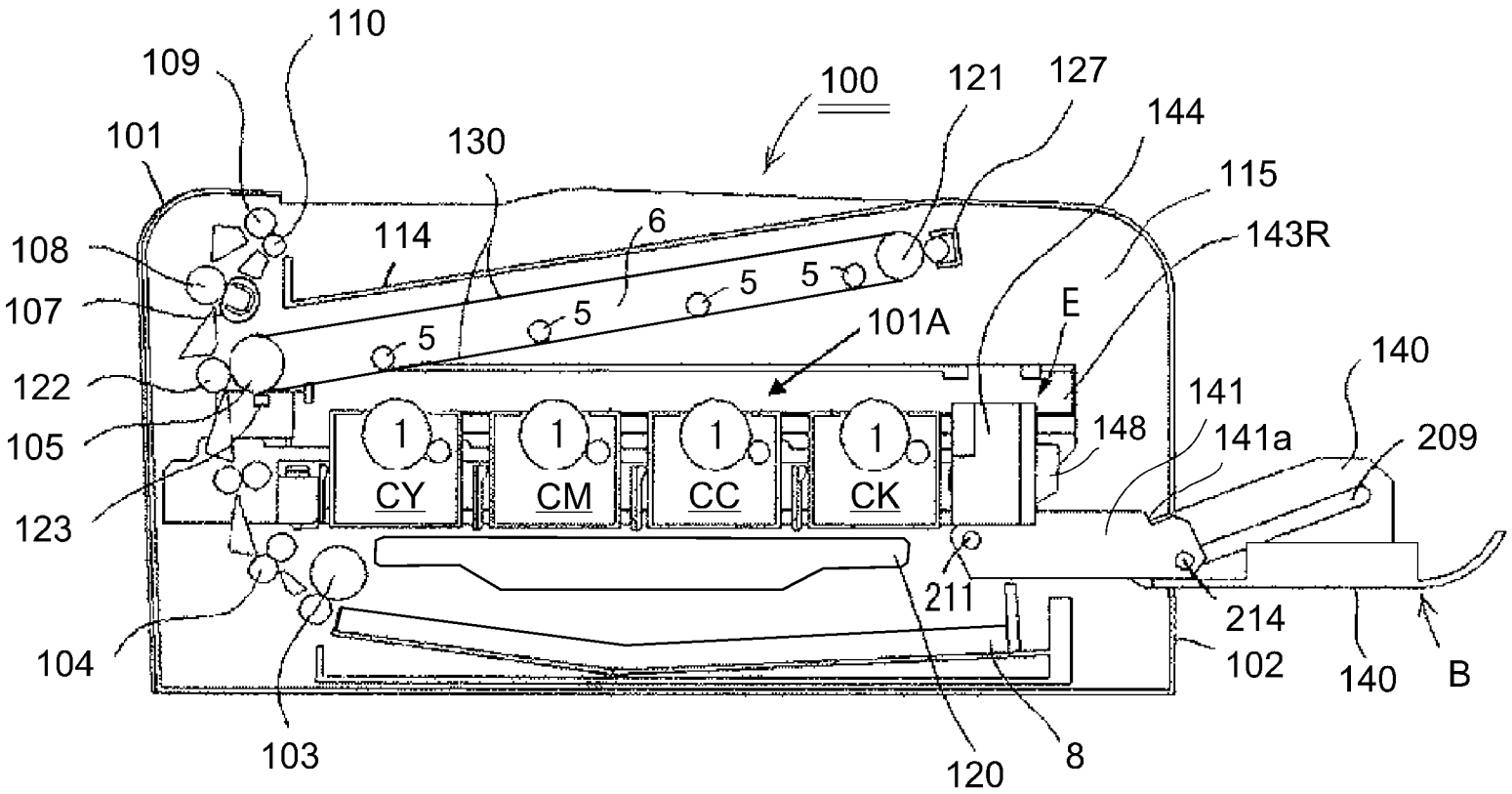

FIG. 14 is a schematic longitudinal left side view of the image forming apparatus in a state in which an opening is open by opening a door.

Figure 15:
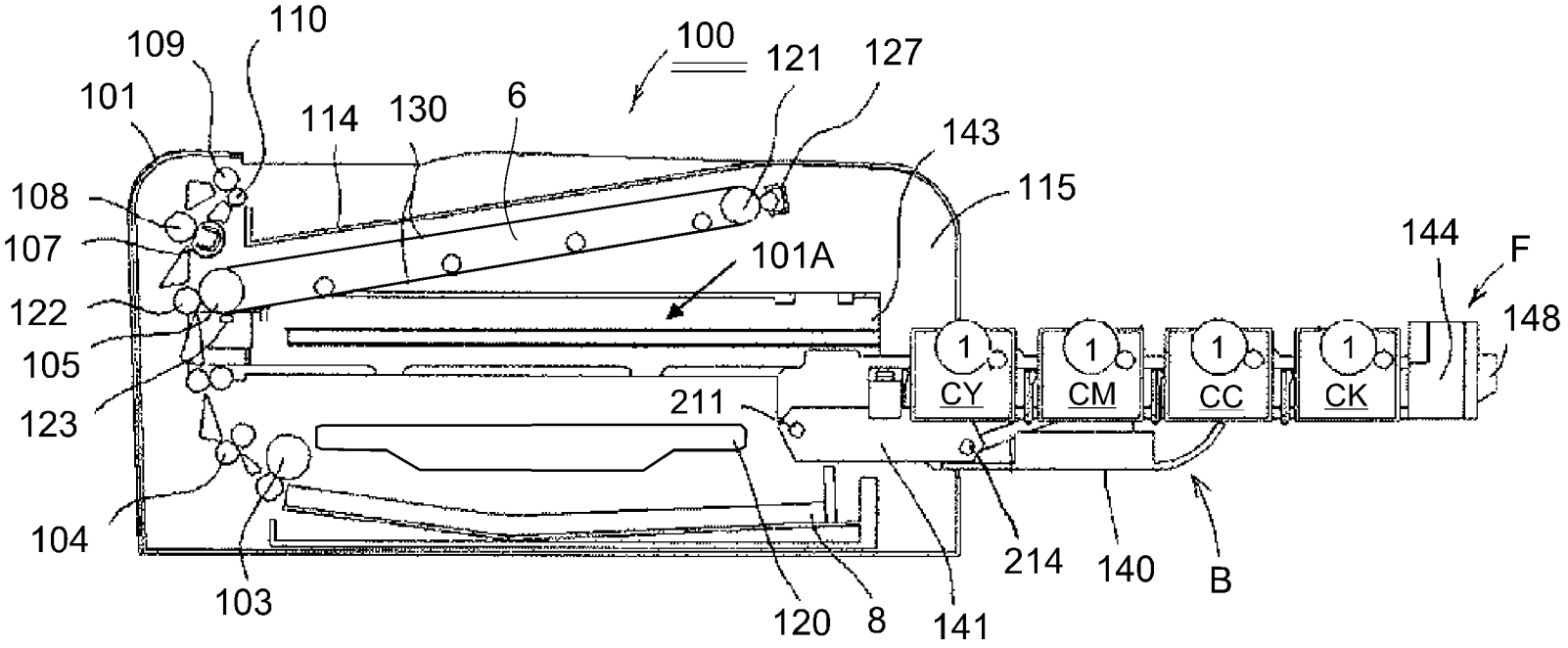

FIG. 15 is a schematic longitudinal left side view of the image forming apparatus in a state in which a tray is pulled out to an outside position.

Figure 16:
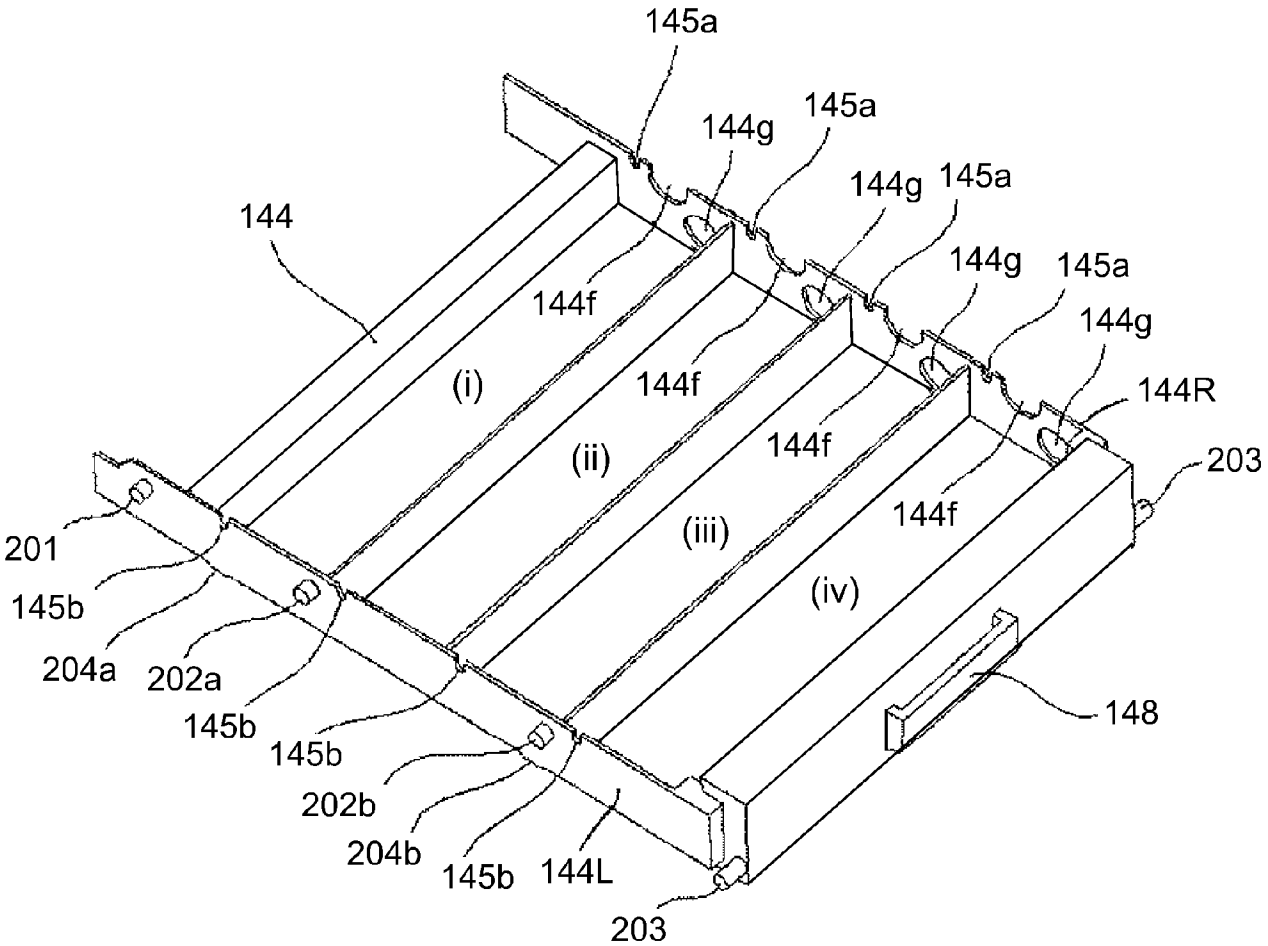

FIG. 16 is a perspective view of an outer appearance of the tray.

Figure 17:
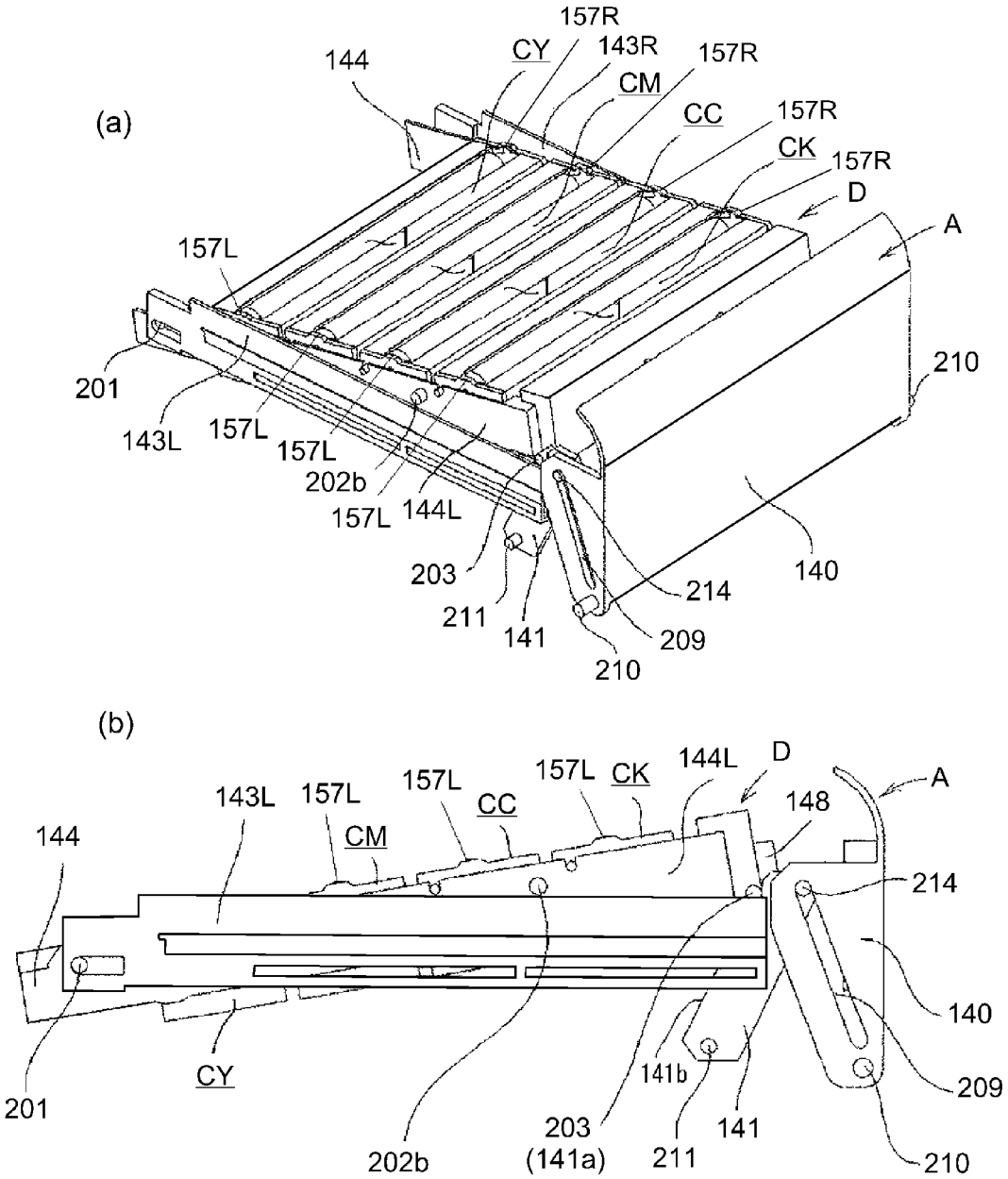
Figure 18:
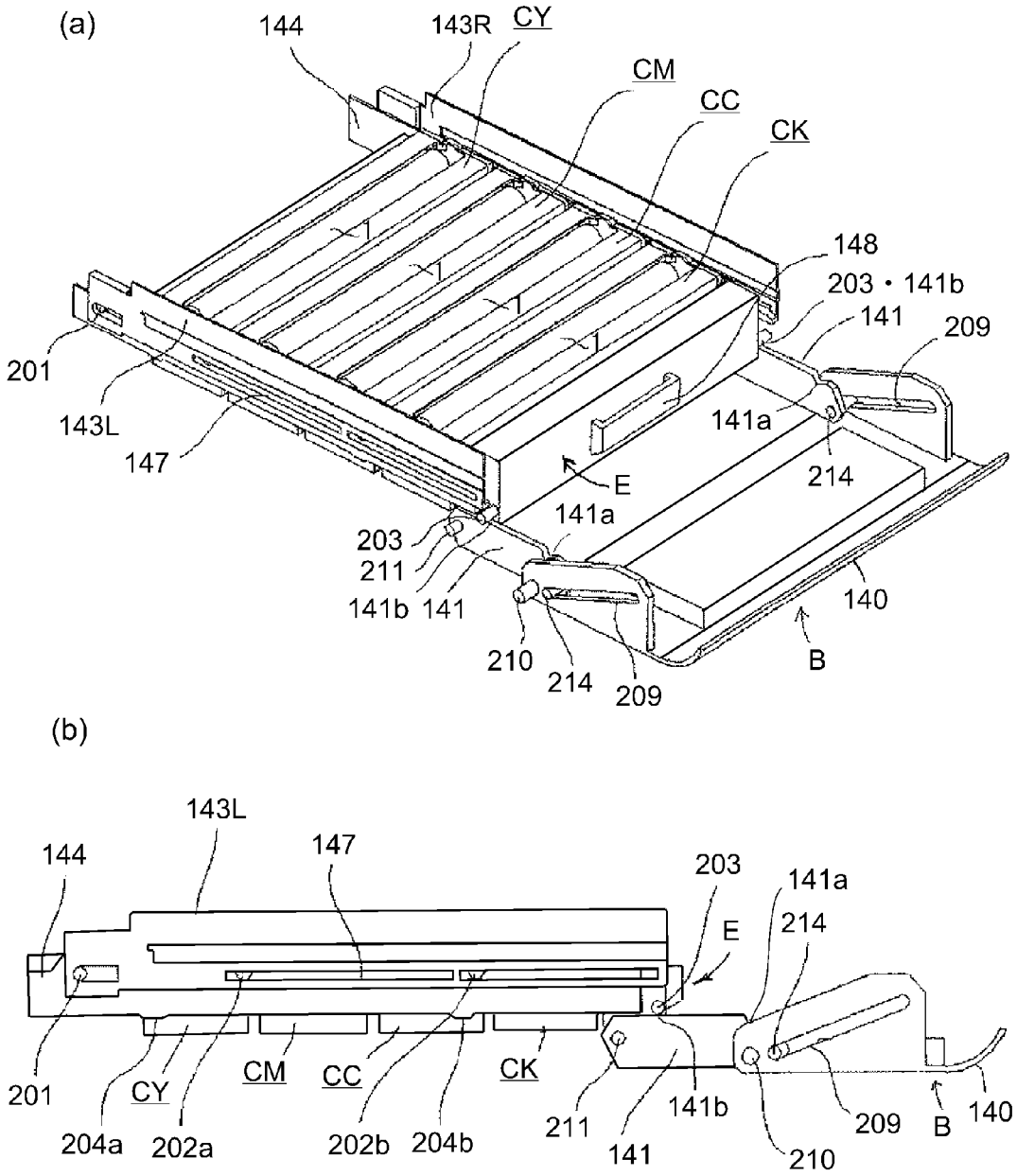
Figure 19:
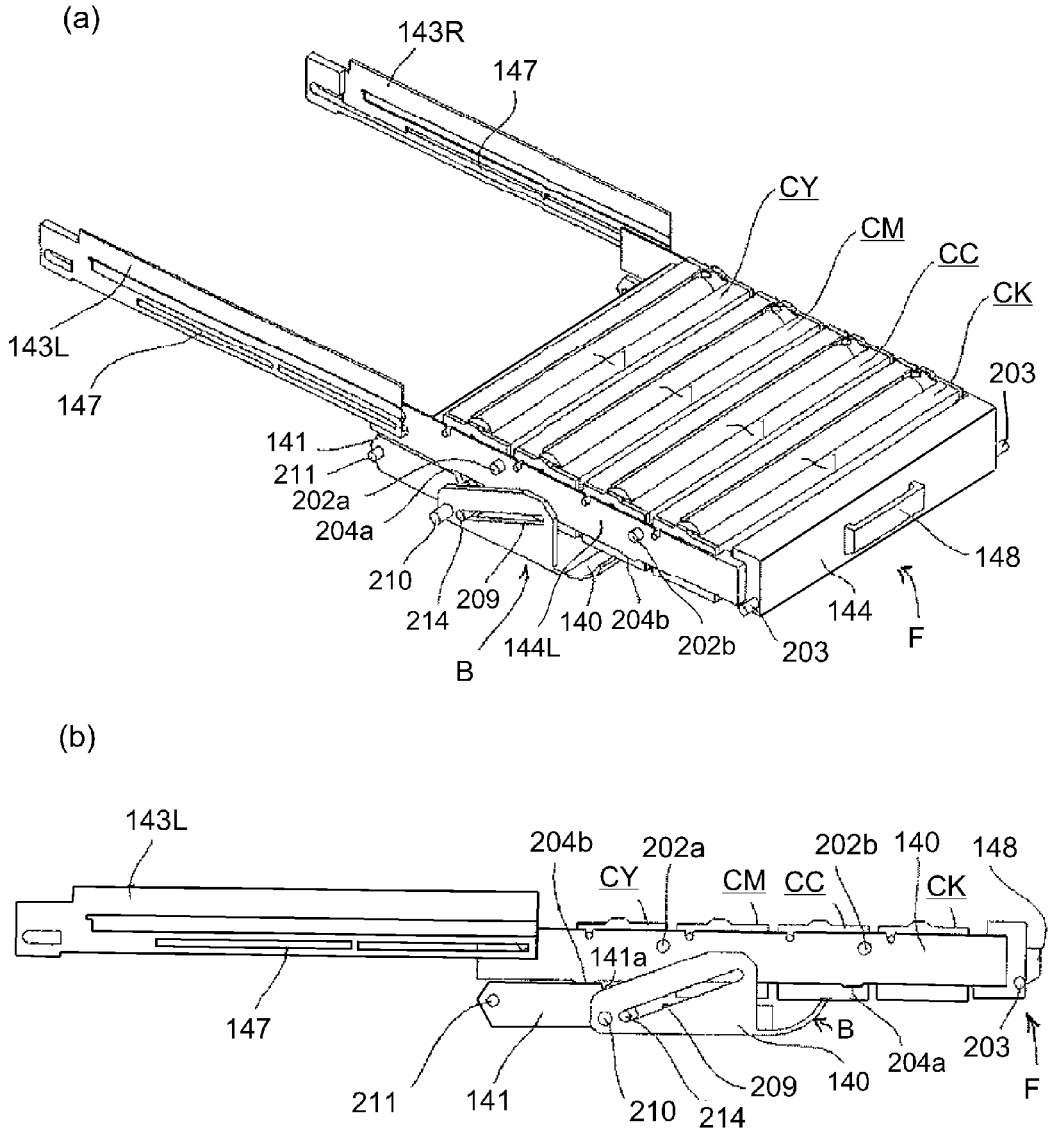

In each of FIGS. 17, 18 and 19, (a) and (b) are illustrations for explaining an interrelating mechanism and an interrelating operation between the door and the tray.

Figure 20:
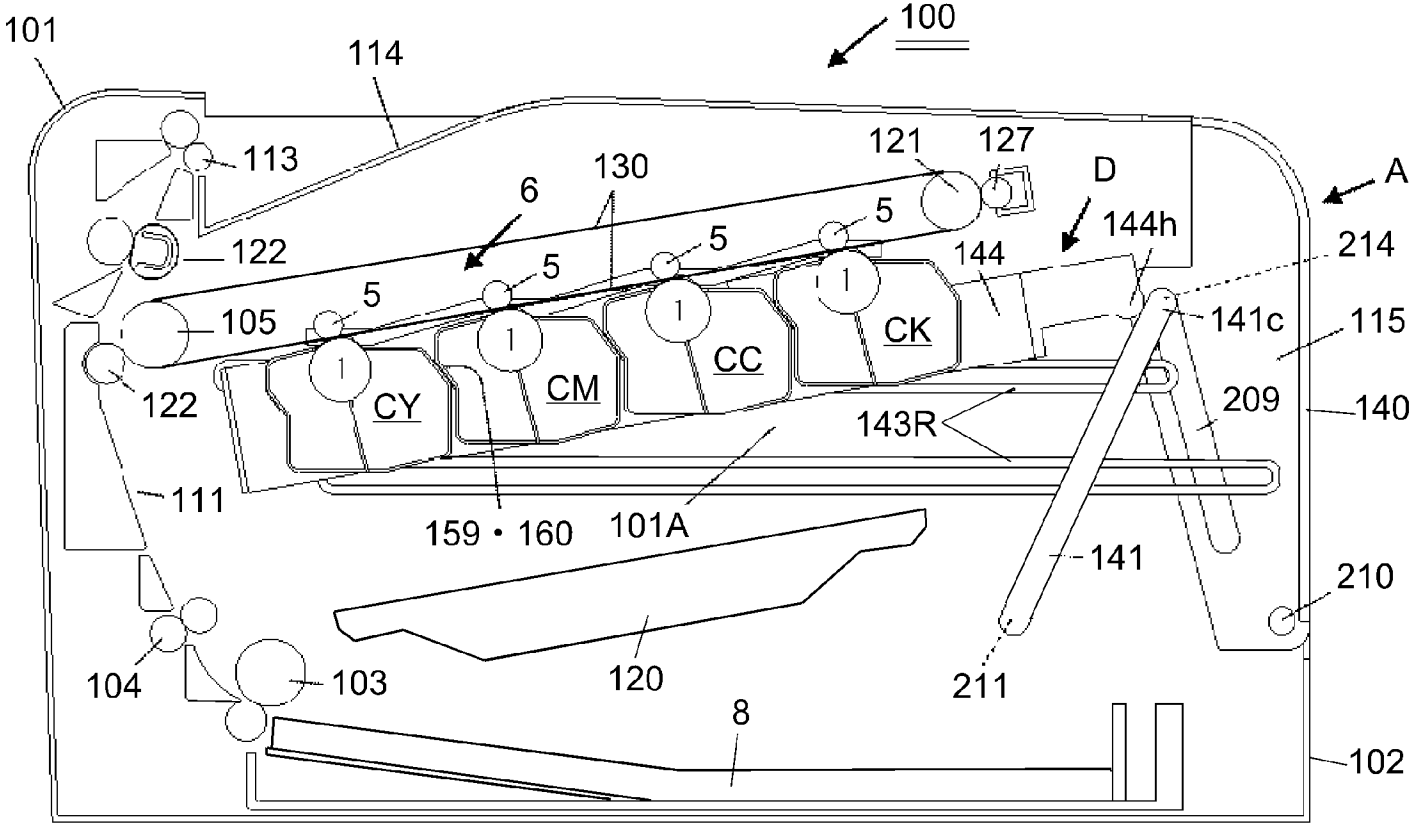

FIG. 20 is a schematic longitudinal left side view of an image forming apparatus in Example 1.

Figure 21:
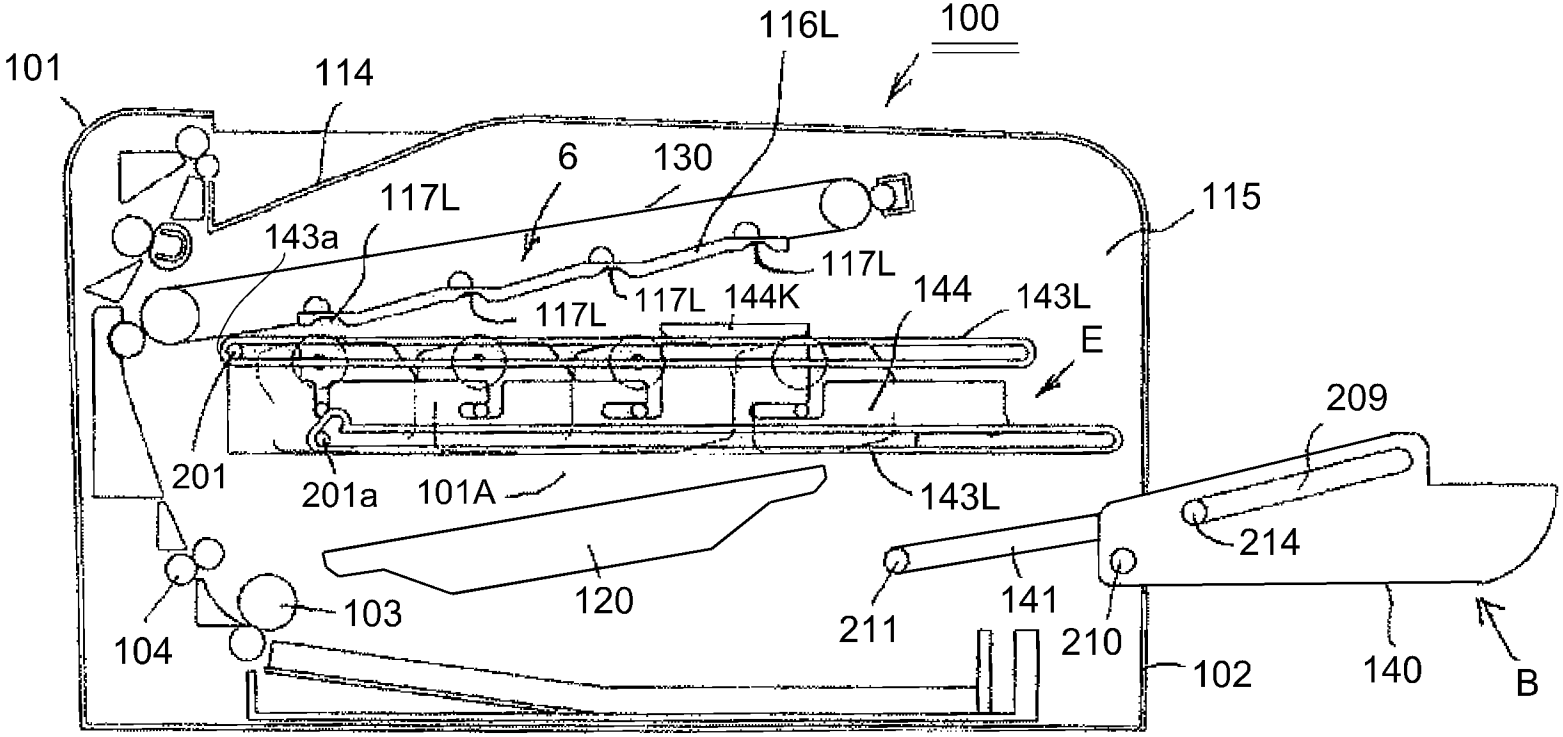

FIG. 21 is a schematic longitudinal left side view of the image forming apparatus in a state in which an opening is open by opening a door.

Figure 22:
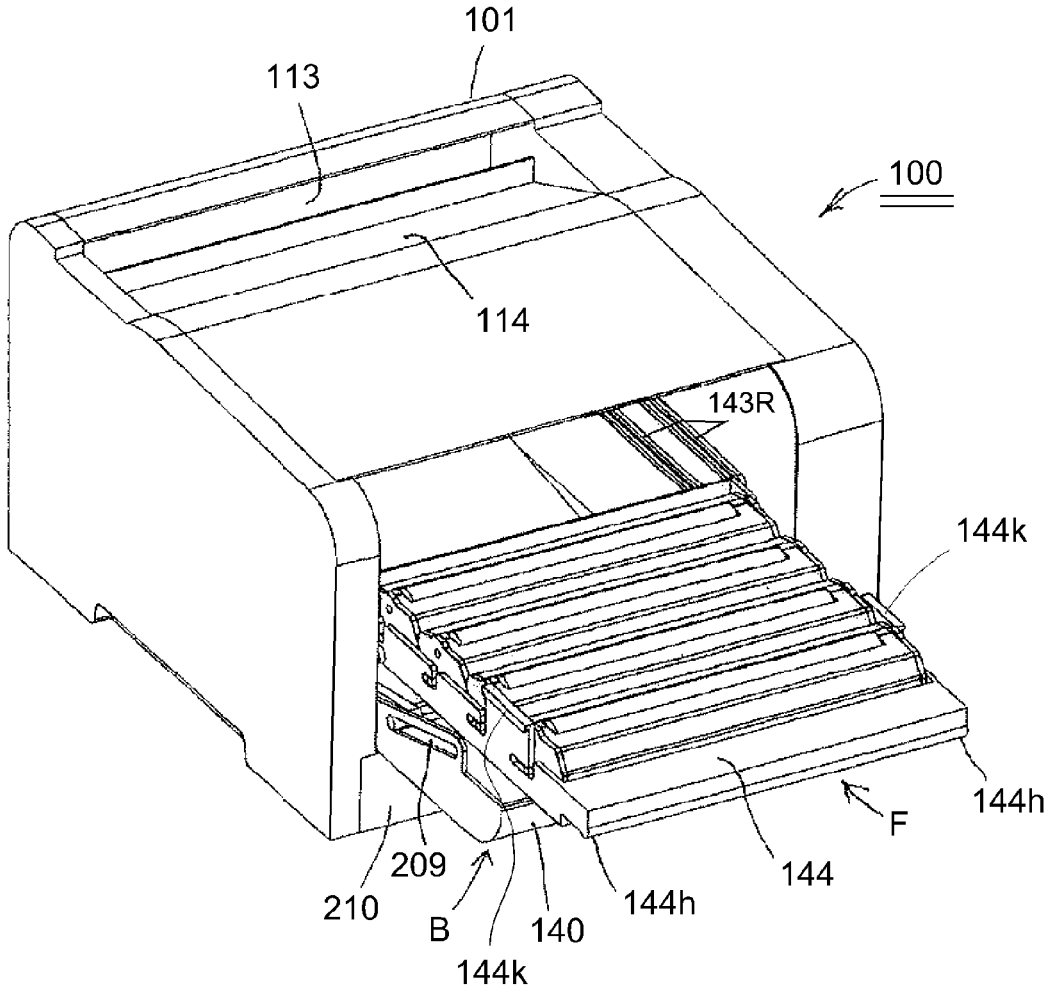

FIG. 22 is a perspective view of an outer appearance of the image forming apparatus in a state in which a tray is pulled out to an outside position.

Figure 23:
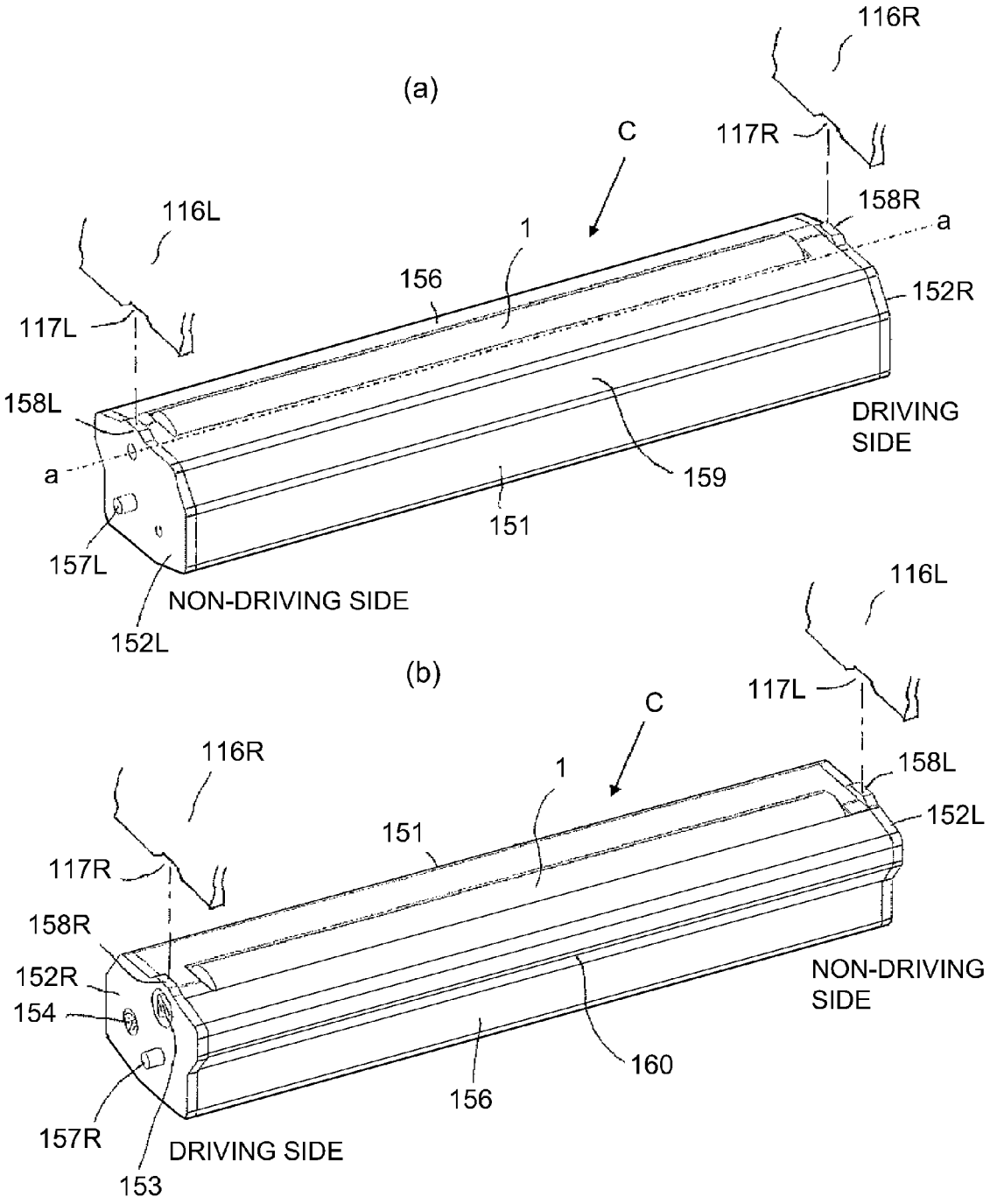

In FIG. 23, (a) and (b) are perspective views of a cartridge as seen from a driving side and a non-driving side, respectively.

Figure 24:
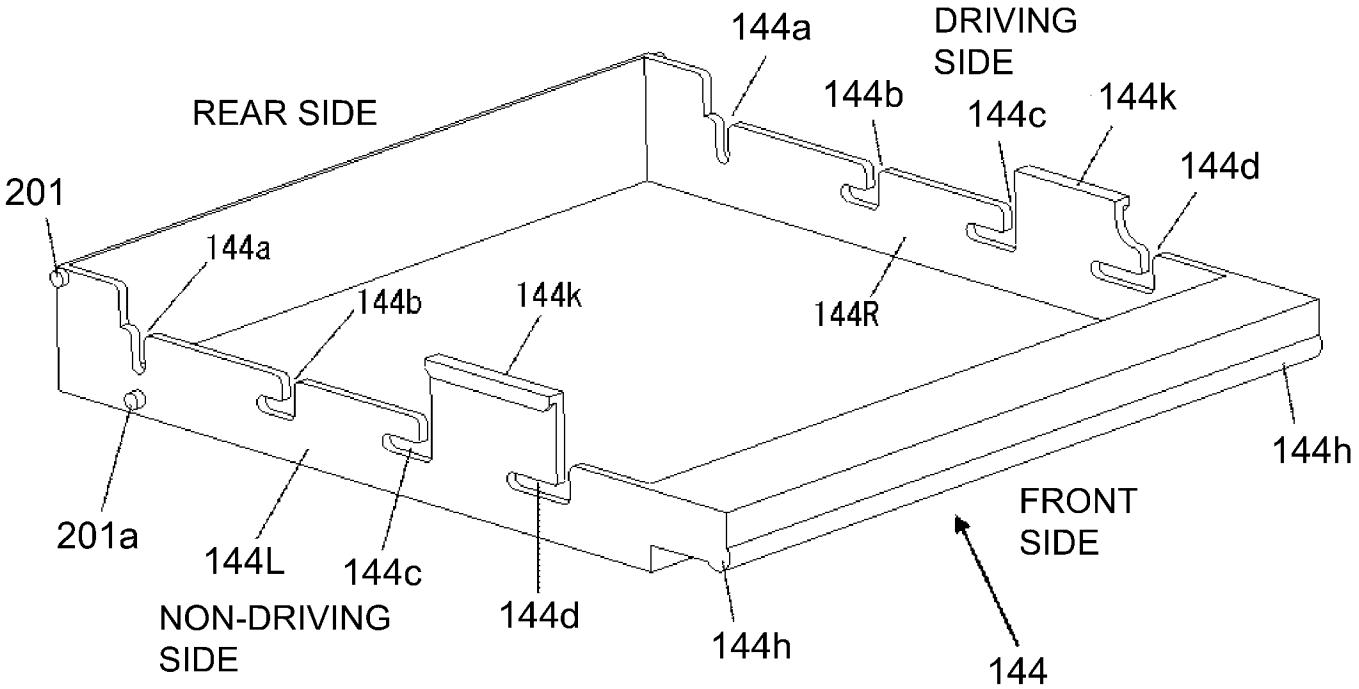

FIG. 24 is a perspective view of an outer appearance of a tray.

Figure 25:
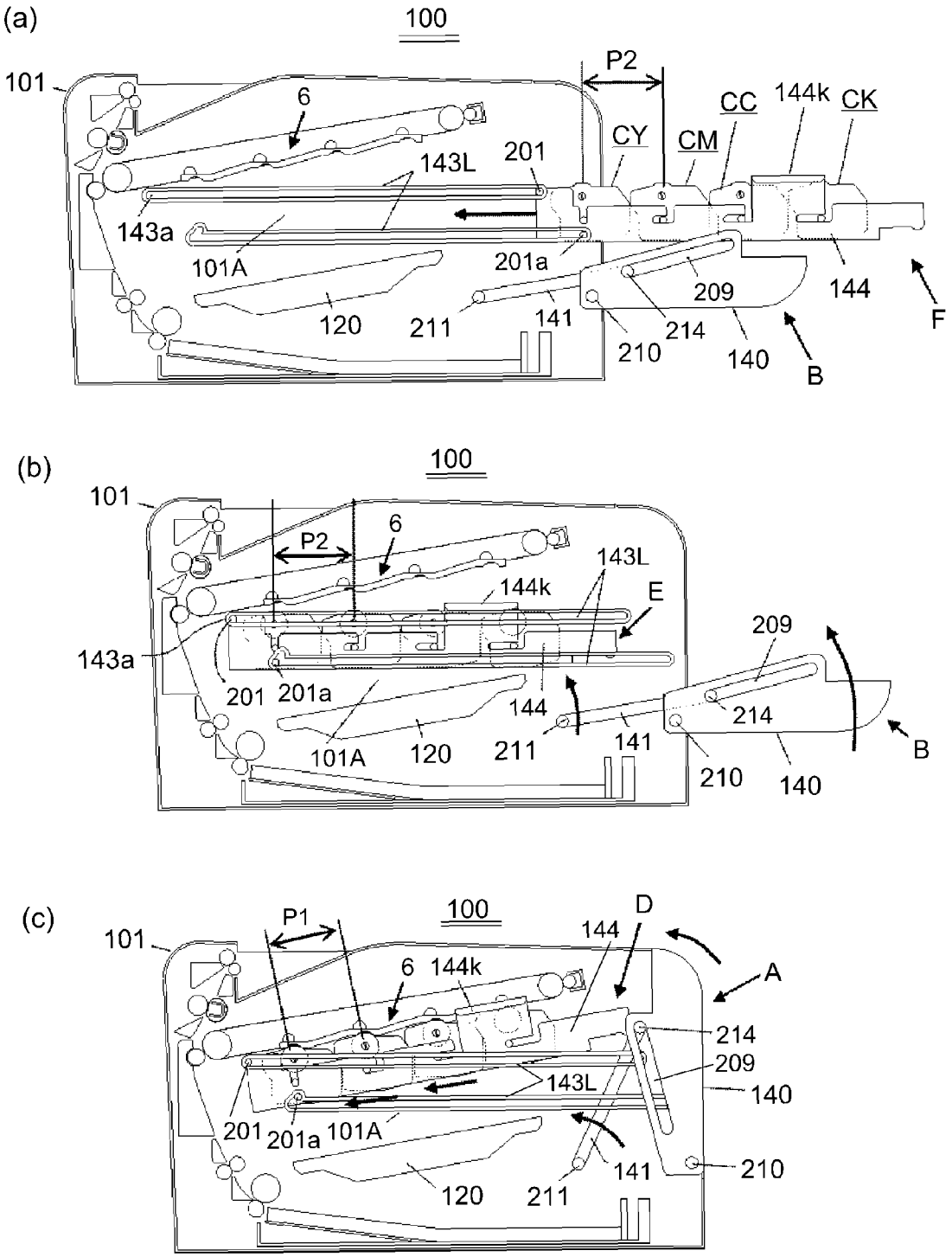

In FIG. 25, (a) to (c) are illustrations for explaining a tray position moving operation and a drum pitch changing outside position between cartridges.

Figure 26:
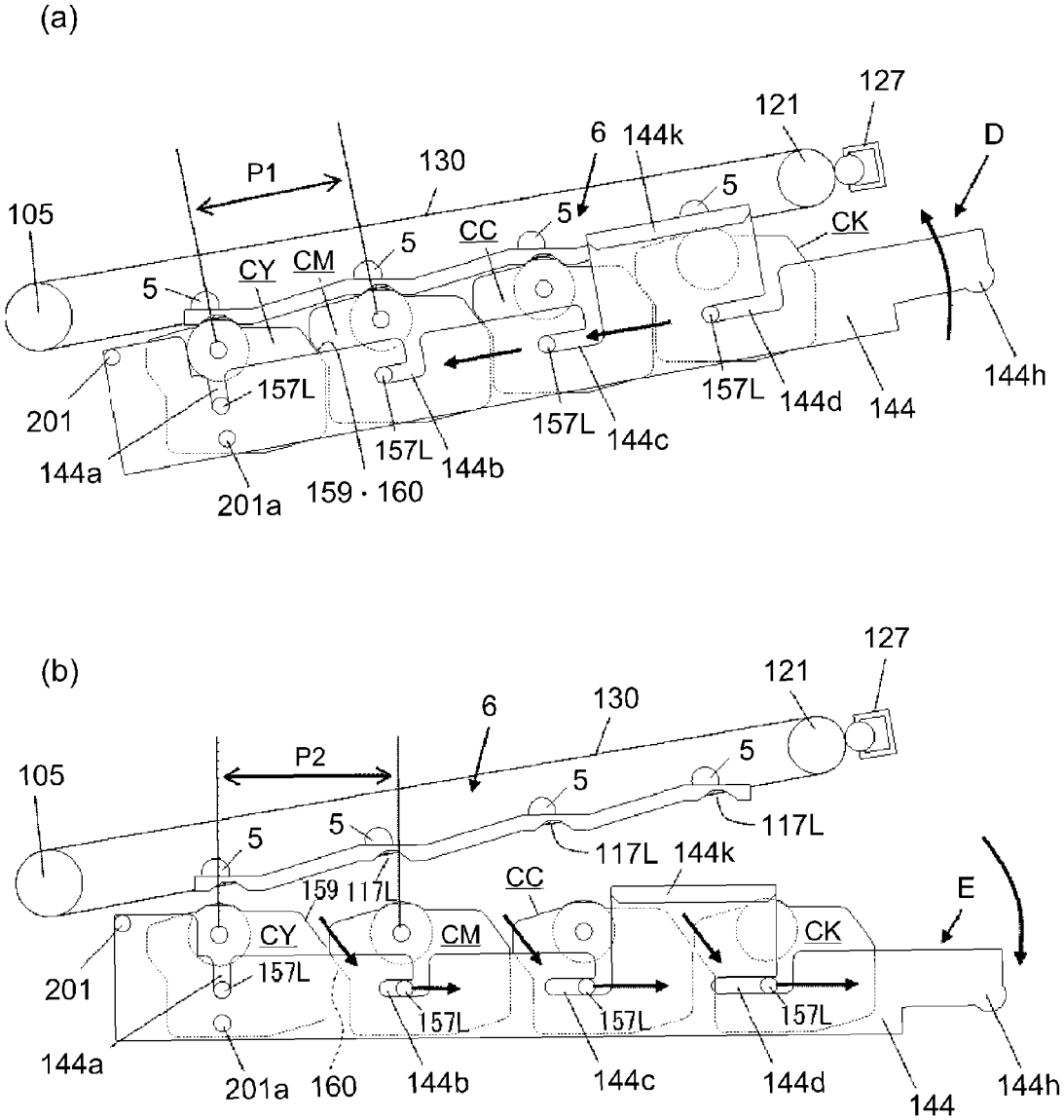

In FIG. 26, (a) and (b) are illustrations for explaining the tray position moving operation and the drum pitch changing operation between the cartridges.

Figure 27:
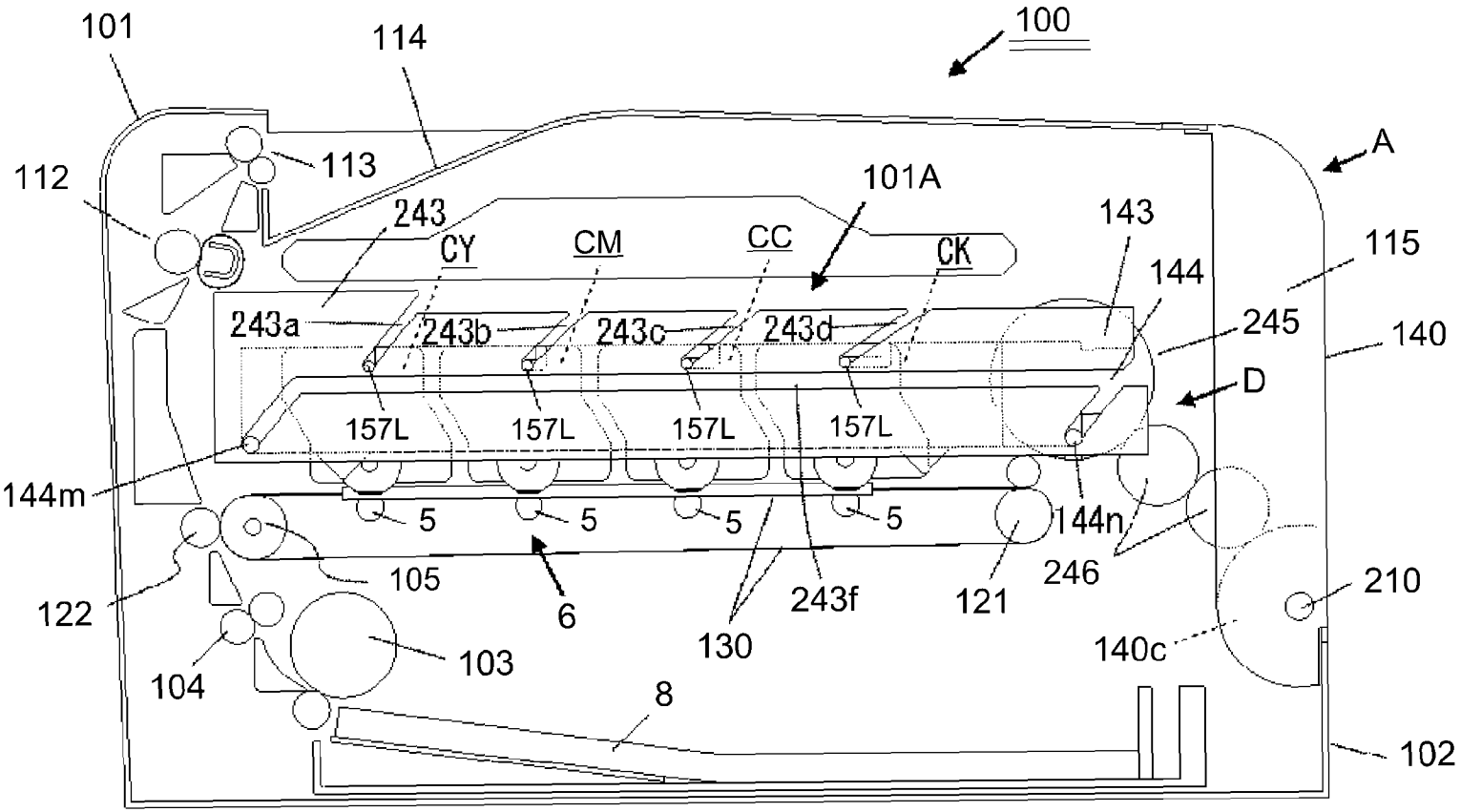

FIG. 27 is a schematic longitudinal left side view of an image forming apparatus in Embodiment 2.

Figure 28:
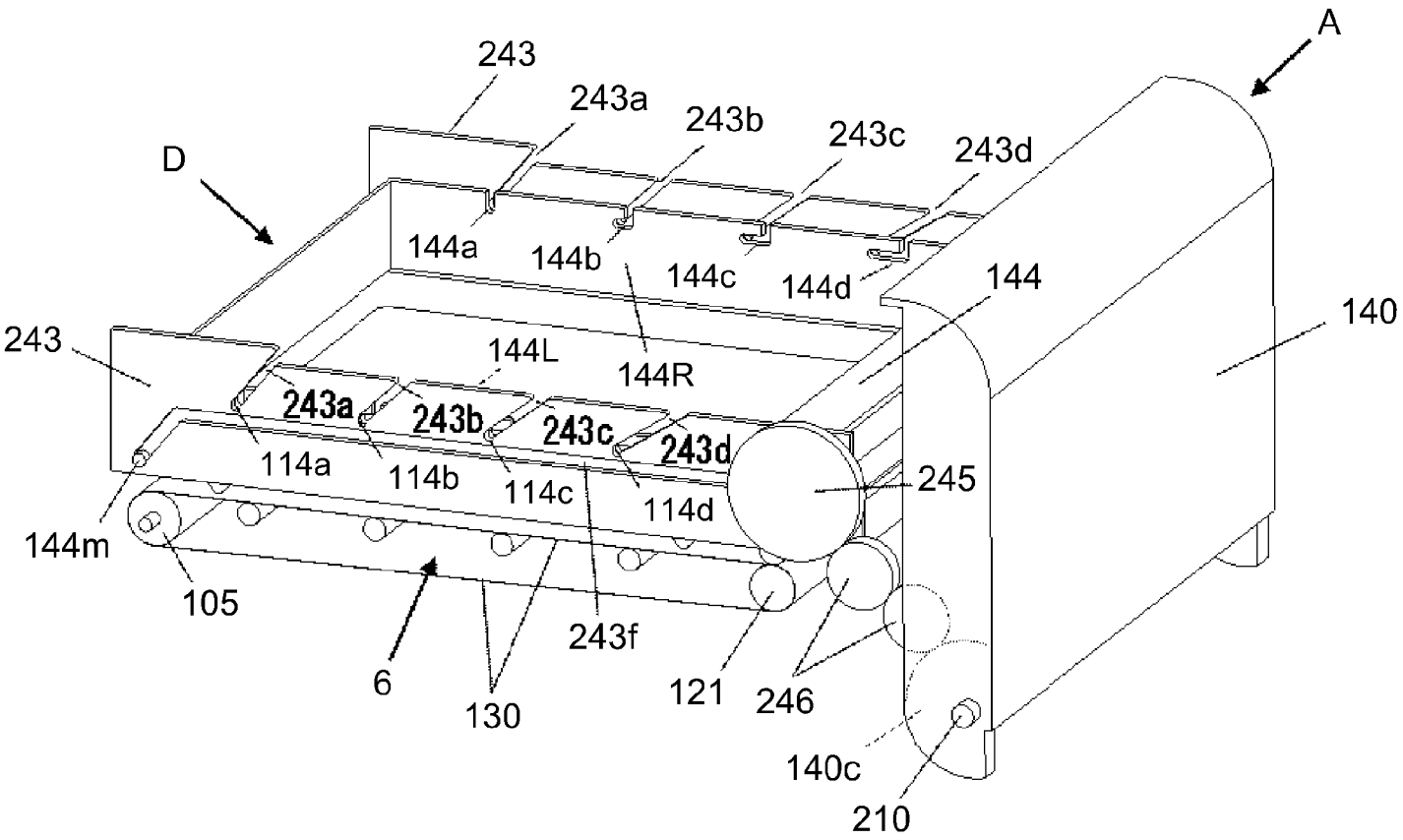
Figure 29:
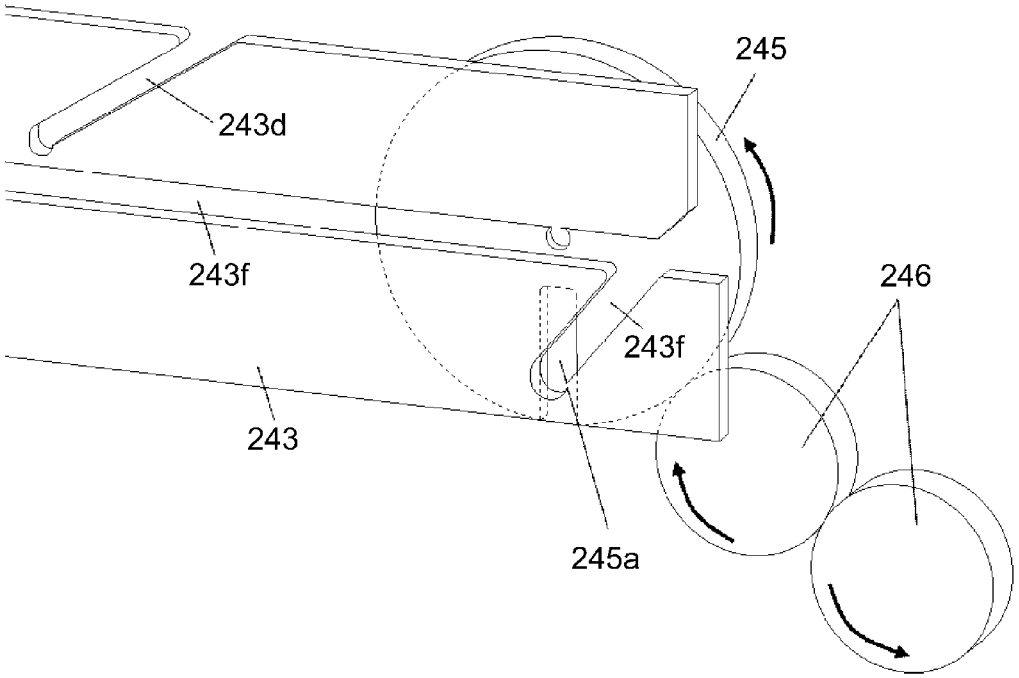
Figure 30:
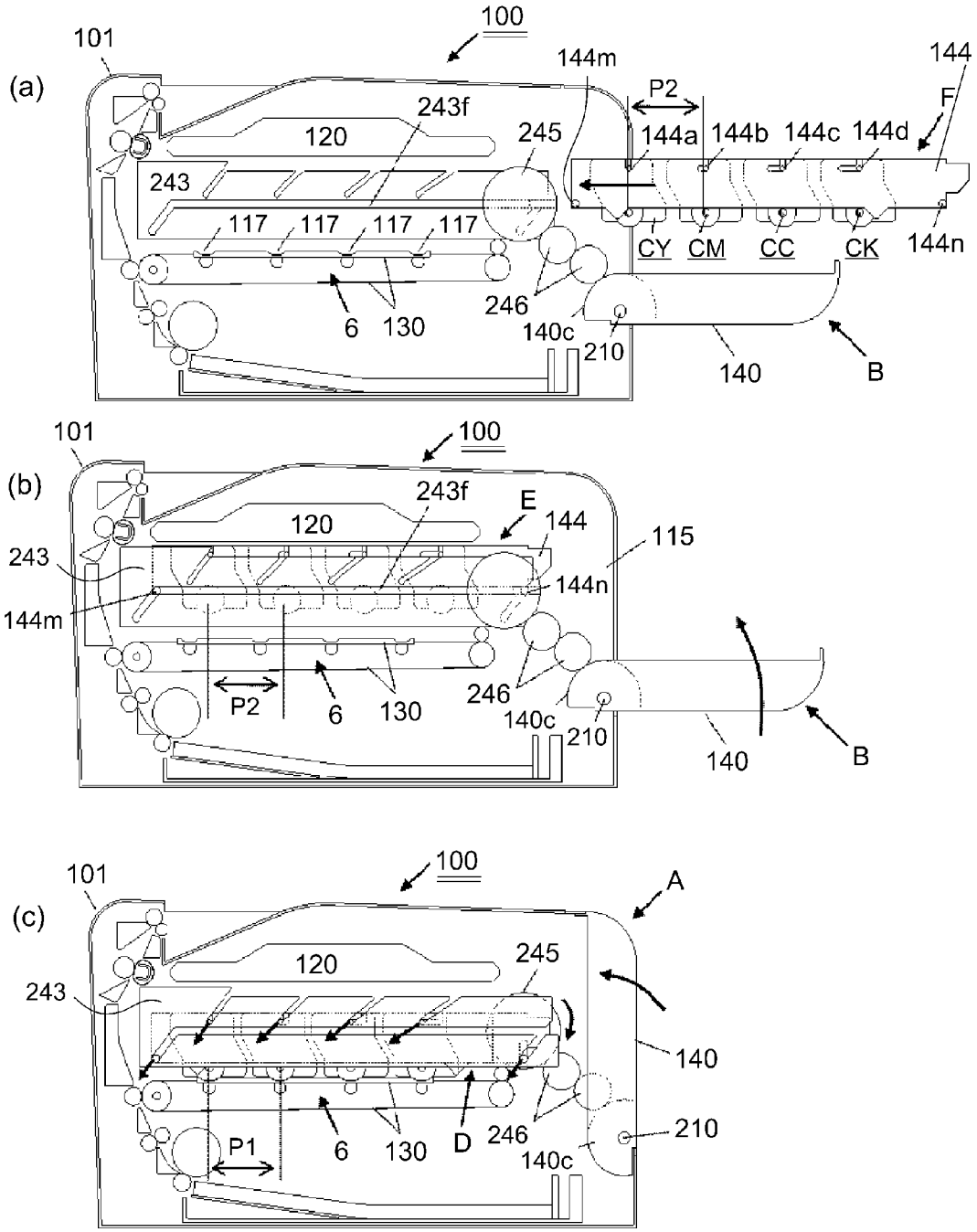
Figure 31:
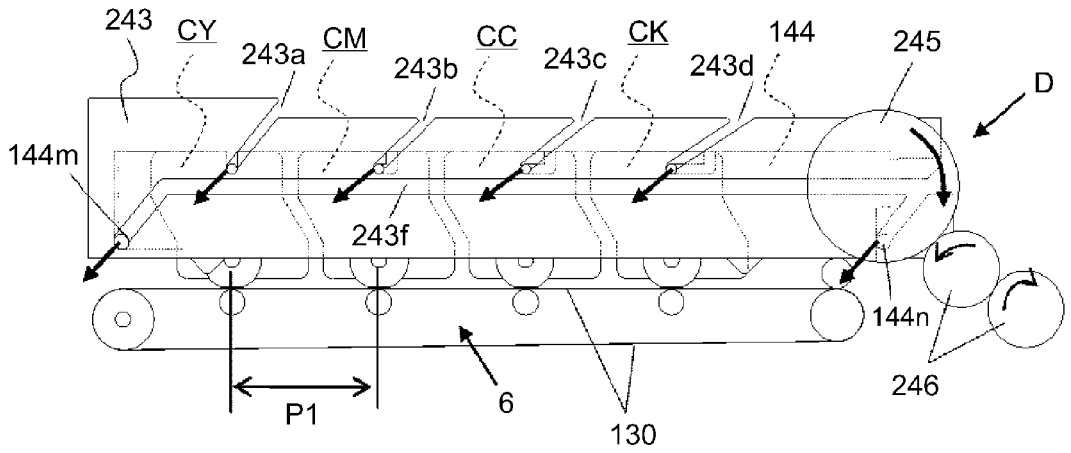
Figure 31:
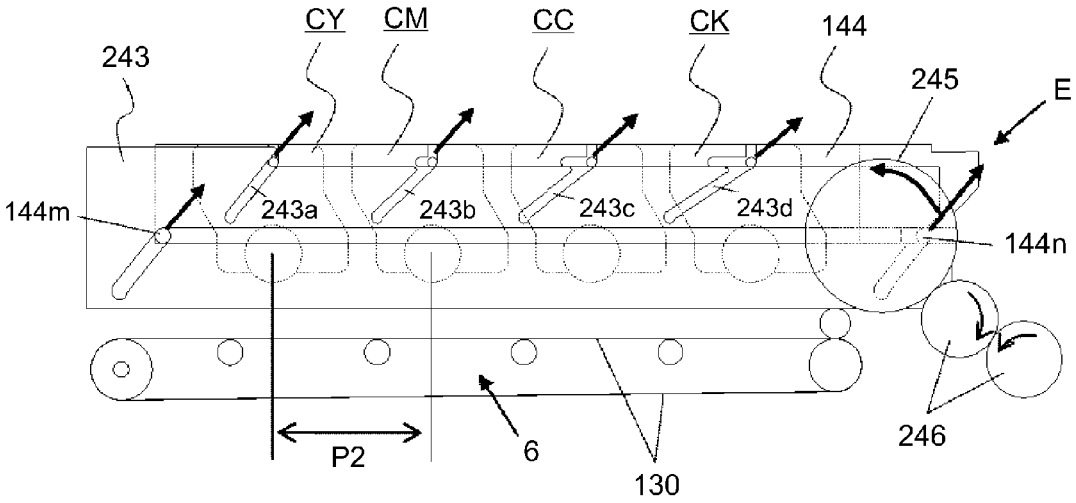

FIGS. 28 and 29, (*a*) to (*c*) of FIG. 30, and, (*a*) and (*b*) of FIG. 31 are illustrations for explaining an interrelating mechanism and an interrelating operation between a door and a tray.

Figure 32:
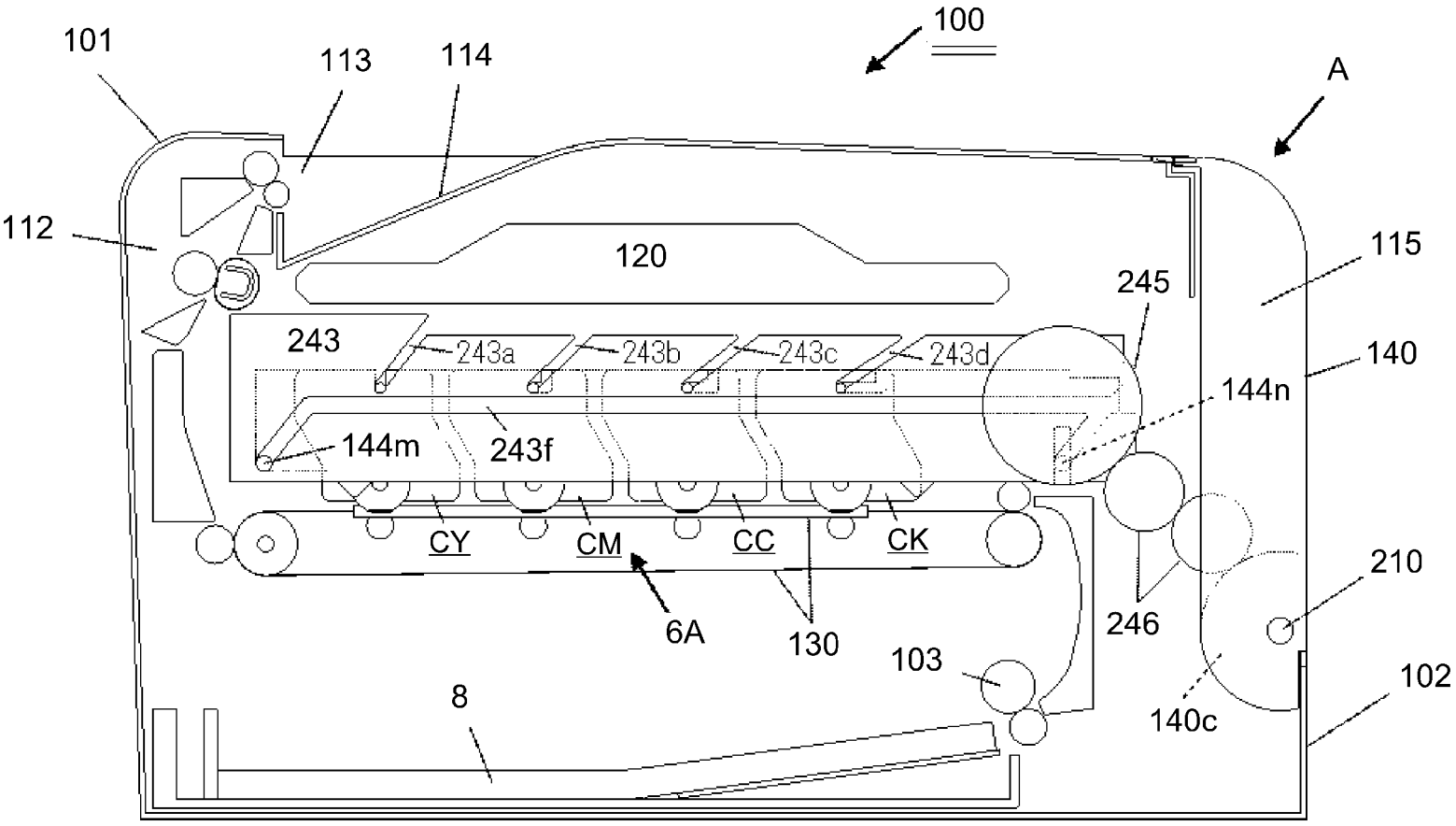

FIG. 32 is a schematic longitudinal left side view of an image forming apparatus of an ETB type using an electrostatic conveyer belt.

Figure 33:
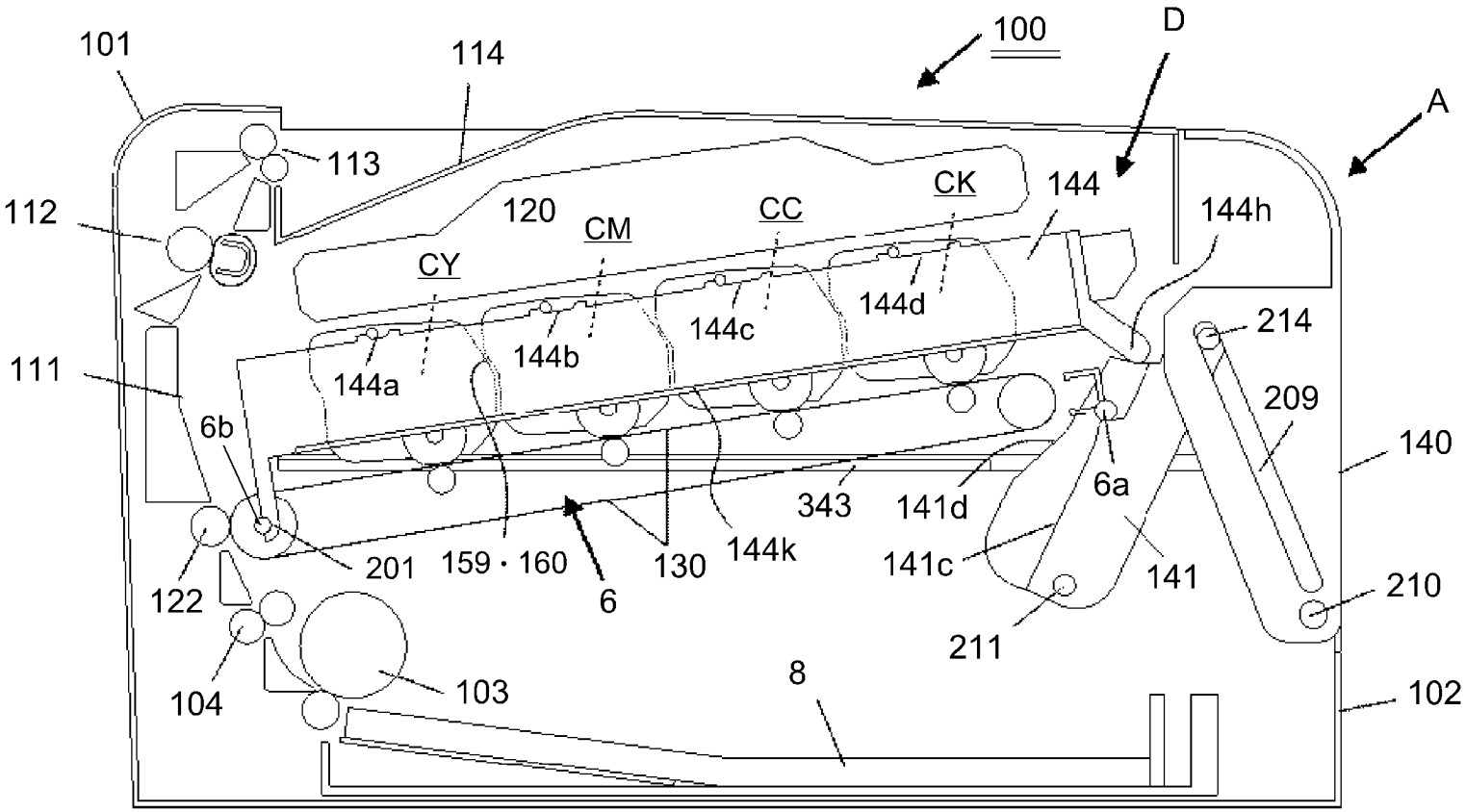

FIG. 33 is a schematic longitudinal left side view of an image forming apparatus in Example 3.

Figure 34:
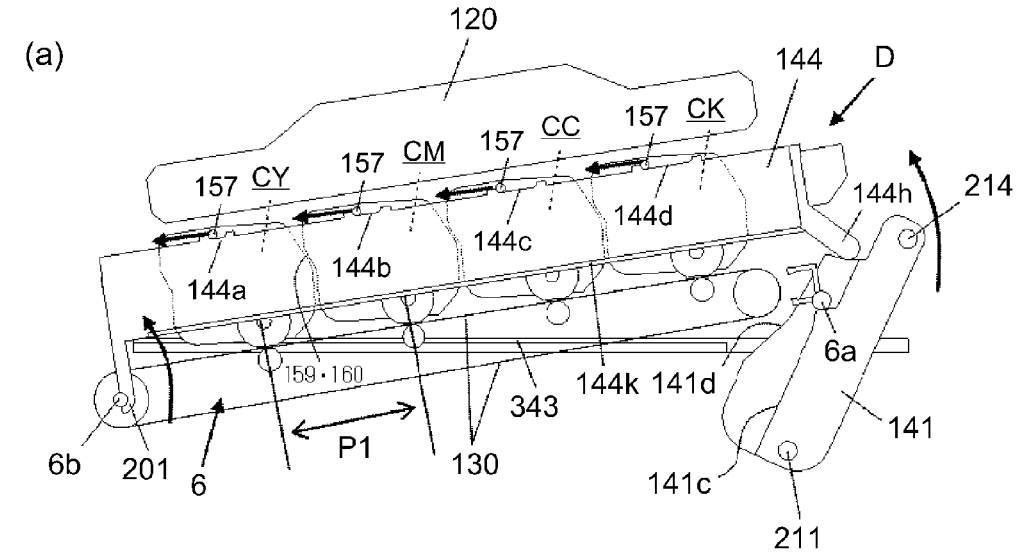
Figure 34:
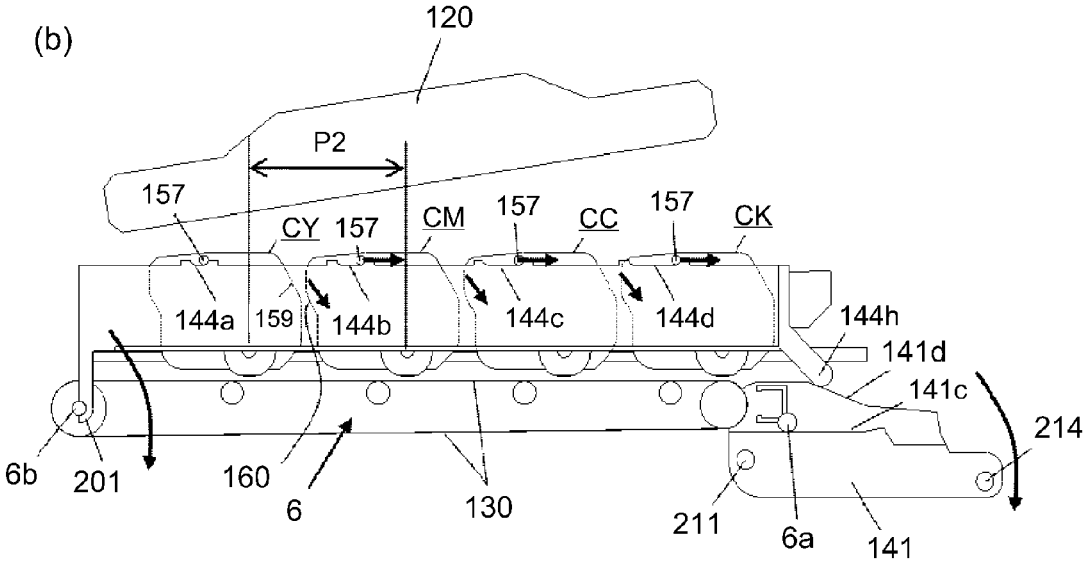

FIG. 34, (a) and (b) are illustrations for explaining an interrelating mechanism and an interrelating operation between a door and a tray.

Figure 35:
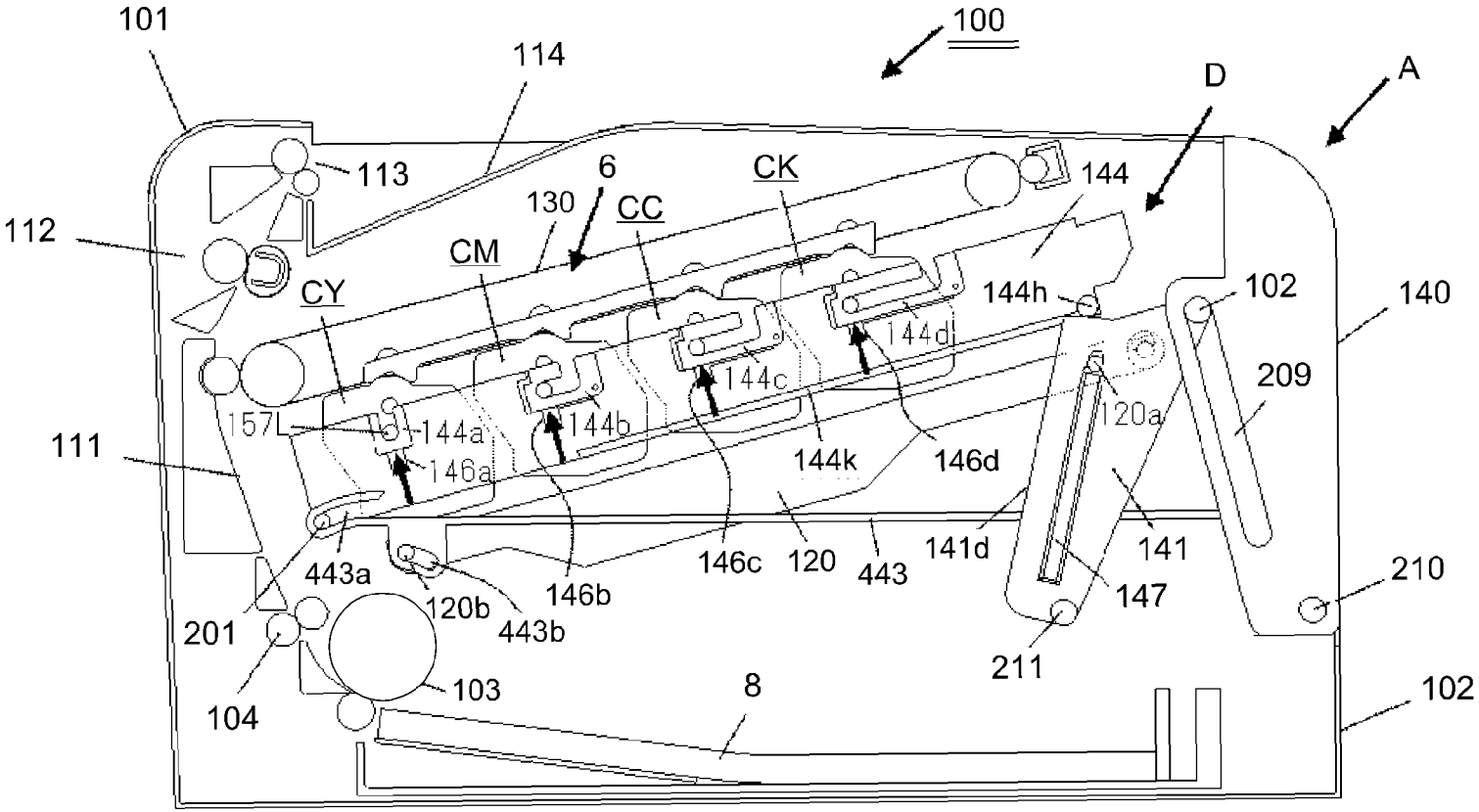

FIG. 35 is a schematic longitudinal left side view of an image forming apparatus in Embodiment 4.

Figure 36:
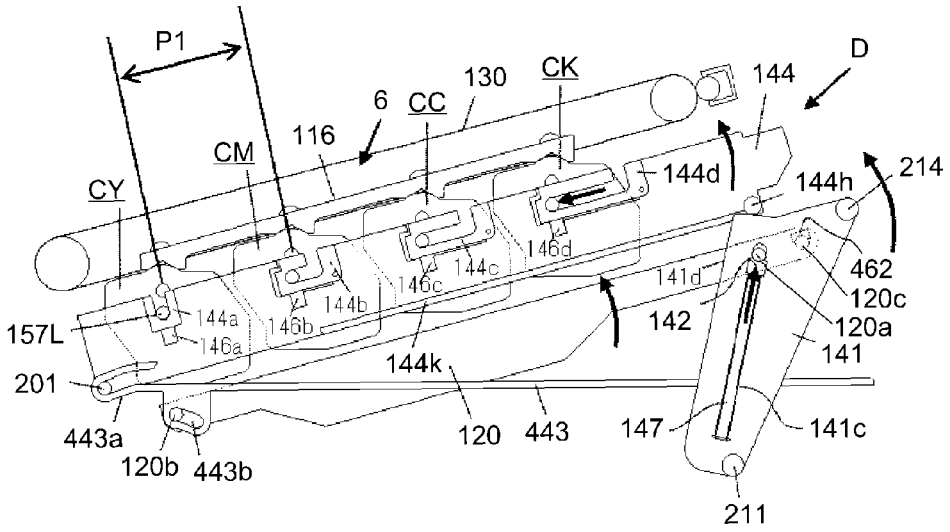
Figure 36:
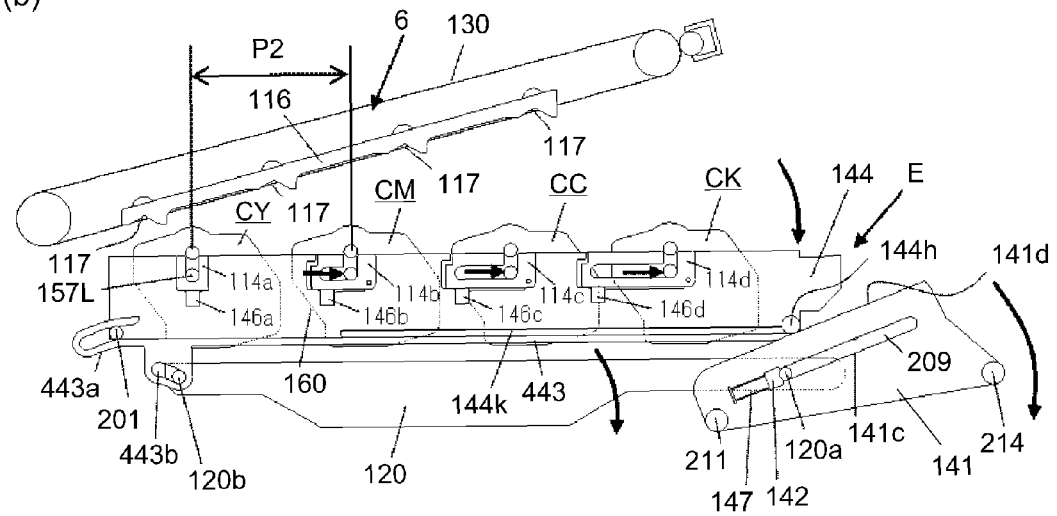

In FIG. 36, (a) and (b) are illustrations for explaining an interrelating mechanism and an interrelating operation between a door and a tray.

DESCRIPTION OF THE PREFERRED EMBODIMENTS

Reference Example 1

General Structure of Image Forming Apparatus

Figure 1:
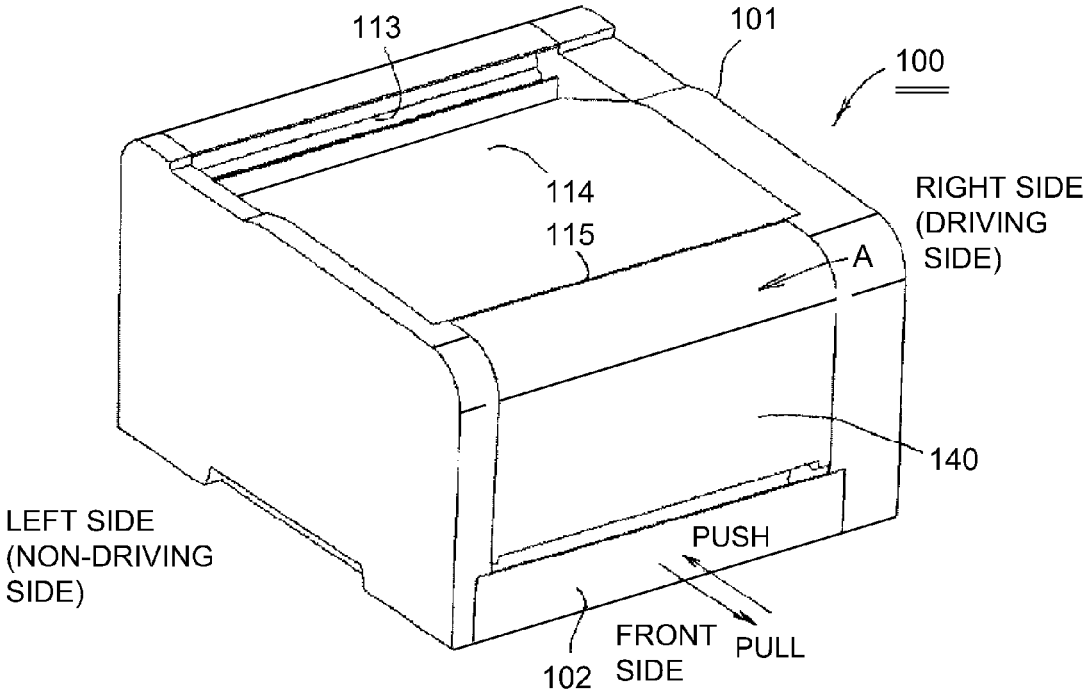
FIG. 1 is a perspective view of an outer appearance of an image forming apparatus in each of Reference Examples and Embodiments.
Figure 2:
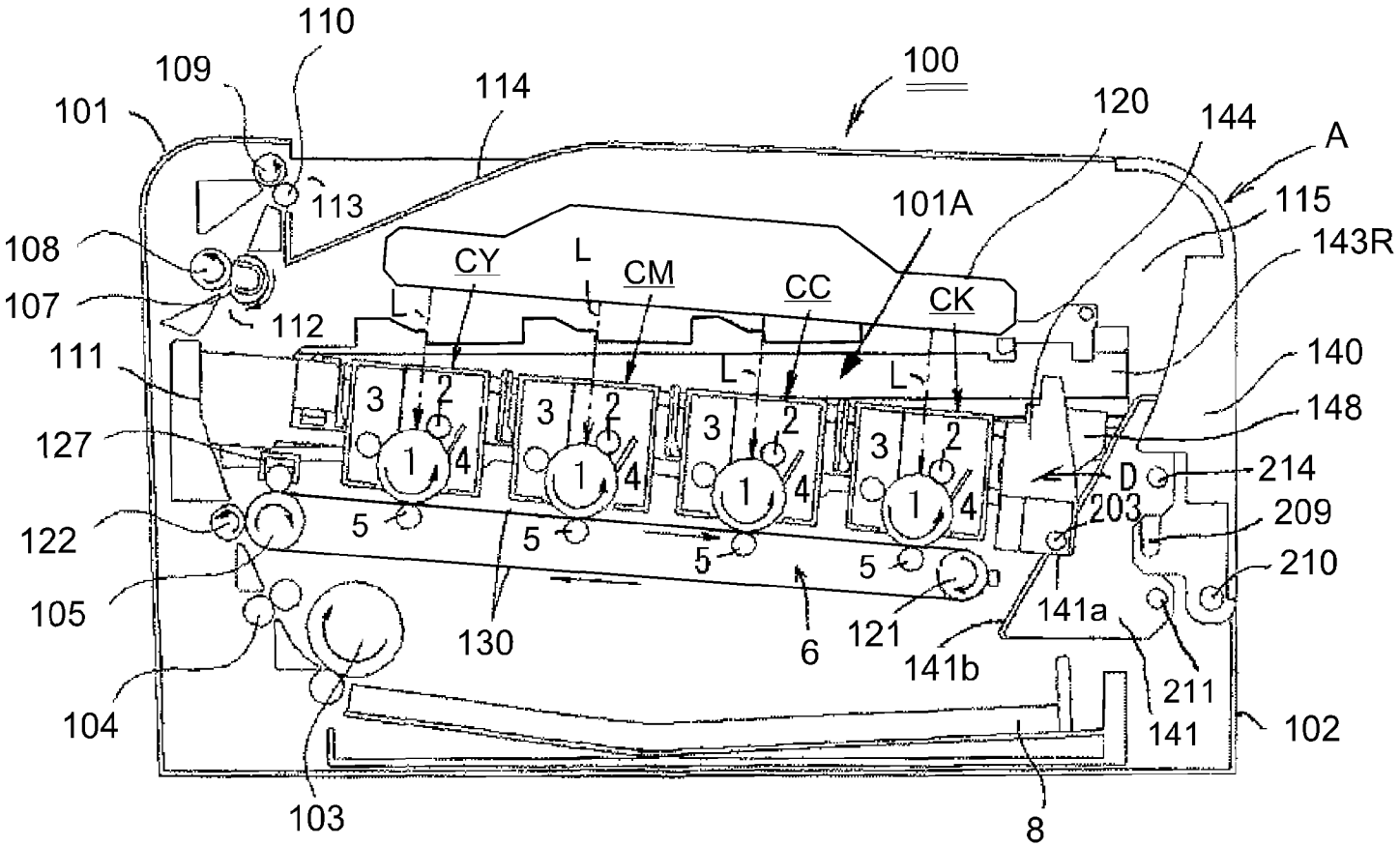
FIG. 2 is a schematic longitudinal left side view of the image forming apparatus in Reference Example 1.

FIG. 1 is a perspective view of an outer appearance of an image forming apparatus 100 in this embodiment, and FIG. 2 is a schematic longitudinal left side view of the image forming apparatus 100. The image forming apparatus 100 is a four color-based full-color laser printer using an electrophotographic process, to which four integral-type process cartridges C (CY, CM, CC, CK) as a plurality of cartridges contributing to image formation. That is, the image forming apparatus 100 is capable of effecting full-color or monochromatic image formation on a sheet-like recording material 8 as a recording medium on the basis of an electrical image signal inputted from an external host device (not shown) such as a personal computer or an image reader into a control circuit portion (not shown).

In the following description, with respect to the image forming apparatus 100, a front (surface) side means the side where a cartridge door 140 as an openable member is provided. A rear (surface) side is the side opposite to the front side. Left and right are those as seen from the front side. Up(per) and low(er) and those with respect to a direction of gravitation. A front-rear direction includes a frontward direction toward front as seen from the rear side and a rearward direction opposite to the frontward direction. The left and right sides means the left and right sides as seen from the front side. A left-right direction includes a leftward direction from right toward left as seen from the front side and a rightward direction opposite to the leftward direction. The right side of the image forming apparatus 100 is a driving side, and the left side of the image forming apparatus 100 is a non-driving side.

At a central portion of an inside of an image forming apparatus main assembly 101, a cartridge accommodating portion 101A is provided. At the cartridge accommodating portion 101A, first to fourth cartridges CY, CM, CC and CK are arranged, in the listed order from the rear side toward the front side, obliquely toward a lower front side with respect to the horizontal direction, and are positionally fixed and mounted at predetermined mounting positions (image formable positions). That is, a constitution in which the cartridges are obliquely arranged is employed.

The respective cartridges P have the same constitution except that only colors of toners (developers) accommodated therein are different from each other. Each cartridge P includes a drum-type electrophotographic photosensitive drum 1 as an image bearing member on which a latent image is to be formed. Further, the cartridge P includes, as image forming process means actable on the drum 1, a charging device (charging means) 2, a developing device (developing means) 3 and the cleaning device (cleaning means) 4. The charging device 2 in this embodiment is a contact charging roller. The developing device 3 includes a developing roller, and in a developer container as a developer accommodating portion, the toner is accommodated. The cleaning device 4 is of a blade type.

The developing device 3 of the first cartridge CY accommodates yellow (Y) toner. The developing device 3 of the second cartridge CM accommodates magenta (M) toner. The developing device 3 of the third cartridge CC accommodates cyan (C) toner. The developing device 3 of the fourth cartridge CK accommodates black (K) toner.

Above the cartridge accommodating portion 101A, a laser scanner 120 as an exposure device (exposure means) is provided. This scanner 120 outputs laser light L modulated correspondingly to image information for each color inputted from the external host device to subject the charged surface of the drum 1 of each cartridge C to scanning exposure through an exposure window 7 (FIGS. 3 and 4) provided at an upper surface of the cartridge C.

Under the cartridge accommodating portion 101A, an intermediary transfer belt unit 6 is provided. The belt unit 6 includes, as an intermediary transfer member, an endless belt (ITB) 130 which is formed of a dielectric material and which has flexibility. The belt 130 is stretched between an inner belt driving roller 105 and a tension roller 121 as a plurality of members around which the belt 130 is extended and stretched.

The inner belt driving roller 105 is positioned in the rear side than a position of the first cartridge CY. The tension roller 121 is positioned in the front side than a position of the fourth cartridge CK. The drum 1 of each cartridge C positionally fixed and mounted at the predetermined mounting position at the cartridge accommodating portion 101A contacts, at its lower surface, an upper surface of an upper belt portion of the belt 130. Inside the belt 130, four primary transfer rollers 5 are provided opposed to the lower surfaces of the drums 1 of the corresponding cartridges C through the upper belt portion of the belt 130. Toward the inner belt driving roller 105, a secondary transfer roller 122 is contacted to the belt 130. In each cartridge C, a contact portion between the drum 1 and the belt 130 is a primary transfer nip. A contact portion between the secondary transfer roller 122 and the belt is a secondary transfer nip.

Below the belt unit 6, a feeding cassette 102 in which sheets of the recording material 8 are accommodated is provided. The feeding cassette 102 is freely inserted into and taken out from the apparatus main assembly 101 from the front side (front loading).

In a rear side of the inside of the apparatus main assembly 101, a vertical feeding path 111 for the recording material 8 is provided. From a lower portion toward an upper portion of this feeding path 111, a feeding roller 103, a conveying roller pair (registration roller pair) 104, the secondary transfer roller 122, a fixing device 112 and a discharging unit 113 are provided in the listed order. The fixing device 112 includes a fixing film 107 and a pressing roller 108 between which a fixing nip is formed. The discharging unit 113 includes a pair of discharging rollers 109 and 110.

An operation for forming a full-color image is as follows. The drum 1 of each of the first to fourth cartridges CY, CM, CC and CK is rotationally driven in the counterclockwise direction, indicated by an arrow, at a predetermined control speed. Further, also the belt 130 moves in the clockwise direction (the same direction as the rotational direction of the drum at an opposing portion), indicated by an arrow, at a speed corresponding to the speed of the drum 1. The scanner 120 is also driven. In synchronization with the driving of the scanner 120, the charging roller 2 in each cartridge C uniformly electrically charges the surface of the drum 1 to predetermined polarity and potential at predetermined control timing. The scanner 120 scans (exposes) the surface of each drum 1 with the laser light L modulated correspondingly to the image signal for an associated color. As a result, an electrostatic latent image corresponding to the image signal for the associated color is formed on the surface of the drum 1. T thus formed electrostatic latent image is developed by the developing device 3 into a toner image.

By the above-described electrophotographic image forming process operation, a yellow (Y) toner image which corresponds to the yellow (Y) component of a full-color image is formed on the drum 1 of the first cartridge CY, and this toner image is primary-transferred onto the belt 130.

On the drum 1 of the second cartridge CM, a magenta (M) toner image which corresponds to the magenta (M) component of the full-color image is formed, and this toner image is primary-transferred onto the belt 130 so that it is superposed on the yellow (Y) toner image which has already been transferred on the belt 130.

On the drum 1 of the third cartridge CC, a cyan (C) toner image which corresponds to the cyan (C) component of the full-color image is formed, and this toner image is primary-transferred onto the belt 130 so that it is superposed on the yellow (Y) and magenta (M) toner images which have already been transferred the belt 130.

On the drum 1 of the fourth cartridge CK, a black (K) toner image which corresponds to the black (K) component of the full-color image is formed, and this toner image is primary-transferred onto the belt 130 so that it is superposed on the yellow (Y), magenta (M), and cyan (C) toner images which have already been transferred on the belt 130.

Consequently, an unfixed full-color toner image is formed on the belt 130 by the yellow (Y), magenta (M), cyan (C) and black (K) toner images.

A transfer residual toner remaining on the surface of the drum 1 at each cartridge C is removed by the cleaning device 4.

Meanwhile, the feeding roller 103 is rotationally driven at a predetermined control timing. One of the sheets of the recording material 8 stacked on the feeding tray 102 is fed and conveyed in the vertical feeding path 111, thus being introduced into the secondary transfer nip. As a result, the superposed four color toner images are simultaneously (collectively) secondary-transferred onto the recording material 8.

The recording material 8 is separated from the surface of the belt 130 and introduced into the fixing device 112, and is heated and pressed in a fixing nip of the fixing device 112. As a result, color mixing of the respective color toner images and fixation thereof on the recording material 8 are performed. Thereafter, the recording material 8 is moved out of the fixing device 23, and then is discharged as a full-color image formation product onto the discharge tray 114, provided in the upper surface side of the apparatus main assembly 101 by the discharging unit 113. Further, the surface of the belt 130 from which the recording material 8 is separated is cleaned by a cleaning portion 127, and then is repeatedly subjected to image formation.

(Structure of Cartridge)

Figure 3:
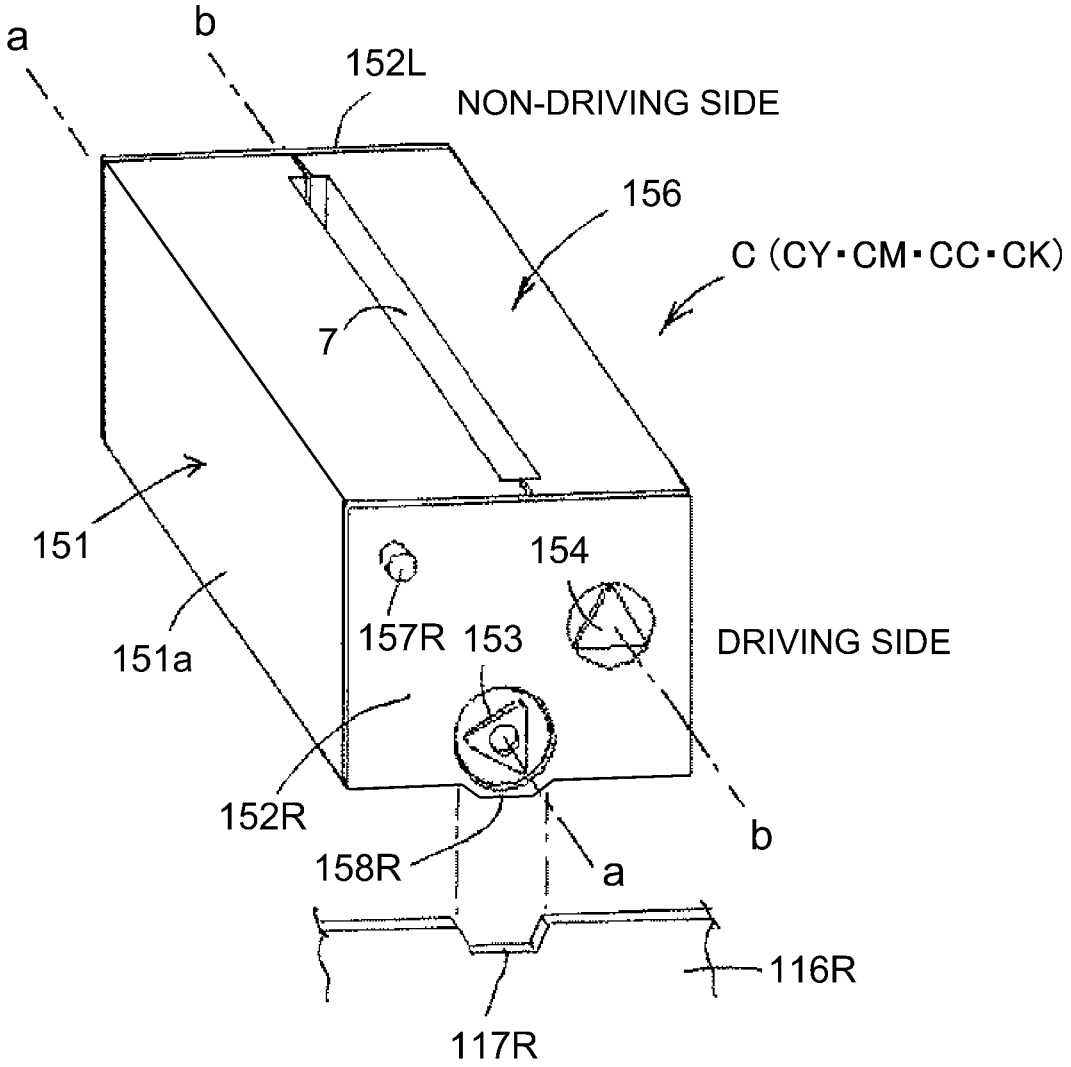
FIG. 3 is a perspective view of a cartridge as seen from a driving side.
Figure 4:
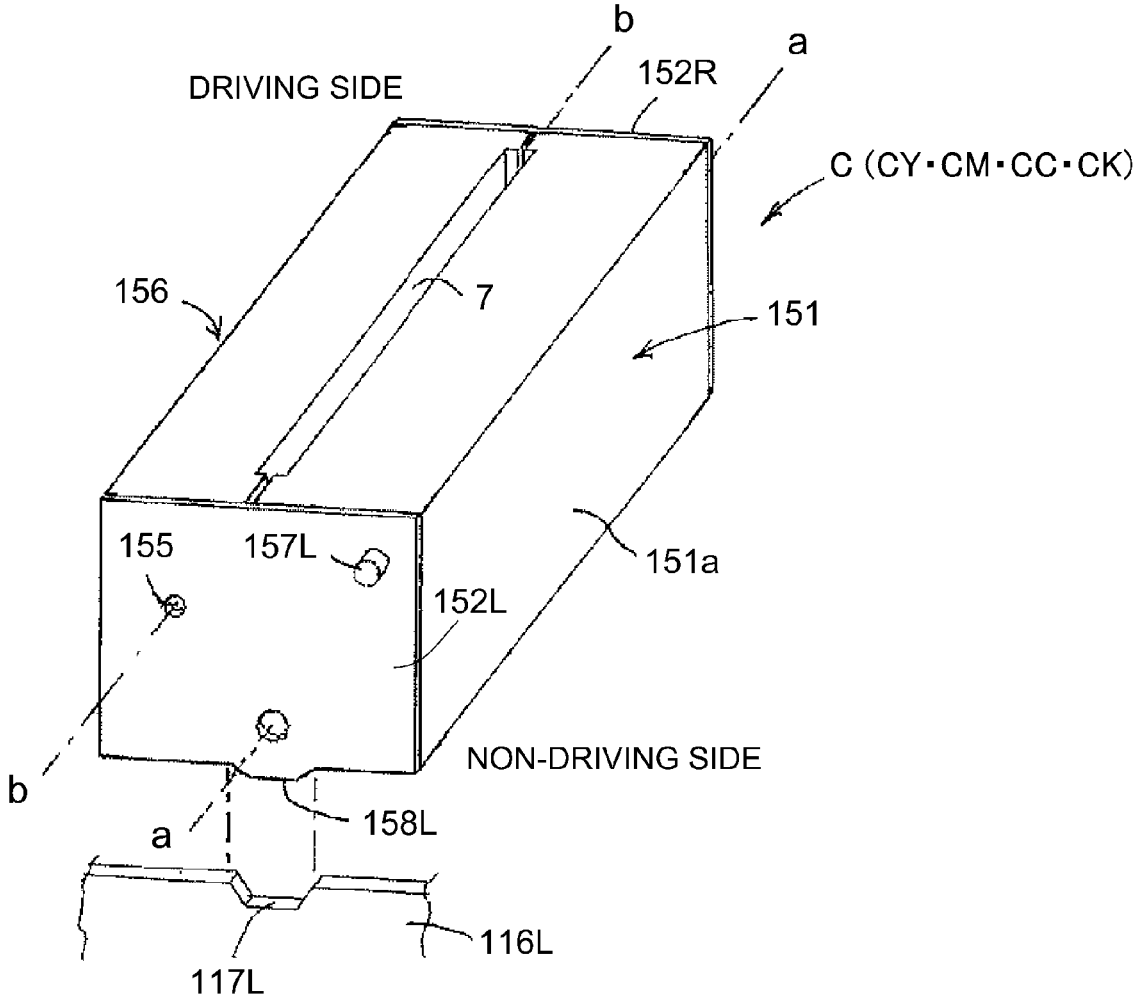
FIG. 4 is a perspective view of the cartridge as seen from a non-driving side.

FIGS. 3 and 4 are perspective views of the cartridges C (CY, CM, CC, CK) as seen from a driving side and a non-driving side, respectively. Each cartridge C is an elongated assembly having, as a longitudinal direction, a left-right direction which is a direction of an axis (drum axis) a-a of the drum 1. Further, the cartridge C includes a drum unit (first frame) 151, a developing unit (second frame) 156, a left side plate 152L and a right side plate 152R. The right side plate 152R side (one end side of the cartridge) is the driving side of the cartridge C, and the left side plate 152L side (the other end side of the cartridge) is the non-driving side.

In the drum unit 151, the drum 1, the charging roller 2 and the cleaning device 4 are incorporated. The developing unit 156 is a single member of the developing device 3 above, and includes the developing roller as the developing means for developing, with the developer, the latent image found on the drum 1 and a developer accommodating portion in which the developer used for developing the latent image is accommodated.

The left side plate 152L and the right side plate 152R are fixed mounted from the outside of a frame (container) 151*a* of the drum unit 151 on a left side surface and a right side surface, respectively, of the frame 151*a*. The developing unit 156 is swingably supported between the left and right side plates 152L and 152R so as to rotate about an axis b-b parallel to the drum axis a-a. That is, the developing unit 156 is rotatably connected with the drum unit 151. In the upper surface side of the drum unit 151, a gap portion between the drum unit 151 and the developing unit 156 is the exposure window portion 7.

The axis b-b of the rotation center of the developing unit 156 is aligned with a center of a developing roller driving coupling (second drive input portion, developing roller driving force receiving portion) 154 in the right side plate 152R side as the driving side. Further, in the left side plate 152L side as the non-driving side, the rotation center b-b is aligned with a center of a supporting shaft 155. A position of the supporting shaft 155 is substantially aligned with the center of the coupling 154 with respect to cross-sectional coordinates. That is, a center axis of the coupling 154 and a center axis of the supporting shaft 155 are substantially aligned with each other.

In the right side plate 152R side as the cartridge C driving side, a drum driving coupling (first drive input portion, drum driving force receiving portion) 153, the developing roller driving coupling 154, a rotation preventing portion 157R and a driving side portion-to-be-supported (first portion-to-be-positioned) 158R are provided. A center of the drum coupling 153 is aligned with a drum axis. In the side plate 152L side as in the cartridge C non-driving side, a non-driving side rotation preventing portion 157L and a non-driving side portion-to-be-supported (second portion-to-be-positioned) 158L are provided.

The driving side rotation preventing portion 157R and the non-driving side rotation preventing portion 157L are, as described later, engaged with engaging portions 145*a* and 145*b* provided in the cartridge tray 144 side when the cartridge C is inserted into an associated one of predetermined cartridge holding portions (i) to (iv) (FIG. 7) of the cartridge tray 144 as a movable member. This will be described later in detail. The rotation preventing portions 157R and 157L act as means for preventing rotation of the cartridge C when the cartridge C is positioned relative to the apparatus main assembly 101. That is, the rotation preventing portions 157R and 157L prevent the process cartridge C from rotating when the cartridge C receives the rotational driving force from the apparatus main assembly 101.

The first portion-to-be-positioned 158R provided in the driving side is an arcuate downward projection and is provided on a lower edge of the right side plate 152R so as to be coaxial with the drum. The second portion-to-be-positioned 158L provided in the non-driving side is also an arcuate downward projection and is provided on a lower edge of the left side plate 152L so as to be coaxial with the drum.

These portions-to-be-positioned 158R and 158L are engaged with main assembly-side positioning portions 117R and 117L, respectively, provided in the apparatus main assembly 101 in the driving side and the non-driving side in a state in which the cartridge C is mounted at the predetermined mounting position in the accommodating portion 101A. The main assembly-side positioning portions 117R and 117L are provided on frames 116R and 116L of the apparatus main assembly 101 in the driving side and the non-driving side, and effect positioning of the cartridge C at the predetermined mounting position.

Incidentally, the portions-to-be-positioned 158R and 158L are, as described later, engaged with the main assembly-side positioning portions 117R and 117L in midstream of rotation of the tray 144 when the tray 144 supporting the cartridge C rotates toward the intermediary transfer belt 130.

(Mounting and Dismounting Method of Cartridge)

With use of each of the cartridges C for image formation, the developer (toner) accommodated in the developing device 3 is consumed. Then, when the developer is consumed to such an extent that an image of a quality satisfactory to a user who has purchased the cartridge C cannot be formed, the cartridge C loses commercial value thereof.

Therefore, e.g., the image forming apparatus is provided with a means (not shown) for detecting an amount of the developer remaining in individual cartridge C. Then, the detected amount of the developer in each cartridge C is compared, by the control circuit portion, with a threshold (value) preset for providing a prewarning or warning of its lifetime of the cartridge C. When the detected amount of the residual developer in the cartridge C is smaller than the preset threshold, the prewarning or warning of the lifetime of the cartridge P is displayed on a display portion (not shown). As a result, the image forming apparatus prompts the user to prepare a cartridge for exchange, or to replace the cartridge C with a fresh cartridge, in order to maintain an output image quality.

In the image forming apparatus 100 in this Reference Example 1, the exchange (replacement) of the cartridge C is performed through a method in which the cartridge C is placed on the tray 144, on which the cartridge C is mountable, to be pulled out and then is replaced in a front-access manner in order to improve usability. That is, in the front side of the apparatus main assembly 101, an opening 115 through which the cartridge C passes in order that the cartridge C is inserted into the apparatus main assembly 101 and is taken out from the apparatus main assembly 101 is provided.

Further, a cartridge door 140 as an openable member movable between a closed position A (FIGS. 1 and 2) where the opening 115 is closed and an open position belt (FIG. 5) where the opening 115 is open. The door 140 can be opened and closed and can be rotationally moved relative to the apparatus main assembly 101 about rotational fulcrum 210 provided at a lower portion of the door 140.

Figure 5:
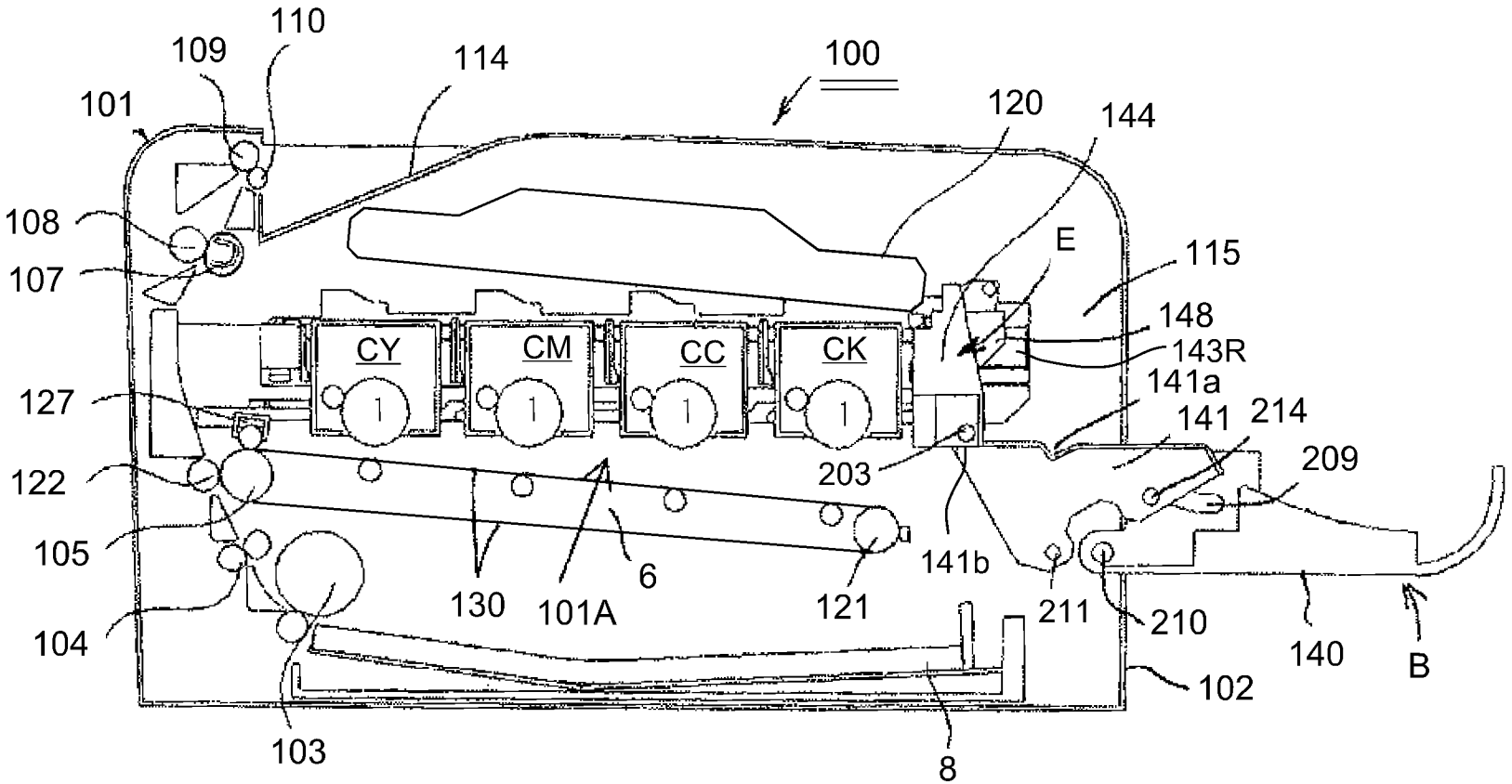
FIG. 5 is a schematic longitudinal left side view of the image forming apparatus in a state in which an opening is open by opening a door.

That is, the door 140 is rotated about the rotational fulcrum 210 by being raised substantially vertical so that it can be placed in a closed state with respect to the apparatus main assembly 101 as shown in FIGS. 1 and 2. By closing the door 140, the opening 115 is closed. Further, the door 140 is rotated frontward to the substantially horizontal direction with respect to the apparatus main assembly 101, about the rotational fulcrum 210 so that it can be placed in an open state from the apparatus main assembly 101 as shown in FIG. 5. As a result, the opening 115 at the front surface of the apparatus main assembly 101 is largely opened.

Figure 6:
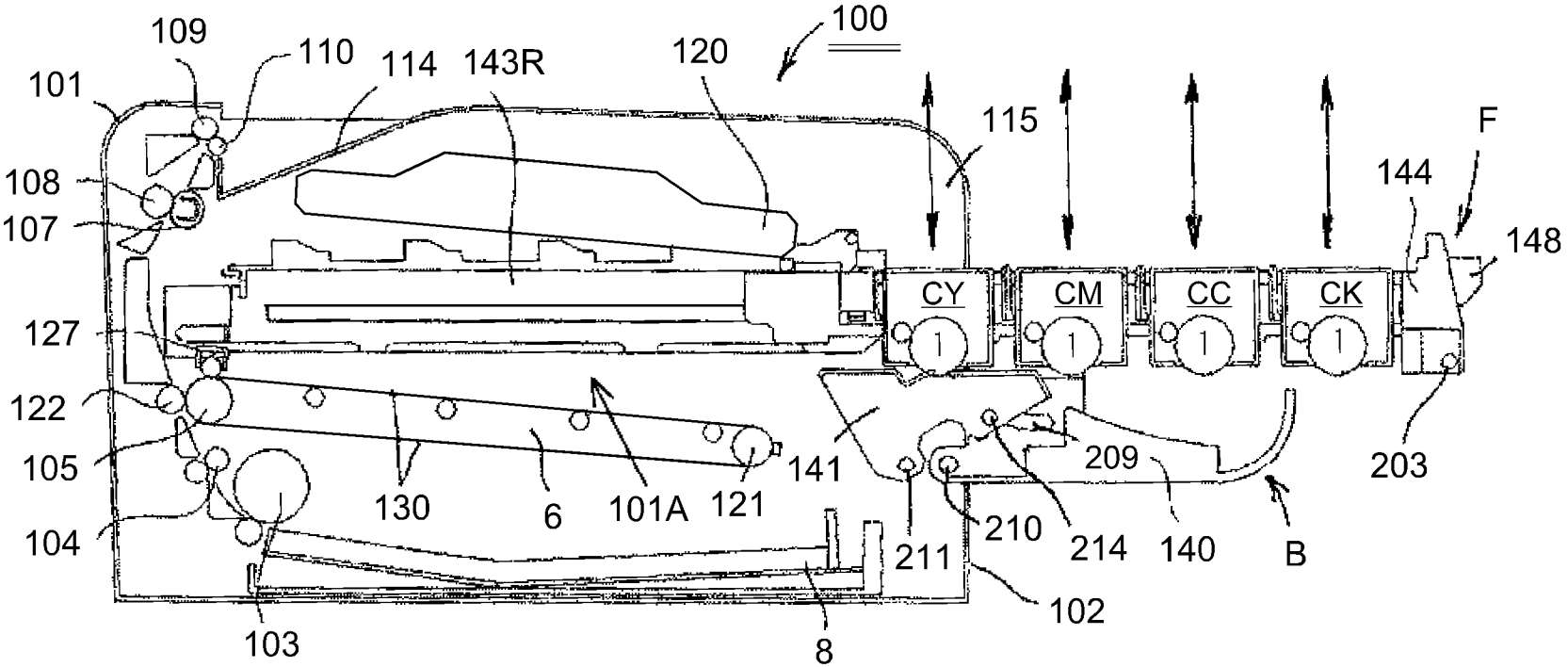
FIG. 6 is a schematic longitudinal left side view of the image forming apparatus in a state in which a tray is pulled out to an outside position.

The tray 144 supports the cartridges CY, CM, CC and CK and is movable to an outside position F located outside the apparatus main assembly 101 as shown in FIG. 6, a first inside position D located inside the apparatus main assembly 101 as shown in FIG. 2, and a second inside position E located inside the apparatus main assembly 101 as shown in FIG. 5.

The outside position F (FIG. 6: pulling-out position) is a tray movement position where the tray 144 is pulled out to a predetermined position outside the apparatus main assembly 101 and then each of the cartridges C is detachably mountable to the tray 144.

The first inside position D (FIG. 2: contact position) is a tray movement position where at the inside (cartridge accommodating portion) of the apparatus main assembly 101, each of the cartridges C supported by the tray 144 is located at a mounting position (image forming position) where the image forming apparatus 100 is capable of performing an image forming operation.

The second inside position E (FIG. 5: spaced position) is a tray movement position where at the inside (cartridge accommodating portion) of the apparatus main assembly 101, the tray 144 is positioned partway of a movement path belt the outside position F and the first inside position D.

The tray 144 is movable, between the second inside position E and the outside position F, relative to the apparatus main assembly 101 in a direction crossing the longitudinal direction of the cartridges in a state in which the tray 144 supports the four cartridges CY, CM, CC and CK as the plurality of the cartridges.

The tray 144 is horizontally held slidably and movably in the front-rear direction by a pair of tray holding members (rails) 143L and 143R (FIG. 9). Here, the front direction is a direction in which the tray 144 is pulled out from the apparatus main assembly 101, and the rear direction is a direction in which the tray 144 is inserted into the apparatus main assembly 101.

The tray 144 moves from the first inside position D (FIG. 2) to the second inside position E (FIG. 5) in interrelation with the opening movement of the door 140. As a result, the cartridges C are raised from the predetermined mounting position while being supported by the tray 144, so that the drums 1 of the cartridges C are spaced from the belt 130. Then, the tray 144 moved to the second inside position E moves from the second inside position E to the outside position F (FIG. 6) outside the apparatus main assembly 101, and thus is in a pullable state. A spacing mechanism of the drum 1 from the belt 130 will be described specifically later.

As shown in FIG. 6, when the tray 144 is pulled out to the outside position F, upper (top) surfaces of all the cartridges CY, CM, CC and CK are exposed (open). When the tray 144 is pulled out by a sufficient predetermined distance, the tray 144 is prevented by a stopper portion (not shown) from being pulled out further. The tray 144 is held in a state in which the tray 144 is horizontally pulled out to the predetermined pulling-out position.

The tray 144 roughly supports each cartridge C so as to be detachably movable upward. Further, the tray 144 roughly supports each cartridge C by moving each carriage C downward. A spent cartridge C to be replaced is raised and removed above from the tray 144. Then, a fresh cartridge C is engaged in and placed on the tray 144 from above.

Further, when each cartridge C is mounted into the apparatus main assembly 101, a reverse procedure is performed. That is, the tray 144 from which the old cartridge C is dismounted and in which the new cartridge C is mounted at the outside position F (FIG. 6) is pushed and moved into the apparatus main assembly 101, and is located at the second inside position E (FIG. 5). Then, the door 140 is rotated from an open position B (FIG. 5) to a closed position A (FIG. 2) to close the opening 115. The tray 144 moves to the first inside position D (FIG. 2) in interrelation with the closing movement of the door 140. Then, the respective cartridges C are positionally fixed and mounted at the predetermined mounting positions.

(Structure of Cartridge Tray)

Figure 7:
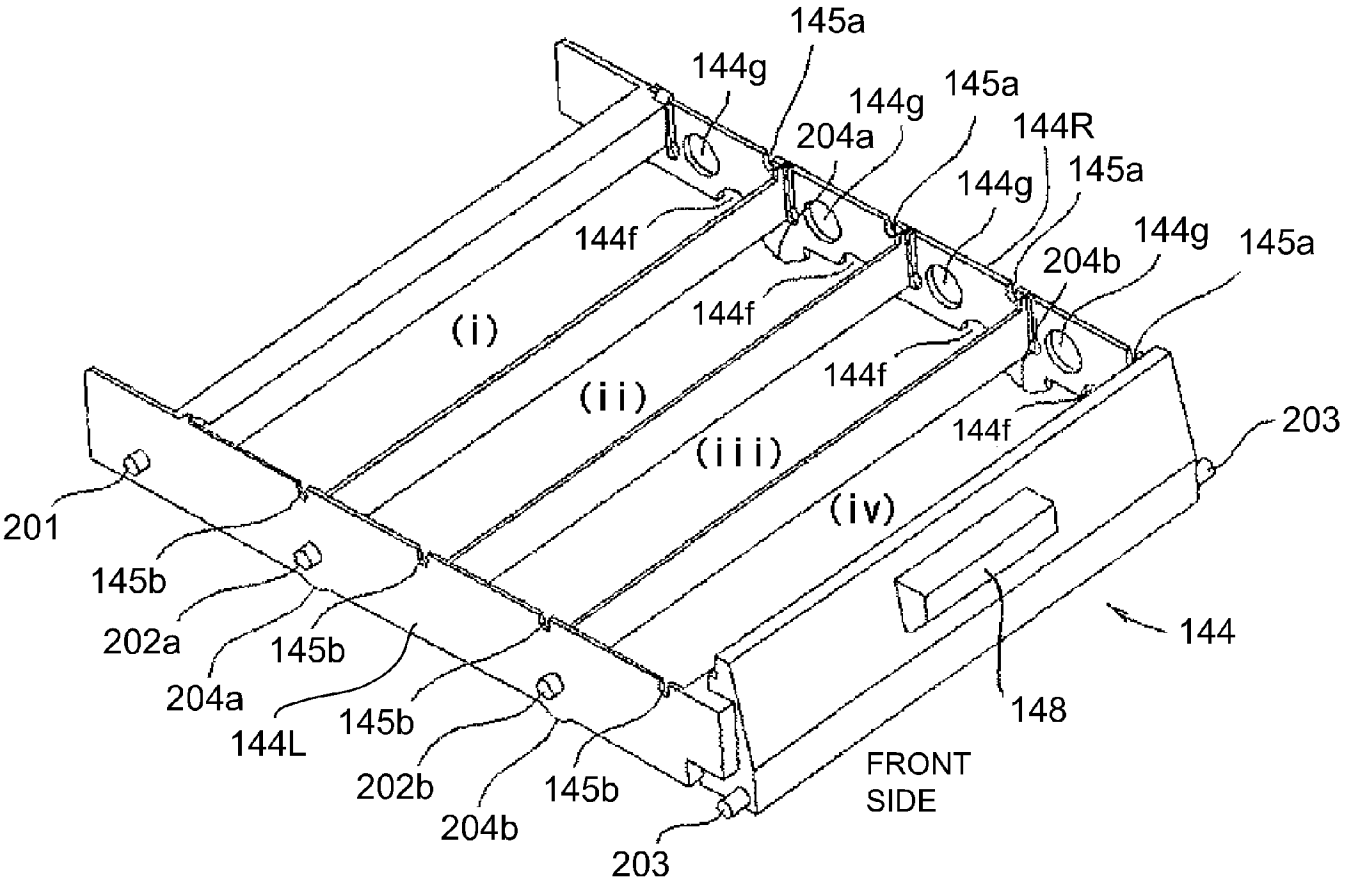
FIG. 7 is a perspective view of an outer appearance of the tray which does not support cartridges.
Figure 8:
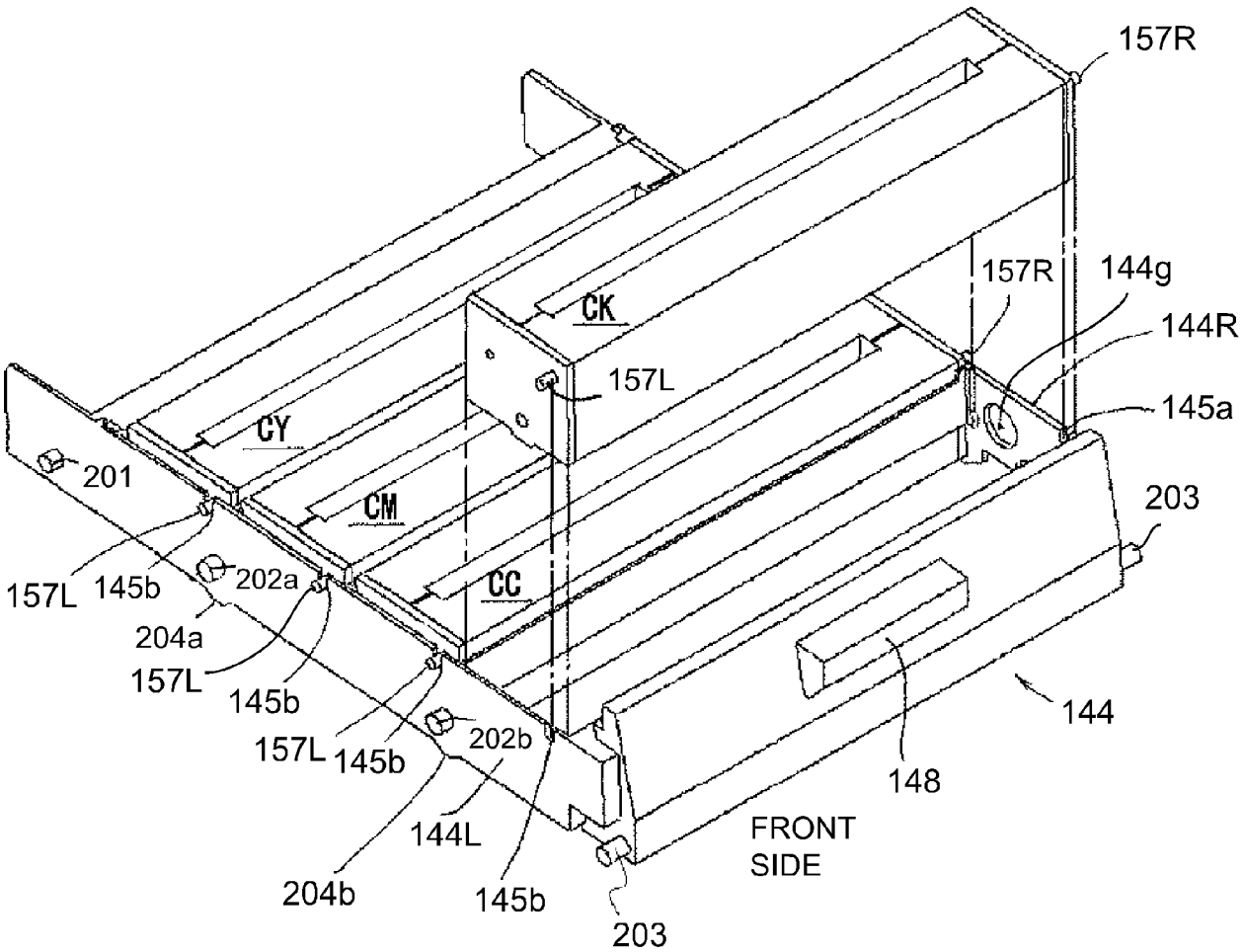
FIG. 8 is a perspective view of an outer appearance of the tray which supports the cartridges.

FIG. 7 is a perspective view of an outer appearance of the tray 144 which does not support the cartridges C, and FIG. 8 is a perspective view of an outer appearance of the tray by which the cartridges C are supported. The tray 144 includes a rectangular large frame portion, and the inside of the large frame portion is substantially equally partitioned into four areas by partitioning plates with respect to the front-rear direction thereof, so that first to fourth elongated small frame portions (i), (ii), (iii) and (iv) from the rear side to the front side are formed in the listed order. The small frame portions (i), (iv) are cartridge holding portions for holding the four cartridges CY, CM, CC and CK, respectively, and roughly support the cartridges C.

With respect to each of the small frame portions (i) to (iv), a right frame portion 144R (driving side) of the tray 144 is provided with holes 144*f* and 144*g* through which first and second drive output portions (not shown) provided in the apparatus main assembly 101 side go in and out of the cartridge tray 144. The first and second drive output portions are engaged with and disengaged from a driving side drum drive coupling (first drive input portion) 153 and a developing (device) drive coupling (second drive input portion) 154, respectively, of each cartridge C positionally fixed to the mounting portion.

Further, with respect to each of the small frame portions (i) to (iv), the right frame portion 144R of the tray 144 is provided with an engaging portion 145*a* with which the rotation preventing portion 157R (FIG. 3) of the cartridge C is to be engaged. Further, with respect to each of the small frame portions (i) to (iv), a left frame 144L (non-driving side) of the tray 144 is provided with an engaging portion 145*b* with which the rotation preventing portion 157L (FIG. 4) of the cartridge C is to be engaged.

Each of the cartridges CY, CM, CC and CK are inserted into the corresponding small frame portions (i) to (iv), respectively, of tray 144 from above in a drop-in manner while keeping the longitudinal direction at the left-right direction. When each cartridge C is gradually inserted, each of the driving side rotation preventing portion 157R and the non-driving side rotation preventing portion 157L is gradually engaged with the engaging portions 145*a* and 145*b*, respectively, provided in the tray 144 side (FIG. 8).

(Cartridge Tray Rotation and Spacing Mechanism)

The tray 144 is rotatable, between the first inside position D and the second inside position E in the apparatus main assembly 1, about the Reference Examples 201 (rotating centers: rotational fulcrum in the right frame side is not shown) provided coaxially at the left and right frame portions in the rear end portion side in interrelation with the opening and closing operation of the door 140.

That is, when the door 140 is located at the closed position A as shown in FIG. 2, the tray 144 is located at the first inside position D. When the door 140 is opened from the closed position A to the open position B as shown in FIG. 5, the tray 144 is rotated and moved from the first inside position D to the second inside position E about the rotational fulcrums 201 by an interrelating member interrelated with the opening rotation operation of the door 140.

Further, on the other hand, when the door 140 is open at the open position B as shown in FIG. 5 and the tray 144 is located at the second inside position E, the door 140 is closed to the closed position A as shown in FIG. 2. Then, the tray 144 is rotated and moved from the second inside position E to the first inside position D about the rotational fulcrums 201 by an interrelating member interrelated with the closing rotation operation of the door 140.

1) An interrelating mechanism and an interrelating operation will be described specifically with reference to FIGS. 9, 10 and 11. FIGS. 2 and 9 show a state in which the door 140 is located at the closed position A and the tray 144 is located at the first inside position D.

In this state, boss portions (interrelating portions) 203 provided coaxially at the left and right frame portions in the front end portion side of the tray 144 are supported by first boss supporting portions 141*a* of left and right door links of the door 140. The rotational fulcrums 201 of the tray 144 are supported by the tray holding members 143L and 143R. In this state, the tray 144 is held at the first inside position D in which the tray 144 is inclined so that its front side is low.

Here, the closed state of the door 140 is stably held by movement prevention of the boss portions 214, of the door links 141, positioned at upper end portions of door guiding portions (elongated holes) 209 of the door 140 placed in the closed state.

When the tray 144 is located at the first inside position D, the first and second portion-to-be-positioned 158R and 158L (FIGS. 3 and 4) provided in the driving side and the non-driving side of each of the held cartridges C are engaged with main assembly-side positioning portions 117R and 117L, respectively, provided in the apparatus main assembly side. Then, each cartridge C is urged against the main assembly-side positioning portions 117R and 117L by an urging operation of an urging mechanism (not shown) provided in the apparatus main assembly 101 side.

As a result, the respective cartridges C are, as shown in FIG. 2, obliquely arranged relative to the horizontal direction so that the front side of the tray 144 is low, and are positionally fixed and mounted at the predetermined mounting positions (oblique arrangement of the cartridges). In this mounted state, the drums 1 of the cartridges C contact the belt 130 of the intermediary transfer belt unit 6. That is, each cartridge C is positionally fixed and mounted at the image formable position. On the basis of an image formation start signal, the first and second drive output portions, of the apparatus main assembly 101, corresponding to each cartridge C enter the tray 144 through the holes 144*f* and 144*g* (FIG. 7) of the tray 144. Then, the first and second drive output portions are engaged with the associated drum drive coupling 153 and the associated developing drive coupling 154 of the cartridge C, so that the drum 1, the developing roller and other movable portions of each cartridge C are driven.

Further, from a power source portion (not shown) in the apparatus main assembly 101 side, a predetermined charging bias and a predetermined developing bias are applied to each cartridge C via electrical contact portions (not shown). As a result, the image forming operation of each cartridge C is executed.

When an image forming job is ended, the first and second drive output portions are retracted and moved to the outside of the tray 144 through the holes 144*f* and 144*g*, thus being disengaged from the drum drive coupling 153 and the developing drive coupling 154 of each cartridge C. In this state, the image forming apparatus 100 is held in a stand-by state until a subsequent image formation start signal is inputted.

2) When the cartridge C mounted in the apparatus main assembly 1 is exchanged (replaced), as a first procedure, a user (operator) opens and rotates the door 140, located at the closed position A (FIGS. 2 and 9), about the rotational fulcrums 210 to move the door 140 to the open position B (FIGS. 5 and 10). This opening rotation of the door 140 is carried out against weight moment, in the tray 144 side, acting from the boss portions 203 of the tray 144 toward the boss supporting portions 141*a* of the door links 141.

By sufficiently opening and rotating the door 140 to the open position B, the door 140 is held by a catcher (not shown), and thereafter the opened state is stably held even when the user unlinks his (her) hand. As a result, the opening 115 largely opens. Further, in an opening rotation process of the door 140, the state of the urging mechanism for urging the cartridge C is changed from an urged state to a non-urged state, so that urging-fixing of each cartridge C to the apparatus main assembly 101 is eliminated.

Further, by the opening rotation of the door 140, the left and right door links 141 of the door 140 are rotated about door link fulcrums 211 to the state shown in FIGS. 5 and 10 while boss portions 214 are guided by door guiding portions 209. With this rotation of the door links 141, the tray 144 is raised so that the boss portions 203 are moved from first boss supporting portions 141*a* to second boss supporting portions 141*b* of the door links 141 and then are raised by the second boss supporting portions 141*b*.

By this raising of the tray 144, the tray 144 is rotated about the rotational fulcrums 201 to a substantially horizontal attitude. Further, by the rotation of the tray 144, guiding boss portions 202*a* and 202*b* provided on outer surfaces of the left and right frame portions 144L and 144R of the tray 144 while being spaced in the front-rear direction are guided to cut-away portions 146*a* and 146*b*, respectively. This rotation movement position of the tray 144 in a horizontal attitude is the second inside position E of the tray 144.

The tray 144 moves from the first inside position D to the second inside position E in interrelation with the opening operation of the door 140, whereby the cartridges C are raised while being supported by the tray 144, and the drums 1 of the cartridges C are spaced from the belt 130. Thus, the tray 144 moved to the second inside position E is in a pullable-out state in the horizontal attitude from the second inside position E toward the outside position F (FIG. 6) outside the apparatus main assembly 101 along the tray holding members 143L and 143R.

The tray 144 placed in the pullable-out state is passed through the opening 115 by pulling a grip portion 148 by the user, so that the tray 144 can be moved to the outside position F of the apparatus main assembly 101 as shown in FIGS. 6 and 11.

When the tray 144 is pulled out, the rotational fulcrums 201 and the guiding boss portions 202*a* and 202*b* are supported and slide on the guide rail portions 147 (147*a*,147*b*, 147*c*) provided on the tray holding members 143L and 143R. Further, the tray supporting portions 204*a* and 204*b* of the tray 144 are supported and slide on the door links 141. As a result, the tray 144 is pulled out in the horizontal attitude from the second inside position E inside the apparatus main assembly 101 to the outside position F outside the apparatus main assembly 101. At the outside position F of the tray 144, as described above, the exchanging (replacing) operation between the old and new contacts C is performed.

3) When the exchanging operation between the old and new cartridges C is ended, the tray 144 is passed through the opening 115 from the outside position F outside the apparatus main assembly 101 and then is sufficiently pushed into the inside of the apparatus main assembly 101 to the second inside position E. Then, the door 140 held at the open position B by the catcher is closed and rotated against a retaining force of the catcher to be moved to the closed position A.

By the closing rotation of the door 140, the left and right door links 141 of the door 140 are rotated about door link fulcrums 211 from the state shown in FIGS. 5 and 10 to the state shown in FIGS. 2 and 9 while boss portions 214 are guided by door guiding portions 209. With this rotation of the door links 141, the tray 144 is lowered so that the boss portions 203 are moved from the second boss supporting portions 141*b* to the first boss supporting portions 141*a* of the door links 141, thus being lowered.

By this lowering of the tray 144, the tray 144 is rotated about the rotational fulcrums 201 from the substantially horizontal attitude at the second inside position E to a frontward lowering attitude at the first inside position D. Further, by the rotation of the tray 144, the guiding boss portions 202*a* and 202*b* provided on outer surfaces of the left and right frame portions 144L and 144R of the tray 144 are moved downward through the cut-away portions 146*a* and 146*b*, respectively.

The tray 144 moves from the second inside position E to the first inside position D, whereby the cartridges C are lowed, and the drums 1 of the cartridges C contact the belt 130. Further, the first and second portions-to-be-positioned 158R and 158L of each cartridge C are engaged with the main assembly-side positioning portions 117R and 117L, respectively, of the apparatus main assembly 101. Then, the state of the urging mechanism in the apparatus main assembly 101 side is changed from the non-urged state to the urged state and then each cartridge C is urged against the main assembly-side positioning portions 117R and 117L by the urging operation, so that each cartridge C is positionally fixed and mounted at the image formable position.

In the above, the door links 141 are the interrelating members, movable in interrelation with movement of the door 140, for moving the tray 144 to the second inside position E when the door 140 is located at the open position B and for moving the tray 144 to the first inside position D when the door 140 is located at the closed position A. Further, the tray 144 is movable between the first inside position D and the second inside position E by rotationally moving about the rotation centers 201. The tray 144 is in the inclined state relative to the horizontal surface at the first inside position D and is in the substantially horizontal state at the second inside position E.

In this way, by rotationally spacing the cartridges C from the intermediary transfer belt 130, compared with a conventional tray raising and lowering mechanism, the number of components can be reduced, and an amount of movement of the tray in the apparatus main assembly can be decreased. As a result, it becomes possible to realize space saving of the apparatus main assembly.

Further, even in the case of the apparatus main assembly of the pulling-out cartridge tray type in which the cartridges are obliquely arranged as in this Reference Example 1, the tray can be pulled out in the horizontal direction, so that usability is improved.

Further, in Reference Example 1, the description is made based on an ITB (intermediary transfer belt) type using the intermediary transfer belt 130. However, also in an image forming apparatus of an ETB (electrostatic transfer belt) type using an electrostatic conveying belt 130 for carrying and conveying the recording material 8 to an image transfer portion with the drum 1 of each cartridge C as shown in FIG. 12, a similar effect can be obtained. In FIG. 12, the electrostatic conveying belt is represented by a reference symbol 6A.

Reference Example 2

FIGS. 13 to 19 are illustrations of an image forming apparatus in Reference Example 2. In Reference Example 2, constituent members or portions similar to those of the image forming apparatus 100 in Reference Example 1 described above are represented by the same reference numerals or symbols and will be omitted from redundant description. Further, indication of the reference numerals or symbols in the drawings in partly omitted.

FIG. 13 is a schematic longitudinal left side view of an image forming apparatus 100 in Reference Example 2. The first to fourth cartridges CY, CM, CC and CK are arranged, in the listed order from the rear side toward the front side, obliquely toward an upper front side with respect to the horizontal direction, and are positionally fixed and mounted at predetermined mounting positions (image formation positions). At this mounting position, each cartridge C is capable of performing an image forming operation.

Incidentally, in the image forming apparatus 100 in Reference Example 2, each cartridge C is the integral type process cartridge similarly as the cartridge C in Reference Example 1, but a constitution in which each drum 1 is mounted so as to be directed upward is employed. As the constituent members of each contact, the drum 1 is representatively shown in the figures, but process means actable on the drum 1 will be omitted from illustration.

Above the cartridge accommodating portion 101A, the intermediary transfer belt unit 6 is provided, and below the cartridge accommodating portion 101A, the laser scanner 120 is provided. The intermediary transfer belt unit 6 is disposed obliquely toward the upper front side with respect to the horizontal direction correspondingly to the oblique arrangement of the cartridges C. The drum 1 of each of the cartridges C positionally fixed and mounted at the mounting positions contacts the belt 130 of the intermediary transfer belt unit 6. Also the laser scanner 120 is disposed obliquely toward the upper front side with respect to the horizontal direction.

In Reference Example 2, the cartridges C are disposed in the lower side of the belt 130. By employing such an arrangement, a distance from a position of formation of the image on the drum 1 to a position of transfer of the image onto the recording material 8 can be shortened, and therefore it becomes possible to shorten the FPOT.

In Reference Example 2, the first inside position D of the tray 144 is a movement position, in the attitude obliquely toward the upper front side as shown in FIG. 13, where each of the cartridges C is located at the mounting position where each cartridge C is capable of performing the image forming operation. FIG. 16 is a perspective view of an outer appearance of the tray in Reference Example 2. The tray 144 rotates about the rotational fulcrums 201 in interrelation with the opening and closing operation of the door 140. The laser scanner 120 is positioned relative to the tray 144 by a positioning means (not shown), and is rotated together with the tray 144 in interrelation with the opening and closing of the door 140.

1) The door 140 is stably held in the closed state by a locking mechanism (not shown). When the door 140 is located at the closed position A, as shown in FIGS. 13 and 17, boss portions (interrelating portions) 203 as free end portions of the left and right frame portions 144L and 144R of the tray 144 are supported by first boss supporting portions 141*a* of left and right door links of the door 140. The rotational fulcrums 201 of the tray 144 are supported by the tray holding members 143L and 143R. As a result, the tray 144 is held at the first inside position D in which the tray 144 is inclined so that its front side is high.

In this state, the cartridges C held by the cartridge holding portions (i) to (iv) of the tray 144 are positionally held at predetermined mounting positions in the cartridge mounting point 101A.

That is, upward non-driving side rotation preventing portions 157L and driving side portions-to-be-supported 158R for the cartridges C are urged against downward main assembly-side positioning portions (not shown) provided on frames (not shown) of the apparatus main assembly in the non-driving side and the driving side, respectively. As a result, each cartridge C is positionally held at the predetermined mounting position. The drum 1 of each cartridge C positionally fixed and mounted at the mounting position contacts the belt 130 of the intermediary transfer belt unit 6.

2) The opening operation of the door 140 is made by releasing the locking mechanism to be moved from the closed position A to the open position B. Substantially horizontal open state of the door 140 at the open position B is stably maintained by movement prevention of boss portions 214, of door links 141, positioned at lower end portions of door guiding portions (elongated holes) 209 of the door 140 in the open state.

By this opening rotation of the door 140, the left and right door links 141 of the door 140 are rotated about door link fulcrums 211 to the state shown in FIGS. 14 and 18 while boss portions 214 are guided by door guiding portions 209. With this rotation of the door links 141, the boss portions 203 of the tray 144 are lowered by the second boss supporting portions 141*b*. By this lowering of the tray 144, the tray 144 is rotated and moved about the rotational fulcrums 201 to the second inside position E where the tray 144 in a substantially horizontal attitude. Also the laser scanner 120 is rotated together with the tray 144 to the horizontal attitude.

By this rotational movement of the tray 144, also the cartridges C held by the tray 144 are lowered, and the drums 1 of the cartridges C are spaced from the belt 130 of the belt unit 6.

That is, the user opens the door 140, so that the tray 144 rotates about the rotational fulcrums 201 clockwise. At this time, the door links 141 are rotated to the state shown in FIGS. 14 and 18 while the boss portions 214 are guided by the door guiding portions 209. With the rotation of the door links 141, the tray 144 rotates about the rotational fulcrums 201 while the boss portions 203 are guided. The tray 144 rotates until the guiding boss portions 202*a* and 202*b* are supported by the guiding rail portions 147. The tray 144 rotates and moves to the second inside position E where this state is created, so that the tray 144 is in a state in which the tray 144 is pulled out and moved to the outside position F outside the apparatus main assembly 101 as shown in FIGS. 15 and 18.

When the tray 144 is pulled out, the rotational fulcrums 201 of the tray 144 and the guiding boss portions 202*a* and 202*b* are supported and slide on the guide rail portions 147 provided on the guide holding members 143L and 143R. Further, the tray supporting portions 204*a* and 204*b* of the tray 144 are supported and slide on the door links 141, whereby, the tray 144 is pulled out to the outside of the apparatus main assembly 101. At this time, the laser scanner 120 is disconnected from the tray 144, and is not moved together with the tray 144, so that the laser scanner 120 is left standing inside the apparatus main assembly 101 while being kept in the horizontal attitude.

3) At the position F shown in FIGS. 15 and 19, when the exchange between the old and new cartridges C relative to the tray 144 is ended, the tray 144 is pushed in and moved back to the second inside position E. Then, the door 140 is rotated and moved from the open position B to the closed position A until the door 140 is locked by the locking mechanism. In interrelation with the closing rotation of the door 140, the tray 144 is returned from the second inside position E to the first inside position D. At this time, the laser scanner 120 is positioned relative to the tray 144 by the positioning means, and is rotated together with the tray 144. The cartridges C held by the tray 144 are positionally held at the predetermined mounting positions.

By simultaneous rotation of the laser scanner 120 with the tray 144, whereby a portion below the surface 120 can be effectively used as a space for jam clearance. That is, by simultaneously rotating the tray 144 and the laser scanner 120, even in the constitution in which the cartridges are disposed below the belt 120, by utilizing the space which is naturally used for the jam clearance, it becomes possible to pull out the tray in the substantially horizontal direction. As a result, even in the constitution in which the cartridges are obliquely disposed with respect to the horizontal surface, usability is improved, and the space can be effectively utilized.

Further, also in Reference Example 2, similarly as in the case of FIG. 12 in Reference Example 1, the description is made based on an ITB (intermediary transfer belt) type using the intermediary transfer belt 130. However, also in an image forming apparatus of an ETB (electrostatic transfer belt) type using an electrostatic conveying belt 130 for carrying and conveying the recording material 8 to an image transfer portion with the drum 1 of each cartridge C, a similar effect can be obtained.

In a conventional image forming apparatus having a pulling-out constitution in which a plurality of cartridges are integrally pulled out and then are capable of being mounted into and dismounted from a cartridge tray, a drum spacing constitution from an endless belt (ITB) such as an intermediary transfer belt or an electrostatic conveyer belt is complicated by a raising and lowering mechanism or the like for the cartridge tray. Further, in the case where the cartridges are obliquely disposed with respect to the horizontal surface, the cartridge tray is not readily pulled out in the oblique direction.

In the image forming apparatuses in Reference Examples 1 and 2 described above, the drum spacing mechanism is simplified by omitting the tray raising and lowering movement mechanism to reduce the number of components, so that even in the oblique arrangement of the cartridges, improvement in usability is realized by facilitating the pulling-out of the tray 144.

That is, the cartridges are rotated in interrelation with the openable door and are spaced from the belt, whereby the spacing constitution can be simplified compared with a conventional constitution in which the cartridges are translated relative to the belt. Further, in the case of the oblique arrangement of the cartridges, the cartridge tray is rotated and disposed in the substantially horizontal state, whereby the pulling-out operation can be performed with respect to the substantially horizontal direction, and thus usability can be improved.

Embodiment 1

General Structure of Image Forming Apparatus

FIGS. 20 to 26 are illustrations of an image forming apparatus 100 in Embodiment 1. In this embodiment, constituent members or portions similar to those of the image forming apparatus 100 in Reference Examples 1 and 2 described above are represented by the same reference numerals or symbols and will be omitted from redundant description. Further, indication of the reference numerals or symbols in the drawings in partly omitted.

FIG. 20 is a schematic longitudinal left side view of the image forming apparatus 100 in this embodiment in a state in which the door 140 is closed. The clocked state of the door 140 is stably held by the locking mechanism (not shown). The image forming apparatus 100 in this embodiment is basically a four color-based full-color laser printer, using an electrophotographic process, to which four cartridges C (CY, CM, CC, CK) are detachably mountable similarly as in the image forming apparatuses 100 in Reference Examples 1 and 2. Further, exchange of the cartridges C is made by a method in which the cartridges C are placed on a pulling-out type tray 144 on which the cartridges C are mountable and then are exchanged in a front-access manner.

Similarly as in the image forming apparatuses 100 in Reference Example 2, the oblique arrangement constitution in which the first to fourth cartridges CY, CM, CC and CK are obliquely arranged toward the upper front side with respect to the horizontal surface is employed. The first to fourth cartridges CY, CM, CC and CK are arranged, in the listed order from the rear side toward the front side, obliquely toward the upper front side with respect to the horizontal direction Further, the cartridges are positionally fixed and mounted at predetermined mounting positions (image formation positions: contact positions). At this mounting position, each cartridge C is capable of performing an image forming operation.

Incidentally, in the image forming apparatus 100 in this embodiment, each cartridge C is the integral type process cartridge similarly as the cartridge C in Reference Example 2, but a constitution in which each drum 1 is mounted so as to be directed upward is employed. As the constituent members of each contact, the drum 1 is representatively shown in the figures, but process means actable on the drum 1 will be omitted from illustration.

Above the cartridge accommodating portion 101A, the intermediary transfer belt unit 6 is provided, and below the cartridge accommodating portion 101A, the laser scanner 120 is provided. These members 6 and 120 are positioned relative to the apparatus main assembly 101. The belt unit 6 is disposed obliquely toward the upper front side with respect to the horizontal direction correspondingly to the oblique arrangement of the cartridges C. The drum 1 of each of the cartridges C positionally fixed and mounted at the mounting positions contacts the belt 130 of the intermediary transfer belt unit 6. Also the scanner 120 is disposed, with a predetermined interval from the cartridges C, obliquely toward the upper front side with respect to the horizontal direction.

Similarly as in the image forming apparatus 100 in Reference Example 2, the cartridges C are disposed in the lower side of the belt 130. By employing such an arrangement, a distance from a position of formation of the image on the drum 1 to a position of transfer of the image onto the recording material 8 can be shortened, and therefore it becomes possible to shorten the FPOT.

In this embodiment, the first inside position D of the tray 144 holding the cartridges C is a movement position, in the attitude obliquely toward the upper front side as shown in FIG. 20, where each of the cartridges C is located at the mounting position where each cartridge C is capable of performing the image forming operation.

When the door 140 is located at the closed position A, the rotational fulcrums 201 and the left and right frame portions 144L and 144R (FIG. 24) in the rear end side of the tray 144 are positioned at bearing portions 143*a* (FIG. 21). The bearing portions 143*a* are rear end portions of the left and right tray holding members (rails) 143L and 143R in the apparatus main assembly 101. Further, interrelating portions (portions-to-be-urged) 144*h* provided at the front frame portion also functioning as a grip portion of the tray 144 are urged and caught by contact portions 141*c* of the door links 141, in the front end side, which are rotated in an erecting direction in the left and right sides of the door 140.

In this state, the tray 144 held at the first inside position D where the tray 144 is inclined toward the upper front side, and the cartridges C held by the tray 144 are positionally held at predetermined mounting positions in the cartridge mounting point 101A (FIG. 20).

That is, upward non-driving side rotation preventing portions 157L and driving side portions-to-be-supported 158R (FIG. 23) for the cartridges C are urged against main assembly-side positioning portions 117L and 117R, respectively. The main assembly-side positioning portions 117L and 117R are provided downward on frames 116L and 116R of the apparatus main assembly 101 in the non-driving side and the driving side, respectively. As a result, each cartridge C is positionally held at the predetermined mounting position. Further, the drum 1 of each cartridge C contacts the belt 130 of the belt unit 6.

The opening operation of the door 140 is made by releasing the locking mechanism to be moved from the closed position A (FIG. 20) to the open position B (FIG. 21).

When the door 140 is rotated from the closed position A to the open position B, the left and right door links 141 of the door 140 are rotated about door link fulcrums 211 to the state shown in FIG. 21 while boss portions 214 are guided by door guiding portions 209.

By the rotating operation of the door link 141, the interrelating portions 144*h* of the tray 144 are lowered while sliding on the door links 141, so that the tray 144 is rotated about the rotational fulcrums 201 in a direction in which the tray 144 is substantially horizontal. When the tray 144 is rotated and moved to the substantially horizontal position, the guiding portions 144*k* (FIG. 24) are engaged with the left and right tray holding members 143L and 143R, so that the tray 144 is held in the horizontal attitude (FIG. 21).

This horizontal attitude rotation position of the tray 144 is the second inside position (spaced position) E of the tray 144. The tray 144 is rotated and moved to the second inside position E, whereby as shown in FIG. 22, the tray 144 is capable of being pulled out and moved to the outside position (mounting and dismounting position) F outside the apparatus main assembly 101. This pulling-out movement of the tray 144 is made in a manner such that boss portions 201, auxiliary boss portions 201*a* and the guiding portions 144*k* in the tray 144 side are guided by the tray holding members 143L and 143R.

When the tray 144 is pulled out to the outside position F, engagement of the guiding portions 144*k* with the tray holding members 143L and 143R is eliminated partway. Even when the engagement is eliminated, the boss portions 201 and the auxiliary boss portions 201*a* are still engaged with the tray holding members 143L and 143R, so that the pulled-out state of the tray 144 is maintained.

In this embodiment, the tray 144 is moved in interrelation with the opening rotation of the door 140, so that the drum 1 of each cartridge C is spaced from the belt 130, and at the same time, a pitch between adjacent drums of adjacent cartridges C is increased. Thereafter, when the tray 144 is pulled out from the apparatus main assembly 1, the upper surface of each cartridge C is exposed (open), so that it is possible to ensure a mounting locus along which one cartridge C does not interfere with the adjacent cartridge thereof. A method of changing the pitch between the adjacent drums will be described later.

(Structure of Cartridge)

In this embodiment, the respective cartridges C have the same structure. The structure of each cartridge C will be described with reference to FIG. 23. In FIG. 23, (a) is a perspective view of the cartridge C as seen from the non-driving side, and (b) is a perspective view of the cartridge C as seen from the driving side.

In this embodiment, the drum pitch between the adjacent cartridges C is narrowed (decreased) while ensuring a space for components necessary to the cartridges C and a volume of the developers. For that reason, the drum unit 151 of one cartridge C and the developing unit 156 of the adjacent cartridge C are disposed so as to overlap with each other with respect to the up-down direction of the apparatus main assembly 101 (FIG. 20). In this embodiment, constituent members or portions similar to those in the cartridges C in Reference Examples 1 and 2 will be omitted from redundant description by adding the same reference numerals or symbols.

(Structure of Tray and Peripheral Members)

With reference to FIGS. 20 and 24, structures of the tray and peripheral members of the tray 144 will be described. FIG. 24 is a perspective view of the tray 144. The tray 144 roughly supports the respective cartridges C. Each of the right frame portion 144R (driving side) and the left frame portion 144L (non-driving side) is provided with guiding portions 144*a*, 144*b*, 144*c* and 144*d* for guiding the associated rotation preventing portions 157R and 157L of the cartridges C.

Further, the tray 144 is provided with the rotational fulcrums 201 as the rotation centers used during an operation (contact and separation operation) between the first inside position D and the second inside position E. Further, the tray 144 is provided with the portions-to-be-guided 144*k* used during an operation (insertion and pulling-out operation) between the second inside position E and the outside position F. Further, the tray 144 is provided with the interrelating portions 144*h* interrelated with the opening and closing operation of the door 140.

The door 140 is provided with link grooves 209 and rotation shafts 210, and the rotation shafts 210 are rotatably supported by the apparatus main assembly 101. Each of the door links 141 is movably connected with the link groove 209 of the door 140 at the boss portion 214 provided in one end portion thereof, and is rotatably supported by the apparatus main assembly 101 at a door link fulcrum 211 provided at the end portion. The door links 141 slidably contact the interrelating portions 144*h* of the tray 144.

(Positional Movement Operation of Tray)

With reference to FIGS. 24, 25 and 26, a positional movement operation of the tray 144 in the order of the outside position F, the second inside position and the first inside position D and a drum pitch changing operation between the cartridges C will be described. In FIG. 25, (a), (b) and (c) show operations of the respective units at the outside position F, the second inside position E and the first inside position D, respectively. In FIG. 26, (a) and (b) show a change in drum pitch between the cartridges at the first inside position D and the second inside position E of the tray 144.

First, the cartridges C are mounted in the tray 144. Each cartridge C is inserted into the tray 144 in a drop-in manner. When each cartridge C is inserted into the tray 144, each of the driving side rotation preventing portion 147R and the non-driving side rotation preventing portion 157L is gradually engaged with the associated ones of the guiding portions 144*a*, 144*b*, 144*c* and 144*d* in the tray 144 side. In this state, the cartridges C are mounted with a drum distance P2 so as to be independently mountable from above and dismountable upward ((a) of FIG. 25).

Next, the tray 144 is moved from the outside position F ((a) of FIG. 25) to the second inside position E ((b) of FIG. 25). When the tray 144 is inserted into the second inside position E inside the apparatus main assembly, the boss portions 201, the auxiliary boss portions 201*a* and the guiding portions 144*k* are guided by the tray holding members 143L and 143R. When the tray 144 reaches the second inside position E, the boss portions 201 are engaged with the bearing portions 143*a* of the tray holding members 143L and 143R ((b) of FIG. 25).

Next, the tray 144 is moved from the second inside position E to the first inside position D. When the user closes the door 140 located at the open position B to the closed position A, the door links 141 rotate about the door link fulcrums 211 in the erecting direction in interrelation with the door 140. After the door links 141 contact the interrelating portions 144*h* of the tray 144, when the door 144 is further closed, the tray 144 is rotated upward about the boss portions 201 ((c) of FIG. 25).

At this time, the cartridges C are moved in arrow directions by self-weight while the rotation preventing portions 157L and 157R are guided by the guiding portions 144*a*, 144*b*, 144*c* and 144*d* ((a) of FIG. 26). At that time, the portions-to-be-positioned 158L and 158R of each cartridge C are engaged with the downward main assembly-side positioning portions 117L and 117R provided to the driving side and non-driving side frames 116L and 116R of the apparatus main assembly 101.

As a result, the cartridges C are positioned relative to the apparatus main assembly with a drum distance P1, and contact the belt 130. In this case P1<P2 is satisfied. The door 140 is sufficiently rotated to the closed position A, whereby the closed state thereof is stably maintained by the locking mechanism.

Next, with reference to FIGS. 25 and 26, a positional movement operation of the tray 144 in the order of the first inside position D, the second inside position E and the outside position F and a drum pitch changing operation between the cartridges C will be described.

First, the positional movement operation of the tray 144 from the first inside position D to the second inside position E will be described. When the user releases the locking mechanism and opens the door 140 from the closed position A to the open position B, in interrelation therewith, the door links 141 rotate downward about the door link fulcrums 211 in the front side. By this rotation operation of the door links 141, while the interrelating portions 144*h* of the tray 144 slide with the door links 141, the tray 144 rotates about the boss portions 201.

At this time, each cartridge C slides on the guiding surfaces 159 and 160 (FIG. 23) by self-weight thereof. The rotation preventing portions 157L and 157R of the cartridges C are guided by the guiding portions 144*a*, 144*b*, 144*c* and 144*d* of the tray 144, and therefore, the cartridges C are moved in arrow directions in (b) of FIG. 26. As a result, at the second inside position E of the tray 144, the cartridges C are held in the tray 144 with the drum distance P2. At this time, P1<P2 is satisfied.

When the tray 144 is further pulled out to the outside position F, each cartridge C can be dismounted toward right above since the adjacent cartridges C are held in the tray 144 at a non-overlapping position (FIG. 22 and (*a*) of FIG. 25).

In this way, in interrelation with the opening operation of the door 140, the drum pitch between the adjacent cartridges C is increased, whereby during the mounting and dismounting of the cartridges C, it is possible to ensure a mounting locus along which the adjacent cartridges C do not interfere with each other. As a result, when the tray 144 is located at the outside position F, the cartridges C can be individually pulled out in the upward direction, so that usability is improved. Further, the drum pitch is decreased in interrelation with the closing operation of the door 140, and therefore it is possible to shorten the FPOT.

Further, in this embodiment, the ITB type using the intermediary transfer belt 130 is described, but a similar effect can be obtained also in the ETB type using the electrostatic conveyer belt. Further, in this embodiment, the tray spacing method using the rotation movement type is described, but may also be changed to a tray spacing method using a translation type (horizontal movement) described later.

Embodiment 2

(General Structure of Image Forming Apparatus)

Embodiment 2 of the present invention will be described. In this embodiment, constituent members or portions similar to those of the image forming apparatus in Reference Examples 1 and 2 described above are represented by the same reference numerals or symbols and will be omitted from redundant description. Further, indication of the reference numerals or symbols in the drawings is partly omitted.

(General Structure of Image Forming Apparatus)

With reference to FIG. 27, an outline of a general structure of an image forming apparatus 100 in this embodiment will be described. FIG. 27 is a schematic sectional view of the image forming apparatus 100 in a state in which the door 140 is located at the closed position A and in which the tray 144 is located at the first inside position D.

In this embodiment, relative to the intermediary transfer belt 130, the cartridges C and the scanner 120 are disposed in the upper side. By employing such an arrangement, the image forming apparatus 100 is advantageous in terms of toner scattering from the cartridges C to the scanner 120, and toner supply to the drums 1 can be made by utilizing self-weight of the toner. Therefore, the toner supplying means can be simplified, so that it is possible to realize downsizing and cost reduction.

(Structure of Tray and Peripheral Members)

With reference to FIGS. 27, 28 and 29, structures of the tray and peripheral members of the tray 144 will be described. FIG. 28 is a perspective view of the tray 144 and peripheral members of the tray 144. FIG. 29 is a perspective view of a tray contact and separation mechanism. The tray 144 roughly supports the respective cartridges CY, CM, CC and CK. Each of the right frame portion 144R (driving side) and the left frame portion 144L (non-driving side) is provided with guiding portions 144*a*, 144*b*, 144*c* and 144*d* for guiding the associated rotation preventing portions 157R and 157L of the cartridges C. Further, the tray 144 is provided with portions-to-be-guided 144*m* and 144*n* during the contact and separation operation.

The tray 144 is held horizontally slidably and movably in the front-rear direction by the pair of rails 243 provided on the left and right frames, of the apparatus main assembly, constituting the apparatus main assembly frame. The rails 243 are provided with guiding portions 243*a*, 243*b*, 243*c* and 243*d* for guiding the rotation preventing portions 157L and 157R of the cartridges C and provided with guiding portions 243*f* for guiding the portions-to-be-guided 144*m* of the tray 144.

Each of the guiding portions 243*a*-243*d* of the rail 243 has a shape such that a movement direction is substantially perpendicular to the belt 130 immediately before contact of each cartridge C with the belt 130, and prevents sliding between the drum 1 and the belt 130 during the contact and separation operation. The apparatus main assembly 101 is provided with main assembly-side positioning portions 117 (FIG. 30) engageable with the portions-to-be-positioned 158L and 158R of each cartridge C.

The door 140 is provided with gears 140*c* having the same centers as the rotation shafts 210 of the door 140. The apparatus main assembly 101 is provided with gears 246 engageable with the gears 140*c* and provided with gears 245 engageable with the gears 246. Each gear 245 is provided with a groove 245*a* (FIG. 29) engageable with the portion-to-be-guided 144*n* of the tray 144. connected with the link groove 209 of the door 140 at the boss portion 214 provided in one end portion thereof, and is rotatably supported by the apparatus main assembly 101 at a door link fulcrum 211 provided at the end portion.

(Positional Movement Operation of Tray)

With reference to FIGS. 30 and 31, a positional movement operation of the tray 144 in the order of the outside position F, the second inside position and the first inside position D and a drum pitch changing operation between the cartridges C will be described. In FIG. 30, (a), (b) and (c) show operations of the respective units at the outside position F, the second inside position E and the first inside position D, respectively. In FIG. 31, (a) and (b) show a change in drum pitch between the cartridges at the first inside position D and the second inside position E of the tray 144.

First, the cartridges C are mounted in the tray 144. Each cartridge C is inserted into the tray 144 in a drop-in manner. When each cartridge C is inserted into the tray 144, each of the driving side rotation preventing portion 147R and the non-driving side rotation preventing portion 157L is gradually engaged with the associated ones of the guiding portions 144*a*, 144*b*, 144*c* and 144*d* in the tray 144 side. In this state, the cartridges C are mounted with a drum distance P2 so as to be independently mountable from above and dismountable upward ((a) of FIG. 30).

Next, the tray 144 is moved from the outside position F to the second inside position E. When the tray 144 is inserted into the second inside position E inside the apparatus main assembly, the portions-to-be-guided 144*m* disposed on the side surfaces of the tray 144 are guided by the guiding portions 243*f* of the rails 243 provided in the apparatus main assembly 101. When the tray 144 reaches the second inside position E ((b) of FIG. 30), the portions-to-be-guided 144*n* contact the guiding portions 243 of the rails 243 and are placed in the engaged state with the grooves 245*a* of the gears 245 ((b) of FIG. 30).

Next, the tray 144 is moved from the second inside position E to the first inside position D. When the user closes the door 140, the gears 140*c* rotate counterclockwise in FIG. 30, thus rotating the gears 246, connected with the gears 140*c*, and the gears 245 ((c) of FIG. 30). When the gears 245 rotate clockwise, by the rotation of the grooves 245*a*, the portions-to-be-guided 144*n* of the tray 144 are moved in the arrow direction in (a) of FIG. 31 while the movement direction thereof is regulated by the guiding portions 243*f* of the rails 143. At the same time, the portions-to-be-guided 144*m* of the tray 144 are moved in the arrow direction by being guided by the guiding portions 143*f* of the rails 143.

At this time, the rotation preventing portions 157L and 157R of the contacts C contact the guiding portions 144*a*-144*d* of the tray 144 and the guiding portions 243*a*-243*d* of the rail 243, and the movement directions thereof are regulated. By the movement of the tray 144, the movement direction of each cartridge C is regulated, and therefore is moved in the arrow direction in (a) of FIG. 31.

At that time, the portions-to-be-portioned 158L and 158R of each cartridge C are engaged with the main assembly-side positioning portions 117 in the apparatus main assembly 101 ((a) of FIG. 30). As a result, the cartridges C are positioned relative to the apparatus main assembly with a drum distance P1, and contact the belt 130. In this case P1<P2 is satisfied.

Next, with reference to FIGS. 30 and 31, a positional movement operation of the tray 144 in the order of the first inside position D, the second inside position E and the outside position F and a drum pitch changing operation between the cartridges C will be described.

First, the positional movement operation of the tray 144 from the first inside position D to the second inside position E will be described. When the user opens the door 140 located at the closed position A ((c) of FIG. 30), the gears 140*c* rotate counterclockwise, thus rotating the gears 246, connected with the gears 140*c*, and the gears 245 in the arrow directions ((b) of FIG. 31). When the gears 245 rotate counterclockwise, by the rotation of the grooves 245*a*, the portions-to-be-guided 144*n* of the tray 144 are moved in the arrow direction while the movement direction thereof is regulated by the guiding portions 243*f* of the rails 143. At the same time, the portions-to-be-guided 144*m* of the tray 144 are moved in the arrow direction by being guided by the guiding portions 143*f* of the rails 143.

At this time, the movement directions of the rotation preventing portions 157L and 157R of the contacts C are regulated by the guiding portions 144*a*-144*d* of the tray 144 and the guiding portions 243*a*-243*d* of the rail 243.

In this way, by the movement of the door 140 from the closed position A ((c) of FIG. 30) to the open position B ((b) of FIG. 30), the tray 144 is moved from the first inside position D to the second inside position E. Then, by this movement of the tray 144, each cartridge is moved in the arrow direction while the movement direction thereof is regulated. As a result, by the movement of the tray 144 to the second inside position E, the cartridges C in the tray 144 are spaced from the belt 130 with the drum distance P2. At this time, P1<P2 is satisfied.

Further, the tray 144 is pulled out from the second inside position E ((b) of FIG. 30) to the outside position F ((a) of FIG. 30). The adjacent cartridges C are held in the tray 144 at a non-overlapping position with respect to the up-down direction. For that reason, as shown in (a) of FIG. 30, each cartridge C can be dismounted toward right above.

In this way, in interrelation with the opening operation of the door 140, the drum pitch between the adjacent cartridges C is increased, whereby during the mounting and dismounting of the cartridges C, it is possible to ensure a mounting locus along which the adjacent cartridges C do not interfere with each other. As a result, the cartridges C can be individually pulled out in the upward direction, so that usability is improved. Further, the drum pitch is decreased in interrelation with the closing operation of the door 140, and therefore it is possible to shorten the FPOT.

Further, in this embodiment, the ITB type using the intermediary transfer belt 130 is described, but a similar effect can be obtained also in the ETB type using the electrostatic conveyer belt (FIG. 32). In FIG. 32, 6A represents an electrostatic conveyer belt unit. Further, in this embodiment, the tray spacing method using the translation type is described, but may also be changed to a tray spacing method using the above-described rotation movement type.

Embodiment 2

General Structure of Image Forming Apparatus

FIG. 2 of the present invention will be described. In this embodiment, constituent members or portions similar to those of the image forming apparatus in Reference Examples 1 and 2 described above are represented by the same reference numerals or symbols and will be omitted from redundant description. Further, indication of the reference numerals or symbols in the drawings in partly omitted.

(General Structure of Image Forming Apparatus)

With reference to FIG. 27, an outline of a general structure of an image forming apparatus 100 in this embodiment will be described. FIG. 27 is a schematic sectional view of the image forming apparatus 100 in a state in which the door 140 is located at the closed position A and in which the tray 144 is located at the first inside position D.

In this embodiment, relative to the intermediary transfer belt 130, the cartridges C and the scanner 120 are disposed in the upper side. By employing such an arrangement, the image forming apparatus 100 is advantageous in terms of toner scattering from the cartridges C to the scanner 120, and toner supply to the drums 1 can be made by utilizing self-weight of the toner. Therefore, the toner supplying means can be simplified, so that it is possible to realize downsizing and cost reduction.

Embodiment 3

General Structure of Image Forming Apparatus

Embodiment 3 of the present invention will be described. In this embodiment, constituent members or portions similar to those of the image forming apparatus in Reference Examples 1 and 2 and Embodiments 1 and 2 described above are represented by the same reference numerals or symbols and will be omitted from redundant description. Further, indication of the reference numerals or symbols in the drawings is partly omitted.

(General Structure of Image Forming Apparatus)

With reference to FIG. 33, an outline of a general structure of an image forming apparatus 100 in this embodiment will be described. FIG. 33 is a schematic sectional view of the image forming apparatus 100 in a state in which the door 140 is located at the closed position A and in which the tray 144 is located at the first inside position D.

In this embodiment, relative to the intermediary transfer belt 130, the cartridges C and the scanner 120 are disposed in the upper side. By employing such an arrangement, the image forming apparatus 100 is advantageous in terms of toner scattering from the cartridges C to the scanner 120, and toner supply to the drums 1 can be made by utilizing self-weight of the toner. Therefore, the toner supplying means can be simplified, so that it is possible to realize downsizing and cost reduction.

In this embodiment, different from Embodiments 1 and 2 described above, the scanner 120 and the belt 130 are disposed so as to provide a small distance therebetween, so that it becomes possible to further downsize the main assembly. Further, the tray 144 and the belt unit 6 are disposed so as to be movable toward and away from the cartridges C. In a contact and separation operation described later, a space between the belt unit 6 and a feeding tray 102 is utilized. This space is used when the user inserts his (her) hands into the space and then exchanges (replaces) the feeding roller or during clearance of a paper jam.

(Structure of Tray and Peripheral Members)

With reference to FIG. 33, structures of the tray and peripheral members of the tray 144 will be described. The tray 144 roughly supports the cartridges CY, CM, CC and CK. Each of the right frame portion (driving side) and the left frame portion (non-driving side) is provided with guiding portions 144*a*, 144*b*, 144*c* and 144*d* for guiding the associated rotation preventing portions 157R and 157L of the cartridges C.

Further, the tray 144 is provided with rotation centers 201 used during the contact and separation operation, portions-to-be-guided 144*k* used during an insertion and pulling-out operation interrelating portions 144*h* interrelated with an opening and closing operation of the door 140. The portions-to-be-guided 144*k* contact rails 343 provided in the apparatus main assembly 101 at the second inside position (spaced position) E of the tray 144.

The belt unit 6 is provided with rotation centers 6*b* used during the contact and separation operation and interrelating portions 6*a* interrelated with the opening and closing operation of the door 140. The door 140 is provided with link grooves 209 and rotation shafts 210, and the rotation shafts 210 are rotatably supported by the apparatus main assembly 101. Each of the door links 141 is movably connected with the link groove 209 of the door 140 at the boss portion 214 provided in one end portion thereof, and is rotatably supported by the apparatus main assembly 101 at a door link fulcrum 211 provided at the end portion. Each of the door links 141 is provided with guiding portions 141*c* and 141*d* which slidably contact the interrelating portion 6*a* of the belt unit 6 and the interrelating portions 144*h* of the tray, respectively.

(Positional Movement Operation of Tray)

With reference to FIG. 34, a positional movement operation of the tray 144 and a drum pitch changing operation between the cartridges C will be described. In FIG. 34, (a) and (b) show a change in drum pitch during the positional movement operation of the tray 144.

When the user closes the door 140 from the open position B to the closed position A, by the guiding portions 141*d* of the door links 141, in (a) of FIG. 34, the door links 141 slidably connected with the link grooves 209 of the door 140 rotate about the door link fulcrums 211 in the erecting direction indicated by the arrow. By rotation of the door links 141, the interrelating portions 6*a* of the belt unit 6 receive a force from the guiding portions 141*c* of the door links 141, so that the belt unit 6 rotates in the arrow direction. Similarly, the interrelating portions 144*h* of the tray 144 receives a force from the guiding portions of the door link 141, so that the tray 144 rotates in the arrow direction.

By this operation, first, the movement of the tray 144 from the second inside position E to the first inside position D by the guiding portions 141*d* of the door link 141 is ended. At this time, the cartridges C are moved in arrow directions by self-weight while the rotation preventing portions 157L and 157R are guided by the guiding portions 144*a*, 144*b*, 144*c* and 144*d*. The portions-to-be-portioned 158L and 158R of each cartridge C are engaged with the main assembly-side positioning portions (not shown) provided in the apparatus main assembly 101 and as a result, the cartridges C are positioned relative to the apparatus main assembly 101 while providing the drum pitch P1. After the cartridges C are positioned relative to the apparatus main assembly 101, the movement of the belt unit 6 to the contact position by the guiding portions 141*c* of the door links 141 is ended. As a result, the cartridges C contact the belt 130 of the belt unit 6 with the drum distance P1. In this case P1<P2 is satisfied.

Next, the positional movement operation of the tray 144 from the first inside position D to the second inside position E will be described. When the user opens the door 140 from the closed position A to the open position B, in (b) of FIG. 34, the door links 141 rotate about the door link fulcrums 211 in the fall-forward direction indicated by the arrow.

By this rotation of the door links 141, while the interrelating portions 6*a* of the belt unit 6 side with the door links 141, the belt unit 6 rotates in the arrow direction by the self-weight thereof and then is spaced from the cartridges. Then, while the interrelating portions 144*h* of the tray 144 slide with the guiding portions 141*d* of the door links 141, the tray 144 rotates in the arrow direction by the self-weight thereof, and thus moves from the first inside position D to the second inside position E.

At this time, each cartridge C slides on the guiding surfaces 159 and 160 by self-weight thereof. The rotation preventing portions 157L and 157R of the cartridges C are guided by the guiding portions 144*a*, 144*b*, 144*c* and 144*d* of the tray 144, and therefore, the cartridges C are moved in arrow directions. As a result, at the second inside position E of the tray 144, the cartridges C are held in the tray 144 with the drum distance P2. At this time, P1<P2 is satisfied.

When the tray 144 is further pulled out from the second inside position E to the outside position F, each cartridge C can be dismounted toward right above since the adjacent cartridges C are held in the tray 144 at a non-overlapping position.

In this way, in interrelation with the opening operation of the door 140, the drum pitch between the adjacent cartridges C is increased, whereby during the mounting and dismounting of the cartridges C, it is possible to ensure a mounting locus along which the adjacent cartridges C do not interfere with each other. As a result, the cartridges C can be individually pulled out in the upward direction, so that usability is improved. Further, the drum pitch is decreased in interrelation with the closing operation of the door 140, and therefore it is possible to shorten the FPOT.

In this way, the belt unit 6 and the tray 144 are moved at the same time, so that there is no need to ensure a space, for permitting the movement of the tray, between the belt unit 6 and the tray 144. The space used during the movement of the belt unit 6 and the tray 144 is an already-exiting user operation space and therefore there is no need to ensure a new space, so that it becomes possible to downsize en engine.

Further, in this embodiment, the ITB type using the intermediary transfer belt 130 is described, but a similar effect can be obtained also in the ETB type using the electrostatic conveyer belt. Further, in this embodiment, the tray spacing method using the rotation movement type is described, but may also be changed to a tray spacing method using the translation type (horizontal movement) type described above.

Embodiment 4

General Structure of Image Forming Apparatus

Embodiment 4 of the present invention will be described. In this embodiment, constituent members or portions similar to those of the image forming apparatus in Reference Examples 1 and 2 and Embodiments 1 to 3 described above are represented by the same reference numerals or symbols and will be omitted from redundant description. Further, indication of the reference numerals or symbols in the drawings is partly omitted.

(General Structure of Image Forming Apparatus)

With reference to FIG. 35, an outline of a general structure of an image forming apparatus 100 in this embodiment will be described. FIG. 35 is a schematic sectional view of the image forming apparatus 100 in a state in which the door 140 is located at the closed position A and in which the tray 144 is located at the first inside position D.

In this embodiment, relative to the intermediary transfer belt 130, the cartridges C are disposed in the lower side. By employing such an arrangement, the distance from a position where the image is formed on the drum to a position where the image is transferred onto the recording material can be shortened, and therefore it becomes possible to shorten the FPOT.

In this embodiment, different from Embodiments 1 to 3 described above, the tray 144 and the laser scanner 120 are disposed so as to be movable toward and away from the cartridges C. In a contact and separation operation described later, a space between the scanner 120 and a feeding tray 102 is utilized. This space is used when the user inserts his (her) hands into the space and then exchanges (replaces) the feeding roller or during clearance of a paper jam.

(Structure of Tray and Peripheral Members)

With reference to FIG. 33, structures of the tray and peripheral members of the tray 144 will be described. The tray 144 roughly supports the cartridges CY, CM, CC and CK. The tray 144 is provided with the rotational fulcrum (portions-to-be-guided) 201 used during the contact and separation operation, portions-to-be-guided 144*k* used during an insertion and pulling-out operation interrelating portions 144*h* interrelated with an opening and closing operation of the door 140. Each of the right frame portion (driving side) and the left frame portion (non-driving side) is provided with guiding members 144*a*, 144*b*, 144*c* and 144*d* for guiding the associated rotation preventing portions 157R and 157L of the cartridges C.

The guiding members 144*a*-144*d* are slidably or rotatably mounted to the tray 144, and are urged in arrow directions in FIG. 35 by springs 146*a*-146*d*, respectively, mounted to the tray 144. In the apparatus main assembly, the main assembly-side positioning portions 117 ((b) of FIG. 36) engageable with the portions-to-be-engaged 158L and 158R of the cartridges C are disposed for each of the cartridges C. The guiding members 144*a*-144*d* urge, at the first inside position D of the tray 144, the cartridges C, respectively, toward the main assembly-side cartridge positioning portions in the apparatus main assembly. The laser scanner 120 is provided with the portions-to-be-guided 120*b* used during the contact and separation operation, the interrelating portions 120*a* interrelated with the opening and closing operation of the door 140 and the portions-to-be-positioned 120*c* relative to the apparatus main assembly 101. The portions-to-be-positioned 120*c* contact, at the contact position, main assembly-side scanner developing portions 162 provided in the apparatus main assembly 101.

The left and right frames of the apparatus main assembly 101 are provided with a pair of rails 443 which guide the portions-to-be-guided 144*k* of the tray 144 during the insertion and pulling-out of the tray 144. The rails 443 is provided with bearing portions (guiding portions) 443*a* for holding the rotational fulcrums (portions-to-be-guided) 201 during the contact and separation operation. The rails 443 are provided with guiding portions 443*b* for guiding the portions-to-be-guided 120*b* during the contact and separation operation of the laser scanner 120. Each of the door links 141 is provided with guiding portions 141*d* which slidably contact the interrelating portions 144*h* of the tray. Further, the door links 141 are provided with the guiding grooves 141*c* along which movable sliders 142 and slider urging springs 147 are mounted.

Each of the slider 142 is slidably connected with the interrelating portion 120*a* of the laser scanner 120, and urges at the contact position, the portions-to-be-positioned 120*c* toward the main assembly-side scanner positioning portion 462.

(Positional Movement Operation of Tray)

With reference to FIG. 36, the contact and separation operation of the tray 144 interrelated with the door 140 and of the laser scanner 120 and a drum pitch changing operation between the cartridges C will be described. In FIG. 36, (a) and (b) show a change in drum pitch during the contact and separation operation of the tray 144.

First, the movement operation of the tray 144 from the second inside position E to the first inside position D will be described. When the user closes the door 140 from the open position B to the closed position A, by the guiding portions 141*d* of the door links 141, in (a) of FIG. 34, the door links 141 slidably connected with the link grooves 209 of the door 140 rotate about the door link fulcrums 211 in the erecting direction indicated by the arrow.

By rotation of the door links 141, the interrelating portions 120*a* of the laser scanner 120 are urged by the sliders 142 urged by the slider urging spring 147, so that the laser scanner 120 rotates in the arrow direction. The portions-to-be-positioned 120*c* of the laser scanner 120 contact the main assembly-side scanner positioning portions 462 provided in the apparatus main assembly 101, so that the laser scanner 120 is positioned relative to the apparatus main assembly 101.

Similarly, by the rotation of the door links 141, the interrelating portions 144*h* of the tray 144 receives a force from the guiding portions of the door link 141, so that the tray 144 rotates in the arrow direction. At this time, the cartridges C are moved in arrow directions by self-weight while the rotation preventing portions 157L and 157R are guided by the guiding members 144*a*, 144*b*, 144*c* and 144*d*. The portions-to-be-portioned 158L and 158R are urged toward the main assembly-side positioning portions 161, provided in the apparatus main assembly 101, by the guiding members 144*a*-144*d* urged by the springs 146*a*-146*d*. As a result, the cartridges C are positioned relative to the apparatus main assembly 101 while providing the drum distance P1. As a result, the cartridges C contact the belt 130 with the drum distance P1. In this case, P1<P2 is satisfied.

The positional movement operation of the tray 144 from the first inside position D to the second inside position E will be described. When the user opens the door 140 from the closed position A to the open position B, in (b) of FIG. 36, the door links 141 rotate about the door link fulcrums 211 in the fall-forward direction indicated by the arrow.

By this rotation of the door links 141, the interrelating portions 120*a* of the laser scanner 120 are moved to the spaced position along the guiding grooves 141 while comprising the slider urging springs 147. By the rotation of the door links 141, while the interrelating portions 144*h* of the tray 144 slide with the guiding portions 141*d* of the door links 141, the tray 144 rotates in the arrow direction, and thus moves from the first inside position D to the second inside position E.

At this time, each cartridge C slides on the guiding surfaces 159 and 160 by self-weight thereof. The rotation preventing portions 157L and 157R of the cartridges C are guided by the guiding members 144*a*, 144*b*, 144*c* and 144*d* of the tray 144, and therefore, the cartridges C are moved in arrow directions. As a result, at the second inside position E of the tray 144, the cartridges C are held in the tray 144 with the drum distance P2. At this time, P1<P2 is satisfied.

When the tray 144 is further pulled out from the second inside position E to the outside position F, each cartridge C can be dismounted toward right above since the adjacent cartridges C are held in the tray 144 at a non-overlapping position.

In this way, in interrelation with the opening operation of the door 140, the drum pitch between the adjacent cartridges C is increased, whereby during the mounting and dismounting of the cartridges C, it is possible to ensure a mounting locus along which the adjacent cartridges C do not interfere with each other. As a result, the cartridges C can be individually pulled out in the upward direction, so that usability is improved. Further, the drum pitch is decreased in interrelation with the closing operation of the door 140, and therefore it is possible to shorten the FPOT.

In this way, the laser scanner 120 and the tray 144 are moved at the same time, so that there is no need to ensure a space, for permitting the movement of the tray, between the laser scanner 120 and the tray 144. The space used during the movement of the laser scanner 120 and the tray 144 is an already-exiting user operation space and therefore there is no need to ensure a new space, so that it becomes possible to downsize en engine.

Further, in this embodiment, the ITB type using the intermediary transfer belt 130 is described, but a similar effect can be obtained also in the ETB type using the electrostatic conveyer belt. Further, in this embodiment, the tray spacing method using the rotation movement type is described, but may also be changed to a tray spacing method using the translation type (horizontal movement) described above.

<Summarization>

The constitutions of the image forming apparatuses in Embodiments 1 to 4 are summarized as follows.

(1) Each of the image forming apparatuses is the image forming apparatus 100 capable of forming the color image, and includes the movable member 144 movable to the outside position F, the first inside position D and the second inside position E while supporting the plurality of the cartridges C, arranged in the arranging direction, which contributes to the image formation.

The outside position F is the position where the plurality of the cartridges C are detachably mountable, outside the apparatus main assembly 101 of the image forming apparatus 100, in the direction crossing the arranging direction and the longitudinal direction of the cartridges C. The first inside position D is the position where the cartridges C are located at the mounting positions where the cartridges C are capable of performing the image forming operation inside the apparatus main assembly 101. The second inside position E is the position located, inside the apparatus main assembly 101, partway of the movement path between the outside position F and the first inside position D.

The movable member 144 supports the cartridges C so that the distance between the adjacent two cartridges of the cartridges C in the arranging direction is increased in interrelation with the movement thereof from the first inside position D to the second inside position E.

That is, the movable member 144 supports the cartridges C so that the adjacent two cartridges slide with each other to increase the distance therebetween in the arranging direction by the movement of the movable member 144 from the first inside position D to the second inside position E.

(2) The apparatus main assembly 101 is provided with the opening 115 through which the movable member 144 is passable when moving between the outside position F and the second inside position E, and is provided with the openable member 140 movable between the open position B where the opening 115 is exposed (open) and the closed position A where the opening 115 is closed. Further, the apparatus main assembly 101 is provided with the interrelating member movable in interrelation with the movement of the movable member. The interrelating member moves the movable member to the second inside position E when the openable member 140 is located at the open position B and moves the movable member to the first inside position D when the openable member 140 is located at the closed position A.

(3) The movable member 144 is movable between the first inside position D and the second inside position E by rotationally moving about the rotation center 201.

(4) The movable member 144 is in the inclined state with respect to the horizontal surface at the first inside position D, and is in the substantially horizontal state at the second inside position E.

(5) The movable member 144 supports the cartridges C so that the above-described distance is decreased by the movement thereof from the second inside position E to the first inside position D.

(6) The movable member 144 supports the cartridges C so that the distance is increased by sliding between the cartridges C caused by the movement thereof from the first inside position D to the second inside position E.

(7) The apparatus main assembly 101 includes the guiding portion engageable with the cartridge. This guiding portion decreases the distance when the movable member 144 moves from the second inside position E to the first inside position D, and increases the distance when the movable member 144 moves from the first inside position D to the second inside position E.

(8) The apparatus main assembly 101 includes the belt 130 stretched by the plurality of rollers 150 and 121. At the first inside position D of the movable member 144, the cartridge C or the image bearing member 1 supported by the movable member 144 contacts the belt 130.

(9) The apparatus main assembly 101 includes the exposure means 120 for exposing the image bearing member 1 to light.

(10) The apparatus main assembly 101 is provided with the opening 115 through which the movable member 144 is passable when moving between the outside position F and the second inside position E, and is provided with the openable member 140 movable between the open position B where the opening 115 is exposed (open) and the closed position A where the opening 115 is closed. Further, the apparatus main assembly 101 is provided with the interrelating member movable in interrelation with the movement of the movable member. The interrelating member moves the movable member to the second inside position E when the openable member 140 is located at the open position B and moves the movable member to the first inside position D when the openable member 140 is located at the closed position A. Further, the belt 130 is moved in interrelation with the movement of the openable member 140.

(11) The apparatus main assembly 101 is provided with the opening 115 through which the movable member 144 is passable when moving between the outside position F and the second inside position E, and is provided with the openable member 140 movable between the open position B where the opening 115 is exposed (open) and the closed position A where the opening 115 is closed. Further, the apparatus main assembly 101 is provided with the interrelating member movable in interrelation with the movement of the movable member. The interrelating member moves the movable member to the second inside position E when the openable member 140 is located at the open position B and moves the movable member to the first inside position D when the openable member 140 is located at the closed position A. Further, the exposure means 120 is moved in interrelation with the movement of the openable member 140.

Other Embodiments (a) The cartridge C is not limited to the process cartridge of the integral type in which the image bearing member 1, on which the latent image is to be formed, and the developing means 3 for developing the latent image formed on the image bearing member 1 are provided as in the embodiments described above.

The cartridge C may also be the process cartridge of the function separation type in which the image bearing member 1, on which the latent image is to be formed, and the image forming process means other than the developing means for developing the latent image formed on the image bearing member 1 are provided.

The cartridge C may also be the developing cartridge in which the developing means 3 for developing the latent image formed on the image bearing member 1 for forming the latent image and the developer accommodating portion in which the developer used for developing the latent image is accommodated are provided.

The cartridge C may include other units, such as the developer cartridge in which the developer is accommodated, which are detachably mounted to the apparatus main assembly 101 and which contribute to the image forming process for forming the image on the recording material.

The cartridge C may also be a combination of the above-described process cartridge of the function separation type with the above-described developing cartridge.

(b) The constitution of the image forming apparatus in which the image bearing member 1 on which the latent image is to be formed is fixedly mounted in the apparatus main assembly 101 or the movable member 144 and in which the cartridge C is the image forming process means actable on the image bearing member 1 may also be employed.

(c) The image forming process of the image forming apparatus is not limited to the electrophotographic process, but may also be the electrostatic recording process using the electrostatic recording dielectric member as the image bearing member and the magnetic recording process using the magnetic recording (magnetic) material as the image bearing member.

(d) It is also possible to constitute image forming apparatuses obtained by appropriately and selectively combining constituent elements of the image forming apparatuses of Reference Examples 1 and 2 and Embodiments 1 to 4.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 170303/2013 filed Aug. 20, 2013, which is hereby incorporated by reference.

What is claimed is:

1. An image forming apparatus capable of forming a color image on a recording material, comprising:

a movable member, movable between a first inside position and a second inside position and between the second inside position and an outside position, supporting a plurality of cartridges which contribute to image formation and which are arranged in an arranging direction, wherein the outside position is a position where the cartridges are detachably mountable outside a main assembly of said image forming apparatus in a direction crossing with the arranging direction and with a longitudinal direction of each of the cartridges, the first inside position is a position where the cartridges are positioned inside the main assembly at a mounting position where the cartridges are capable of performing an image forming operation, and the second inside position is inside the main assembly partway of a movement path between the outside position and the first inside position, wherein said movable member supports the cartridges so that a distance between two adjacent cartridges of the cartridges is increased with respect to the arranging direction in interrelation with movement of said movable member from the first inside position to the second inside position.

2. An image forming apparatus according to claim 1, wherein said main assembly includes:

an opening though which said movable member passes when said movable member moves between the outside position and the second inside position;

an openable member movable between an open position where said opening is open and a closed position where said opening is closed; and an interrelating member, movable in interrelation with movement of said openable member, for moving said movable member to the second outside position when said openable member is located at the open position and for moving said movable member to the first inside position when said openable member is located at the closed position.

3. An image forming apparatus according to claim 1, wherein said movable member is movable between the first inside position and the second inside position by moving rotationally about a rotation center.

4. An image forming apparatus according to claim 1, wherein said movable member is in an inclined state with respect to a horizontal surface at the first inside position, and is in a substantially horizontal state at the second inside position.

5. An image forming apparatus according to claim 4, wherein said movable member supports the cartridges so that the distance is decreased by movement thereof from the second inside position to the first inside position.

6. An image forming apparatus according to claim 4, wherein said movable member supports the cartridges so that the distance is increased by movement thereof from the first inside position to the second inside position to cause sliding between the two adjacent cartridges.

7. An image forming apparatus according to claim 1, wherein said main assembly includes a guiding portion, engageable with the cartridges, for decreasing the distance when said movable member moves from the second inside position to the first inside position and for increasing the distance when said movable member moves from the first inside position to the second inside position.

8. An image forming apparatus according to claim 1, wherein said main assembly includes a belt stretched by a plurality of rollers, and wherein at the first inside position of said movable member, the cartridges or image bearing members supported by said movable member contact said belt.

9. An image forming apparatus according to claim 8, wherein said the main assembly includes exposure means for exposing the image bearing members to light.

10. An image forming apparatus according to claim 8, wherein said main assembly includes:

an opening though which said movable member passes when said movable member moves between the outside position and the second inside position;

an openable member movable between an open position where said opening is open and a closed position where said opening is closed; and an interrelating member, movable in interrelation with movement of said openable member, for moving said movable member to the second outside position when said openable member is located at the open position and for moving said movable member to the first inside position when said openable member is located at the closed position, wherein said belt is movable in interrelation with the movement of said openable member.

11. An image forming apparatus according to claim 9, wherein said main assembly includes:

an opening though which said movable member passes when said movable member moves between the outside position and the second inside position;

an openable member movable between an open position where said opening is open and a closed position where said opening is closed; and an interrelating member, movable in interrelation with movement of said openable member, for moving said movable member to the second outside position when said openable member is located at the open position and for moving said movable member to the first inside position when said openable member is located at the closed position, wherein said exposure means is movable in interrelation with the movement of said openable member.

12. An image forming apparatus according to claim 8, wherein the image bearing member is an electrophotographic photosensitive member.

13. An image forming apparatus according to claim 1, wherein each of the cartridges is a process cartridge of an integral type including an image bearing member for forming a latent image and developing means for developing, with a developer, the latent image formed on the image bearing member.

14. An image forming apparatus according to claim 1, wherein each of the cartridges is a process cartridge of a separation type including an image bearing member for forming a latent image and image forming process means other than developing means for developing, with a developer, the latent image formed on the image bearing member.

15. An image forming apparatus according to claim 1, wherein each of the cartridges is a developing cartridge including developing means for developing, with a developer, a latent image formed on an image bearing member and a developer accommodating portion for accommodating the developer used for developing the latent image.

16. An image forming apparatus according to claim 1, wherein the cartridges include a combination of a process cartridge of a separation type including an image bearing member for forming a latent image and image forming process means other than developing means for developing, with a developer, the latent image formed on the image bearing member, and a developing cartridge including developing means for developing, with a developer, a latent image formed on an image bearing member and a developer accommodating portion for accommodating the developer used for developing the latent image.

17. An image forming apparatus according to claim 1, wherein an image bearing member for forming a latent image is fixedly mounted to said main assembly or said movable member, and wherein each of the cartridges is image forming process means actable on the image bearing member.

* * * * *